US010267037B2

(12) United States Patent
Stewart

(10) Patent No.: US 10,267,037 B2
(45) Date of Patent: Apr. 23, 2019

(54) INSULATING CONCRETE FORM SYSTEM

(71) Applicant: Cooper E. Stewart, Pelican Rapids, MN (US)

(72) Inventor: Cooper E. Stewart, Pelican Rapids, MN (US)

( * ) Notice: Subject to any disclaimer, the term of this patent is extended or adjusted under 35 U.S.C. 154(b) by 0 days.

(21) Appl. No.: 15/588,556

(22) Filed: May 5, 2017

(65) Prior Publication Data

US 2017/0321419 A1 Nov. 9, 2017

Related U.S. Application Data

(60) Provisional application No. 62/332,843, filed on May 6, 2016.

(51) Int. Cl.

| | |
|---|---|
| ***E04B 2/28*** | (2006.01) |
| ***E04G 9/02*** | (2006.01) |
| ***E04G 11/06*** | (2006.01) |
| ***E04G 17/07*** | (2006.01) |
| ***E04G 9/10*** | (2006.01) |

(Continued)

(52) U.S. Cl.

CPC ..... *E04B 2/8635* (2013.01); *E04B 2/8641* (2013.01); *E04G 9/02* (2013.01); *E04G 9/10* (2013.01); *E04G 11/06* (2013.01); *E04G 17/0758* (2013.01); *E04B 2002/867* (2013.01);

(Continued)

(58) Field of Classification Search

CPC . E04B 2/8635; E04B 2002/867; E04G 11/06; E04G 9/02; E04G 17/0758; E04G 2017/0638

See application file for complete search history.

(56) References Cited

U.S. PATENT DOCUMENTS 2,062,724 A * 12/1936 Olsen ..... E04B 2/8635 52/422
3,888,456 A * 6/1975 Umstead ..... E04G 17/02 249/216

(Continued)

FOREIGN PATENT DOCUMENTS

CA 2500682 A1 * 9/2005 ..... E04B 2/8635
CA 2795821 A1 * 11/2011 ..... E04B 2/8635

(Continued)

*Primary Examiner* — Jeanette E Chapman
(74) *Attorney, Agent, or Firm* — Richard Joun Bartz

(57) ABSTRACT

The insulating concrete form system includes longitudinal and corner block assemblies each having a pair of side panels configured with tie receivers interacting with panel spacing ties to hold the side panels in an opposing manner and leading edges with an alternating arrangement of projections and recesses for interlocking with neighboring block assemblies. Each panel spacing tie includes a mid-support section interposing in between and connecting to a pair of end sections by a living hinge with each end section being configured with a flange member for placement within an opposing spatial wedge of the tie receiver, whereby the living hinge possesses the capability of allowing the side panels to move inwardly toward one another in a racked position to yield compactness of the longitudinal block assembly for economical transport. The corner block assembly also includes corner panel spacing ties to supplementally reinforce its structure to withstand hydrostatic blowout caused by poured concrete.

55 Claims, 38 Drawing Sheets

(51) Int. Cl.
*E04B 2/86* (2006.01)
*E04G 17/075* (2006.01)
*E04G 17/06* (2006.01)

(52) U.S. Cl.
CPC ..... *E04B 2002/8694* (2013.01); *E04G 2017/0638* (2013.01)

(56) References Cited

U.S. PATENT DOCUMENTS 4,706,429 A * 11/1987 Young ..... E04B 2/8641 52/309.12
4,884,382 A * 12/1989 Horobin ..... E04B 2/8641 52/426
4,889,310 A * 12/1989 Boeshart ..... E04B 2/8641 249/41
4,916,879 A * 4/1990 Boeshart ..... E04B 2/8652 249/40
4,974,700 A * 12/1990 Gates ..... E04G 11/06 182/128
5,088,578 A * 2/1992 Gates ..... E04G 11/06 182/128
5,428,933 A * 7/1995 Philippe ..... E04B 2/54 464/124
5,657,600 A * 8/1997 Mensen ..... E04B 2/8617 52/309.12
5,704,180 A * 1/1998 Boeck ..... E04B 2/8652 249/216
5,896,714 A * 4/1999 Cymbala ..... E04B 2/8617 52/426
6,230,462 B1 * 5/2001 Beliveau ..... E04B 2/8617 52/426
6,668,502 B2 * 12/2003 Beliveau ..... E04B 2/8617 249/188
6,820,384 B1 * 11/2004 Pfeiffer ..... E04B 2/8617 52/309.15
7,739,846 B2 * 6/2010 Garrett ..... E04B 2/8617 52/426
7,805,906 B2 * 10/2010 Garrett ..... E04B 2/8617 52/379
8,037,652 B2 * 10/2011 Marshall ..... E02D 27/02 52/309.11
8,613,174 B2 * 12/2013 Garrett ..... E04B 2/8635 52/309.11
8,646,236 B2 * 2/2014 Hilliard, Sr. ..... E04B 2/8652 52/309.11
8,727,302 B2 * 5/2014 Braun ..... E04G 17/06 249/190
9,033,303 B2 * 5/2015 McDonagh ..... E04G 11/062 249/216
9,260,874 B2 * 2/2016 McDonagh ..... E04G 11/062
2002/0092253 A1 * 7/2002 Beliveau ..... B29C 44/1271 52/426
2003/0213198 A1 * 11/2003 Bentley ..... E04B 2/8617 52/415
2006/0117693 A1 * 6/2006 Garrett ..... E04B 2/8617 52/426
2007/0113505 A1 * 5/2007 Beliveau ..... E04B 2/8617 52/426
2008/0028709 A1 * 2/2008 Pontarolo ..... E04B 2/8647 52/426
2009/0013629 A1 * 1/2009 Boeshart ..... E04B 2/8617 52/426
2009/0107074 A1 * 4/2009 Boeshart ..... E04B 2/8617 52/426
2009/0256055 A1 * 10/2009 Foser ..... E04G 17/064 249/190
2009/0308011 A1 * 12/2009 Philippe ..... E04B 2/8635 52/426
2010/0282060 A1 * 11/2010 Duke ..... E04B 2/08 89/36.02
2012/0304570 A1 * 12/2012 Braun ..... E04G 17/06 52/426
2013/0263544 A1 * 10/2013 Pfeiffer ..... E04B 2/8617 52/407.1
2014/0259990 A1 * 9/2014 Pfeiffer ..... B28B 7/02 52/127.7
2014/0260055 A1 * 9/2014 Pfeiffer ..... E04G 17/12 52/582.1
2014/0301787 A1 * 10/2014 Skidmore ..... E21F 17/103 405/150.1
2014/0318062 A1 * 10/2014 Richardson ..... E04B 2/8635 52/309.1
2015/0159339 A1 * 6/2015 Castonguay ..... E02D 29/0225 405/284
2016/0281376 A1 * 9/2016 Ward ..... E04G 17/04
2017/0203226 A1 * 7/2017 Dorasamy ..... A63H 33/086
2017/0254072 A1 * 9/2017 Howorth ..... E04B 2/86

FOREIGN PATENT DOCUMENTS

CA 2801735 A1 * 7/2013 ..... E04B 2/8635
DE 102014012037 A1 * 2/2016 ..... E04G 11/06
WO WO-2005088033 A1 * 9/2005 ..... E04G 1/00

* cited by examiner

INSULATING CONCRETE FORM SYSTEM

CROSS-REFERENCE TO RELATED APPLICATIONS

This application claims the benefit of U.S. Provisional Patent Application No. 62/332,843, filed May 6, 2016, entitled "Insulating Concrete Form System," the disclosures of which, including all attached documents, are incorporated herein by reference in their entirety for all purposes.

FIELD OF THE INVENTION

The present invention generally relates to an Insulating Concrete Form (ICF) systems directed to the construction and fabrication of poured concrete walls in building structures and, more specifically, to improvements to the foam panels and associated panel spacing ties that appreciably allow for efficient manufacturing, economical shipping and field assembly of the ICF system.

BACKGROUND OF THE INVENTION

Traditional methods of constructing and fabricating poured concrete walls typically involve the usage of forms made from sheets of plywood, solid wood, metal, or plastic composites, whereby the sheets are held apart a predetermined distance, generally in a parallel arrangement, by a plurality of exteriorly placed structural members to form an interior cavity or space for receiving therewithin a specified amount of pourable concrete. After allowing the poured concrete to harden for an appreciable amount of time, the form assembly is systematically disassembled to leave a bare concrete wall for supplemental curing of the concrete to attain full structural strength thereof.

Like the traditional method of concrete wall formation, Insulating Concrete Form (ICF) systems utilize a stacked arrangement of foam panels or blocks in lieu of the noted sheets of material and a plurality of panel spacing ties in lieu of the exteriorly placed structural members to form the preferential shape of the interior cavity or space for receiving therewithin a specified amount of pourable concrete. Although the two methods share similar structural features in this regard, the ICF system has been fielded test and proven to offer superior performance characteristics over the traditional method of wall construction in terms of strength, flexibility, energy efficiency, and time and cost of fabrication and, in this regard, is considered the preferred method by which poured concrete walls are fabricated in building structures with space heating and cooling needs, notwithstanding some noteworthy limitations in the prior art. However, unlike the traditional method of wall construction, the foam panels or blocks of the ICF system are generally left intact to form part of the concrete wall structure insofar to offer a degree of thermal insulating qualities thereto.

In the particular instance of ICF systems, the foam panels may be made from rigid foam insulating materials and appropriately molded, cut, or extruded to comprise a variety of structural provisions that facilitate connection of the panel spacing ties thereto and provide for an interlocking relationship with neighboring panels to fulfill a unified and strengthened form assembly, such as the existence of an alternating arrangement of teeth or projections and spaces or sockets integrated within and along the upper and lower edges of the foam panel and tongue-and-groove configurations integrally present along the opposing vertical edges, as generally represented in U.S. Pat. No. 7,409,801 to Pfeiffer. Notwithstanding recent strides in the prior art in developing ICF systems comprising features for increasing rigidity and strength, perhaps as such to guard against hydrostatic blowout from excessive concrete pours and offer flexibility for onsite assembly, as generally exemplified by U.S. Pat. No. 6,935,081 to Dunn, et al., it is often observed that the foam panel may lack other structural provisions that are necessary and integral in fulfilling a finished concrete wall structure, such as exterior and internal drainage channels and outlets for the release and passing of water or accumulated moisture, means for even distribution of poured concrete within the interior cavity to mitigate occurrences of developing a honeycomb effect that can unduly compromise the strength of the concrete wall structure, integral chaseways adaptively suited for receiving and housing electrical wiring and plumbing lines, availability of continuous vertical supports for subsequent finishing of the insulated concrete wall structure, and so forth. It is often the case that these structural oversights within the foam panel are generally addressed at a later time during the construction phase of the building structure and completed by personnel other than by those responsible for erecting the ICF system and, consequently, can significantly add to the final cost of the finished concrete wall structure in terms of time to adequately accommodate the foregoing features at a moment of time well beyond placement of the ICF system.

Comparatively, the panel spacing ties may comprise one or more structural provisions that fulfill opportunities to lessen the effective volume of the ICF system for shipping purposes as well as to facilitate efficient onsite assembly of the foam panels or blocks constituting the ICF system. Commonly, in applications of onsite form assembly, the foam panels and panel spacing ties are shipped to the job site unassembled to maximize usage of the available shipping space in prospects of reducing costs as a tradeoff for erecting the concrete wall form assembly under the auspices of experienced onsite field personnel. In this instance, the panel forms are stackably arranged onsite in a manner conducive to forming a parallel wall structure with an interior cavity and appropriately held in this arrangement by means of fitting a number of flange members integral to the panel spacing ties within a series of formed grooves integral to the foam panels, paying particular attention not to unduly disrupt the integrity and alignment of the foam panels during installation of the panel spacing ties.

In an effort to reduce costly errors that may be inherently associated with the onsite assembly of the foam panels shipped apart from the panel spacing ties, there has been development in the art to pre-fit the panel spacing ties in full or in part within the foam panels during manufacture thereof in an attempt to offer a degree of compactness for economical shipping and, in some cases, simplify assembly by onsite field personnel.

One example of this approach is disclosed in U.S. Pat. No. 7,082,732 to Titishov, where the ICF system includes a panel spacing tie being fabricated as three separable components: a central web section held in between two end sections. The two end sections are described within the context of Titishov as being embedded in first and second foam panels during the manufacturing phase, while the central web section is hinged to the end sections by pins that permits the opposing foam panels to move inward toward one another in an offsetting, parallel manner to attain compactness for economical shipping and moved apart from one another in an expanded state during onsite assembly of the ICF system to form an interior cavity constituting the shape of the concrete wall structure.

Similar to Titishov in terms of attaining compactness of the ICF system for economical shipping, U.S. Pat. No. 6,915,613 to Wostal, et al. discloses an ICF system comprising in part a plurality of articulating spacers each composed of a pair of spacer links having elbow ends pivotally joined midway along the articulating spacer and opposite wall ends connected to protruding web portions of a web configured with anchoring plates embedded within the structure of the opposing foam panels. Pivotal movement of the spacer links about the elbow ends effectively collapses the articulating spacer in such a manner to form a parallel relationship of the spacer links while moving inward the connected, opposing foam panels to fulfill compactness of the ICF system. Conversely, movement of the spacer links apart from one another while being in a collapsible state beforehand establishes a linear relationship of the spacer links to the extent of openly expanding the foam panels to form an interior cavity for receiving therewithin pourable concrete constituting formation of the wall structure.

Although Titishov and Wostal each disclose a novel approach to fulfill compactness of the ICF system for economical shipping thereof and offer a modest degree of simplicity for onsite assembly of the ICF system, there are inherent disadvantages associated with each approach, most notably being attributed to the multitude of intricate components constituting the panel spacing tie that perhaps can subject it to failure in the backdrop of high manufacturing costs.

For example, the panel spacing ties in either Titishov or Wostal depend on the coordinated movement of a variety of sub-components that slidably engage with one another to facilitate compactness or expansion of the ICF system. It is conceivable within the context of their designs that an appreciable amount debris and other foreign matter could find its way within the intricate structure of the sub-components during onsite assembly of the ICF system that can unduly compromise the range of motion or sliding movement needed to effect complete and accurate assembly of the ICF system and, in instances of sizeable debris or amounts thereof interacting with the sub-components in particular, can render them completely inoperable or subject them to breakage. Furthermore, since structural portions of the panel spacing tie, such as the flange components thereof, permanently reside or are formed within the matrix of the foam panel during the manufacturing phase, any breakage of the sort mentioned above may require extensive repair or render the foam block assembly entirely useless, thus unnecessarily adding to the overall time and cost in completing the finished wall structure.

Accordingly, there remains a need for an ICF system that utilizes a plurality of foam panels or blocks incorporating structural attributes that appreciably advances the concrete wall structure toward completion without having to resort to further modification or alteration of the foam blocks at a moment of time well beyond the assembly of the ICF system, while offering a plurality of panel spacing ties that operably relies on a reduced number of moving sub-components to fulfill compactness of the ICF system for purposes of economical shipping and flexibility for either onsite and offsite assembly as additional cost saving measures for completing and finishing the concrete wall structure.

BRIEF SUMMARY OF THE INVENTION

In order to overcome the numerous drawbacks apparent in the prior art, an insulating concrete form (ICF) system has been devised for constructing and fabricating poured concrete walls in building structures, particularly incorporating interlocking foam panels operating in conjunction with panel spacing ties that effect efficient and economical manufacture, shipping and onsite assembly of the ICF system.

It is an object of the present invention to provide an ICF system that utilizes panel spacing ties having structural attributes that permit assembly and connection to the foam panels during the manufacturing phase yet allow for compactness for economical shipping of the ICF system, while fulfilling an opportunity to openly expand or separate apart the foam panels to form a strengthened interior cavity constituting the form of the concrete wall structure without the extensive interaction and effort of onsite field personnel.

It is an object of the present invention to provide an ICF system that utilizes foam panels or blocks comprising upper and lower edges featuring interlocking elements that fulfill connection with neighboring foam panels regardless of being oriented upward or downward, that is, whether the foam panel is flipped upward or downward to connect with an adjacent foam panel.

It is an object of the present invention to provide an ICF system that incorporates within the interior structure of the foam panel a plurality of marked chaseways suited for receiving and passing therethrough electrical wiring, communication lines, plumbing lines, etc. without unduly compromising the integrity or structural strength of the foam panel that may otherwise undesirably lead to blowout of the ICF system upon concrete placement.

It is a further object of the present invention to provide an ICF system that includes within the structure of the foam panel a plurality of integral recesses or channels that effect removal of accumulated moisture from the concrete wall structure after final completion thereof with further provisions for inhibiting the intrusion of debris and like foreign matter that can otherwise adversely affect the water-draining performance thereof.

It is yet another object of the present invention to provide an ICF system that includes metallic elements integrated within the structure of the panel spacing ties to fulfill discovery of embedded, hidden mounting flanges within the matrix of the foam panel that adequately serve to mount and support supplementary finishing materials and other items of the decorative type to the concrete wall structure, for example.

It is a further object of the present invention to provide an ICF system that includes planar and corner-shaped foam panels having structural attributes that effectively resist occurrences of hydrostatic blow out caused by excessive pours of concrete that can otherwise destroy the structural integrity of the foam panel, thus unnecessarily adding to the cost of the finished concrete wall structure.

It is a further object of the present invention to provide an ICF system that incorporates usage of insulating side panels having structural attributes to adequately accommodate and firmly secure therewithin a plurality of flange members as generally associated with a plurality of panel spacing ties to form a continuous vertical support for mounting and securing thereto a variety of materials supplementally utilized in finishing the concrete wall structure as well as serving as means for mounting other items at a moment of time well beyond completing and finishing the concrete wall structure.

It is yet a further object of the present invention to provide an ICF system that incorporates a panel spacing tie having supplemental structural attributes for securing and supporting standing seams generally formed by the differing lengths of foam panels that have otherwise undergone removal of their associated tongue-groove configuration to accommodate the linear dimension or length of the concrete wall structure, for example.

It is yet a further object of the present invention to provide an ICF system that utilizes a panel spacing tie having supplemental structural attributes in the form of anchoring plates partially embedded in the concrete wall structure that effectively fulfills and accommodates attachment of heavy-weighted materials that complement a finished concrete wall structure.

It is yet a further object of the present invention to provide an ICF system that employs the use of a foam panel having the structural attributes to be readily removed from the form assembly constituting the ICF system insofar to desirably accommodate fabrication of a bare concrete wall structure with further provisions for re-use thereof as supplemental cost saving measures.

In accordance with the present invention, an ICF system has been devised for economical development and fabrication of concrete wall structures, the ICF system comprising longitudinal and corner block assemblies each respectively having a set of first and second side panels and a set of outer and inner corner side panels, a plurality of tie receivers embedded interiorly within the side panels and corner side panels, a plurality of panel spacing ties interacting with the tie receivers, an alternating arrangement of projections and recesses along leading edges of the side panels and corner side panels for interlocking with and securing together leading edges associated with neighboring block assemblies, and supplemental features in the form of vertical passageways for accommodating utility lines and the like and covered channels for moisture removal and abatement of sound transmittance, the first and second side panels of the longitudinal block assembly and the outer and inner corner side panels of the corner block assembly being held in an opposing manner by the panel spacing ties each having a mid-support section interposing in between and connecting to a pair of end sections by a living hinge with each end section being configured with a flange member for placement within a pair of opposing spatial wedges of the tie receiver, the living hinge having the capability of allowing each of the end sections to move angularly relative to the mid-support section to further movement of the first and second side panels inwardly toward one another in a racked position to yield compactness of the longitudinal block assembly for economical transport, the corner block assembly, operating in conjunction with the panel spacing ties, supplementally includes a pair of corner panel spacing ties each having end sections equally configured with flange members for placement within the opposing spatial wedges of the tie receiver, whereby the corner panel spacing ties supplementally serve to reinforce the corner block assembly to mitigate inadvertent occurrences of hydrostatic blowout caused by poured concrete.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a system that fulfills use of insulating concrete forms for the efficient and economical development and fabrication of poured concrete walls for building structures.

Figure 1:
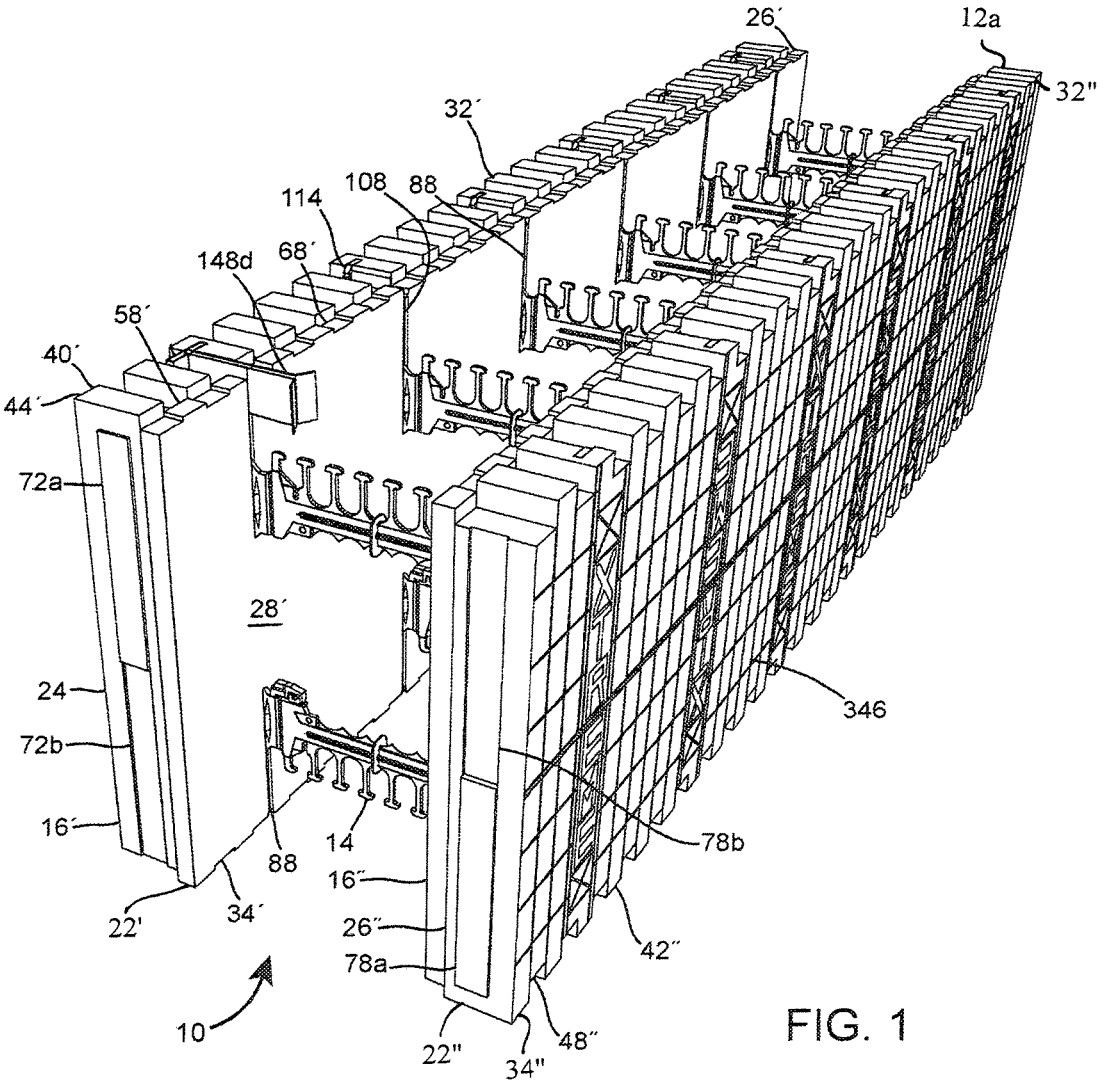
FIG. 1 is an end perspective view of the preferred embodiment of the present invention illustrating first and second side panels each having a plurality of tie receivers in an opposing relation for receiving therewithin panel spacing ties for retaining the side panels in a parallel and foldable position.
Figure 3:
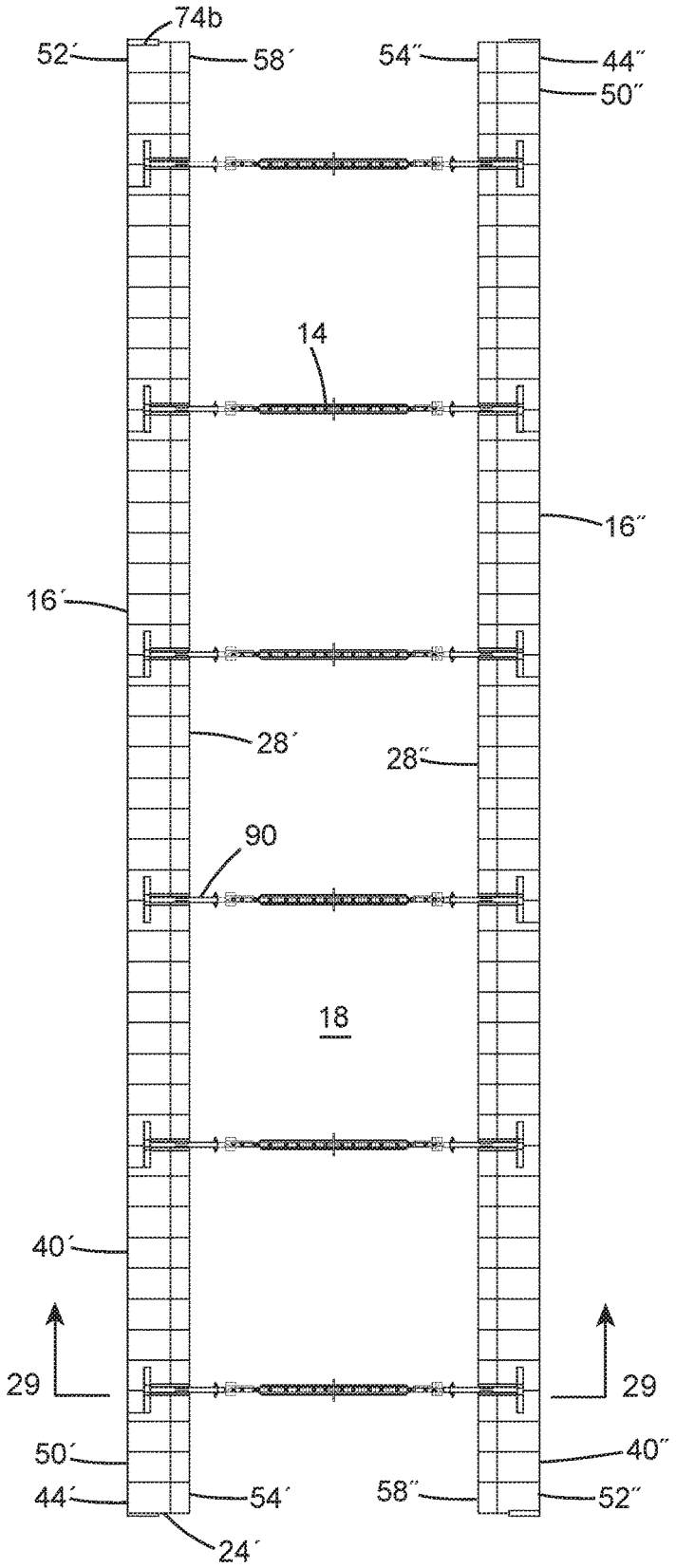
FIG. 3 is a top plan view of the preferred embodiment of the present invention illustrating first and second side panels connected together in an opposing, parallel relation by a plurality of panel spacing ties.
Figure 54:
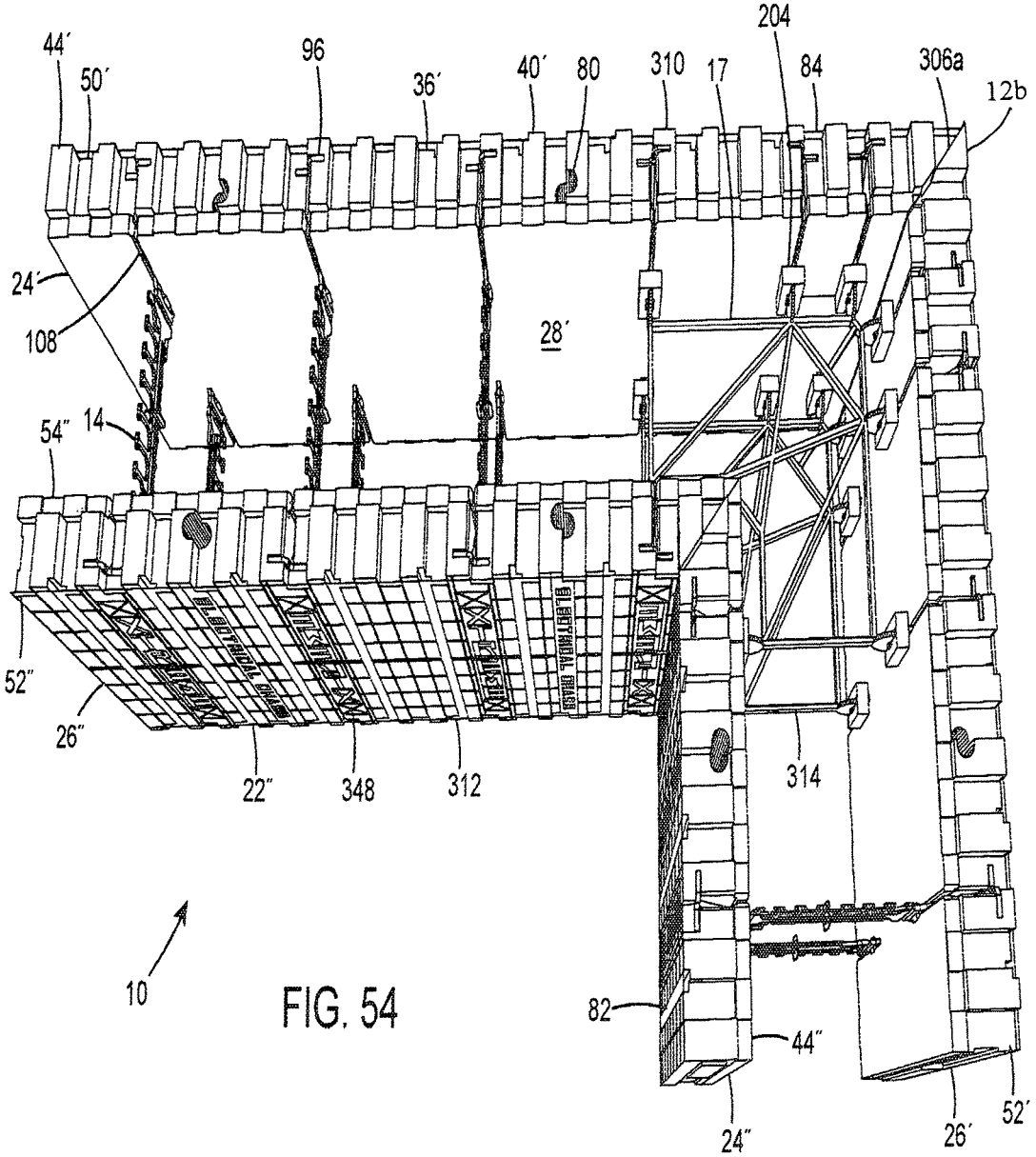
FIG. 54 is a top perspective view of the preferred embodiment of the present invention illustrating a corner block assembly having outer and inner corner side panels held apart and connected together by corner panel spacing ties and panel spacing ties.

Referring now to FIGS. 1 and 54, there is shown generally at 10 an insulating concrete form (ICF) system comprising longitudinal and corner block assemblies 12*a*, 12*b* respectively directed to forming and fabricating straight-line and corner wall structures. Each longitudinal block assembly is generally shown in FIG. 3 as comprising a plurality of panel spacing ties 14 interposing in between and connecting to first and second side panels 16', 16", whereas each corner block assembly is supplemented with a plurality of corner panel spacing ties 17, collectively being configured in such manner to form a communicating receptacle 18 for receiving therewithin a specified amount of pourable concrete to effect development and fabrication of the overall desired shape of the wall structure. It is understood within the context of this disclosure that the overall design requirements of the wall structure will dictate the requisite number and specific configuration of the block assemblies 12*a*, 12*b*, whether they are of the longitudinal or corner type of block assemblies as disclosed and discussed herein. For example, a continuous, straight-line wall structure will incorporate and utilize a plurality of longitudinal block assemblies 12*a* systematically stacked vertically atop of one another in an offsetting manner to satisfy the general height requirements of the wall structure with ends of each block assembly being placed in a side-by-side relationship with supplemental block assemblies to satisfy the lineal dimension of the wall structure.

Figure 2:
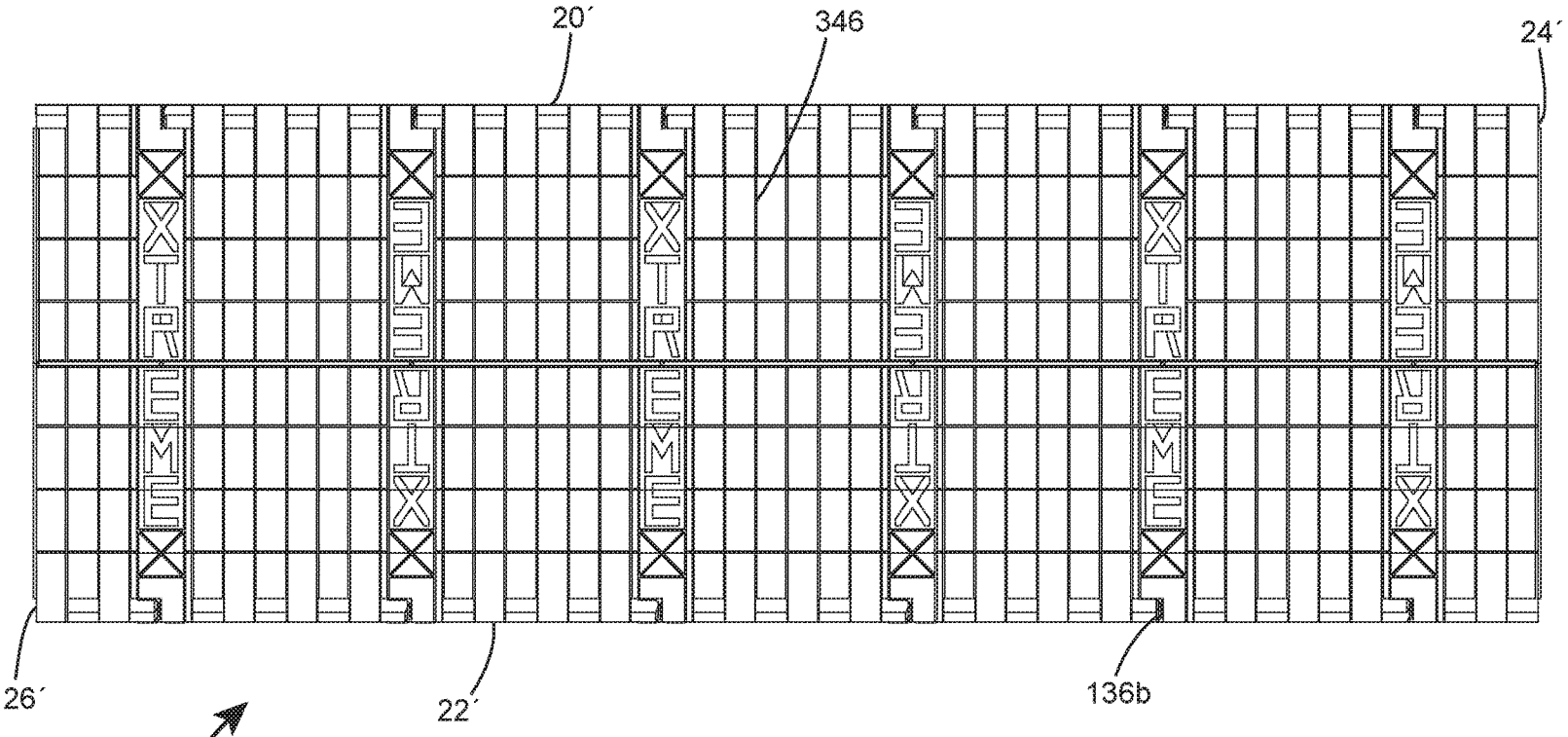
FIG. 2 is a left side elevational view of the preferred embodiment of the present invention illustrating a first side panel having an exterior face with visual markings.
Figure 10:
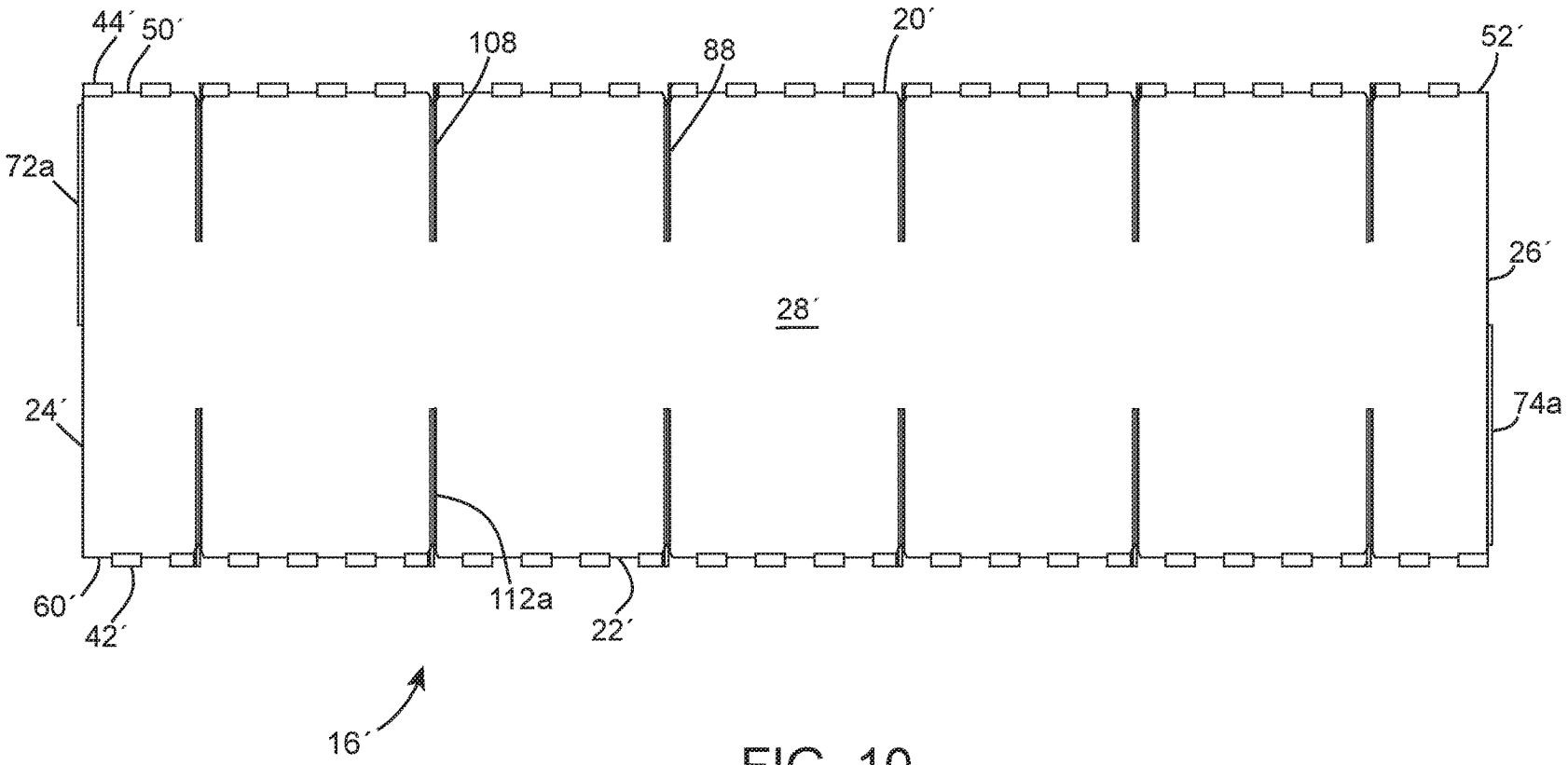
FIG. 10 is a side elevational view of the preferred embodiment of the present invention illustrating a first side panel comprising an interior face configured with a plurality of tie receivers each having a pair of aligned access slots.
Figure 11:
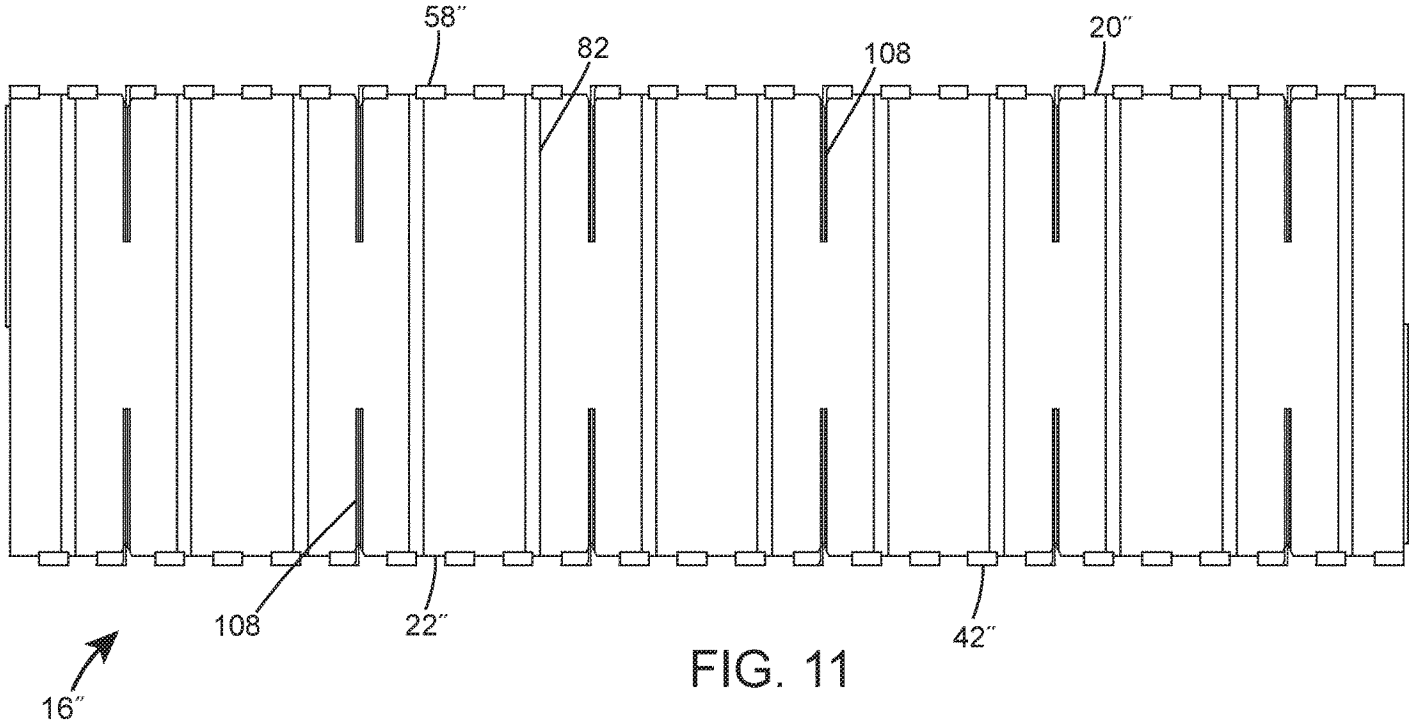
FIG. 11 is a side elevational view of the preferred embodiment of the present invention illustrating a second side panel comprising an interior face configured with a plurality of channels extending in between first and bottom leading edges and a plurality of tie receivers each having a pair of aligned access slots.

Now in reference to FIG. 10, first side panel 16' is shown to comprise first and bottom leading edges 20' and 22' orientated in an opposing, parallel manner and first and second end walls 24' and 26' equally orientated to substantially form the general rectangular shape of the first side panel 16'. In reference to FIGS. 11 and 12, second side panel 16" is shown to comprise first and bottom leading edges 20" and 22" orientated in an opposing, parallel manner and first and second end walls 24" and 26" equally orientated to substantially form the general rectangular shape of the side panel 16". Each of the first and second side panels, as generally represented in FIGS. 2 and 11, comprise interior and exterior faces 28', 28", 30', 30" while the first and bottom leading edges each comprise interlocking means 32', 32", 34', 34" to fulfill a strengthened connection between each of the opposing side panels 16', 16" upon their placement atop of one another to satisfy the general height requirement of the wall structure, particularly being advantageous to mitigate inadvertent occurrences of hydrostatic blowout generally caused by the applied lateral normal forces acting upon the side panels as pourable concrete of predetermined weight is placed within the communicating receptacle 18 of the ICF system 10.

Figure 6:
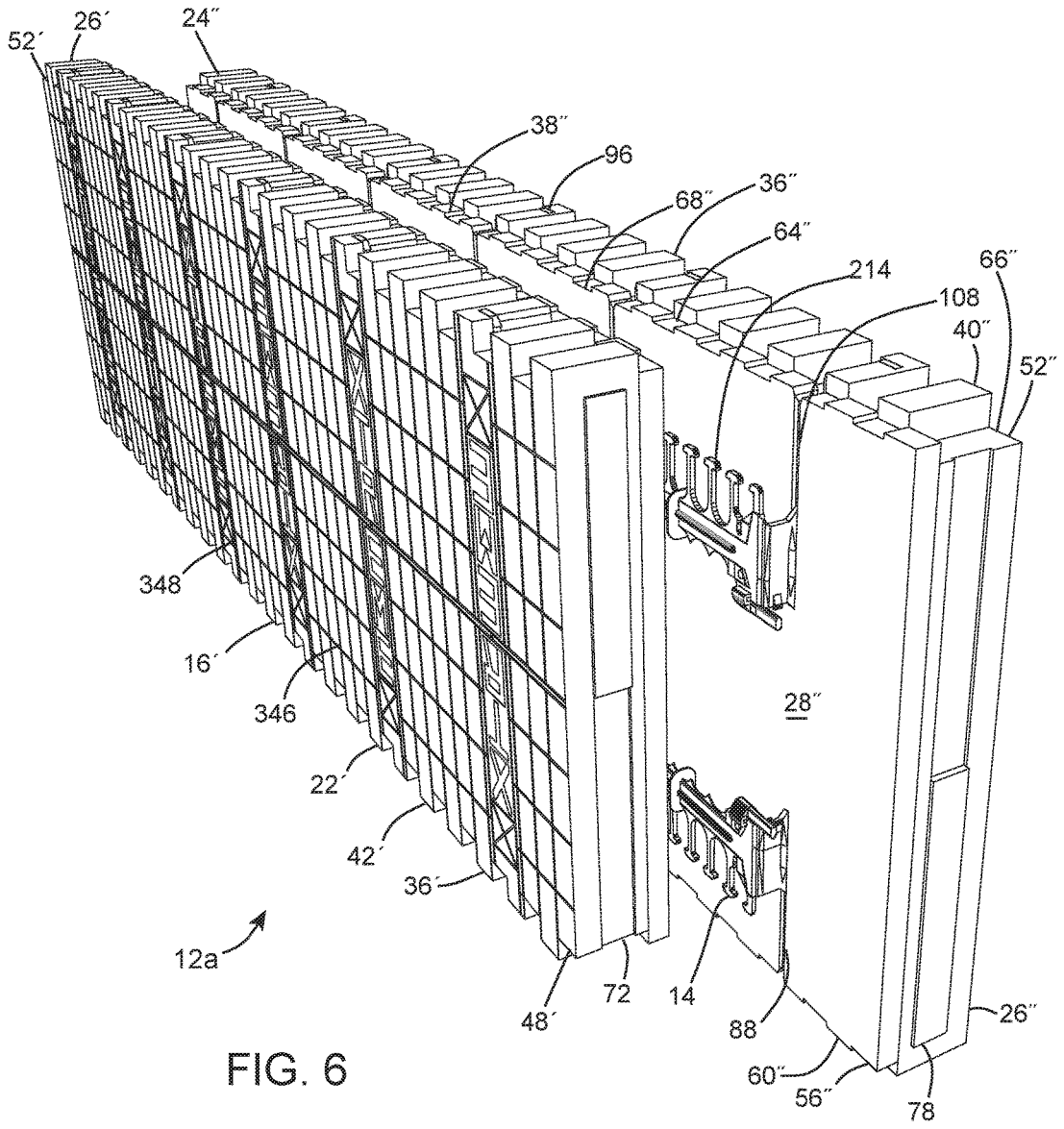
FIG. 6 is an end perspective view of the preferred embodiment of the present invention illustrating first and second side panels held in compacted, racked position by a plurality of panel spacing ties.
Figure 7:
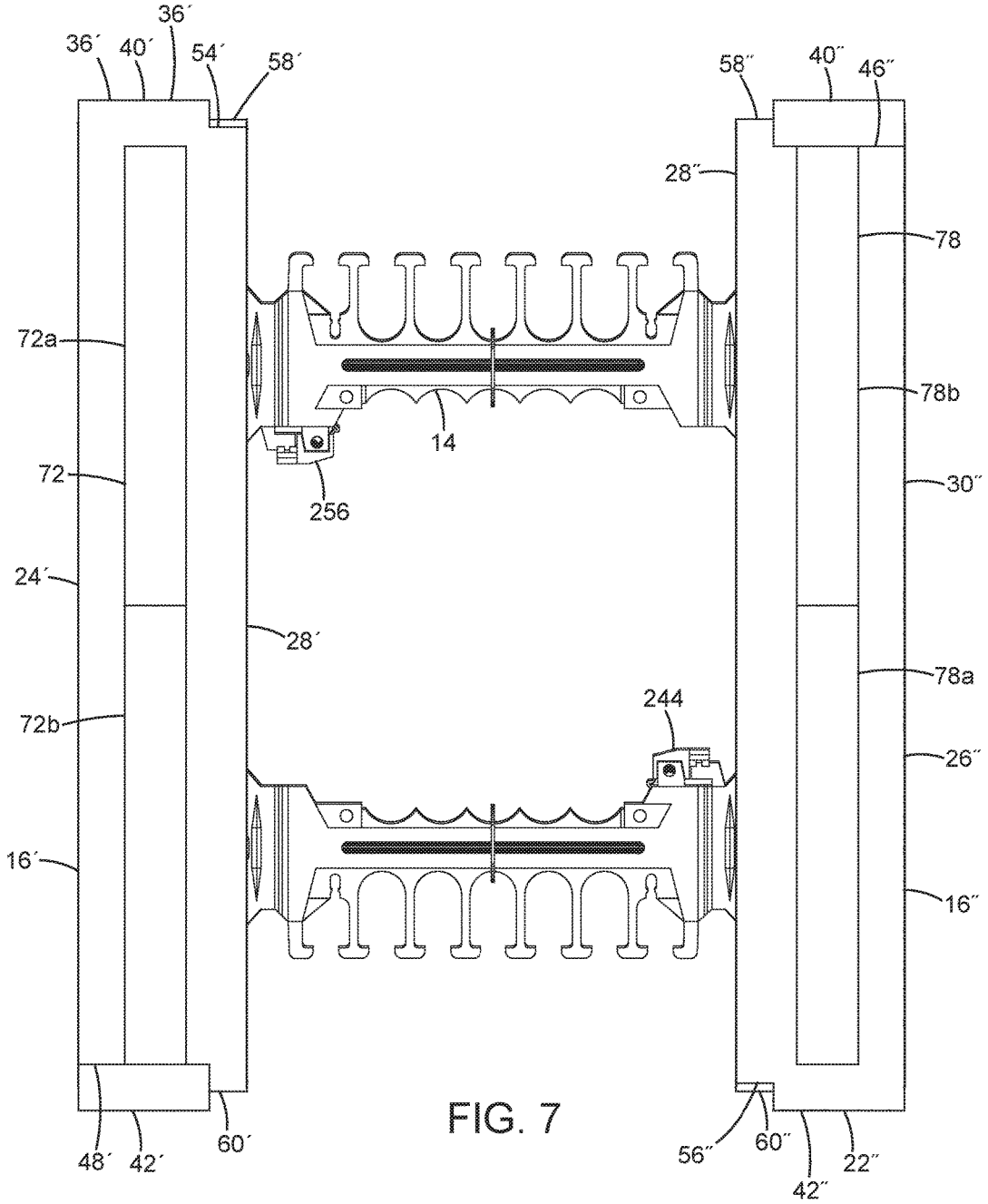
FIG. 7 is an end elevational view of the preferred embodiment of the present invention illustrating first and second side panels each respectively having first and second end walls with a tongue and groove configuration and being held apart in a parallel relation by panel spacing ties.
Figure 8:
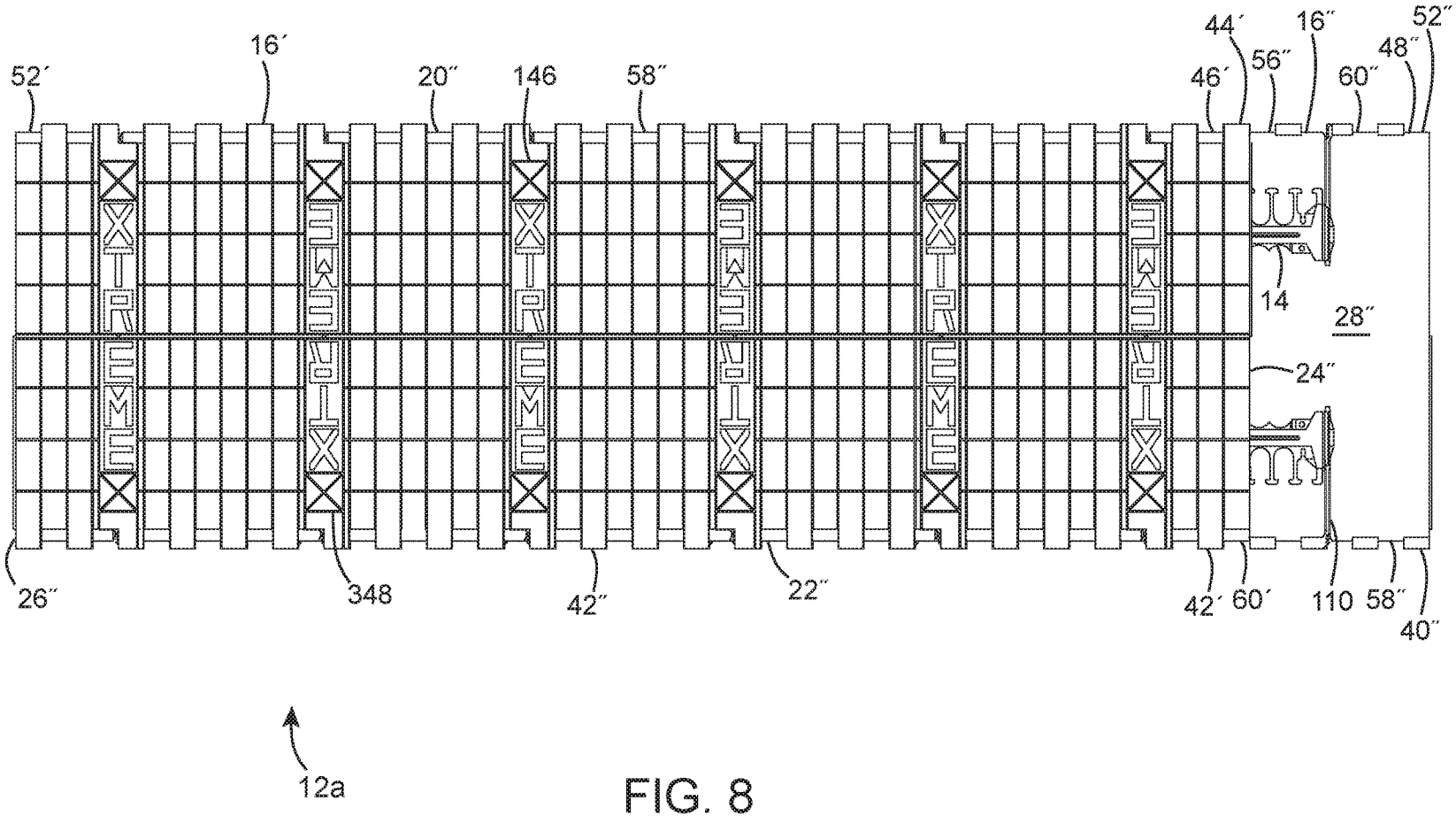
FIG. 8 is a side elevational view of the preferred embodiment of the present invention illustrating first and second side panels held in compacted, racked position by a plurality of panel spacing ties.
Figure 9:
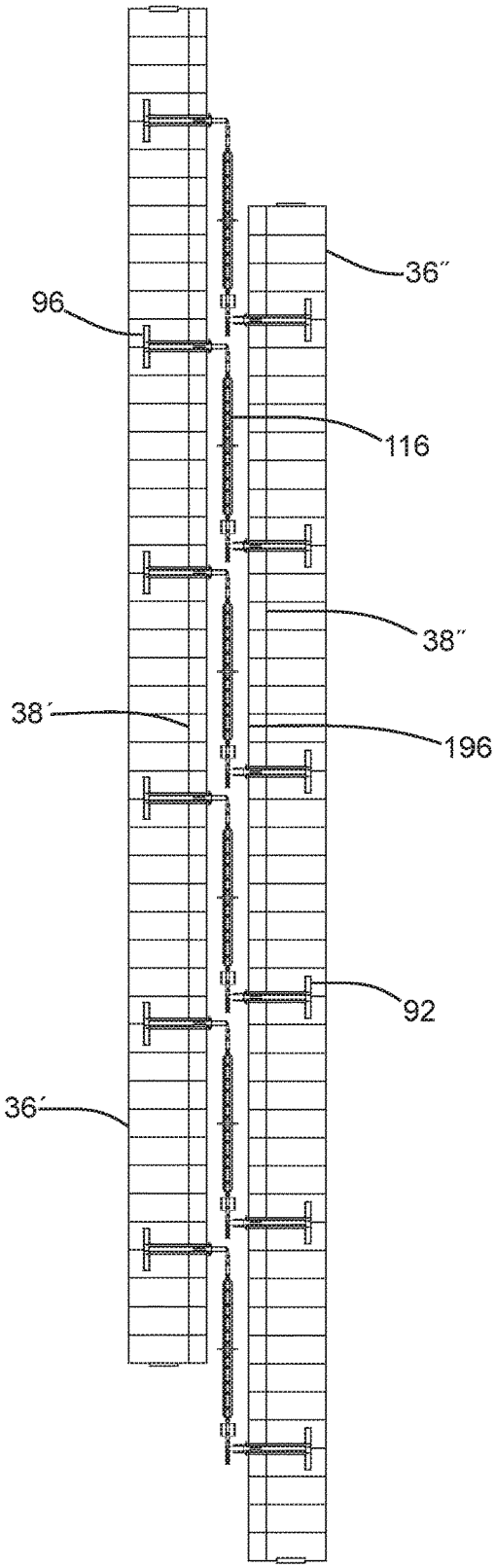
FIG. 9 is a top plan view of the preferred embodiment of the present invention illustrating first and second side panels held in compacted, racked position by a plurality of panel spacing ties each being fitted within a T-shaped slot of a tie receiver.

In fulfilling this objective, interlocking means is preferably illustrated in FIGS. 6 and 9 as comprising a side-by-side, lineal arrangement of alternating projections and recesses along longitudinal outward and inward portions 36', 36", 38', 38" of each of the first and bottom leading edges 20', 20", 22', 22". FIGS. 7 and 8 exemplify arrangement of interlocking means 32', 32" along the top leading edges of the first and second side panels 16', 16", where the longitudinal outward portion is shown with a primary projection 40', 40" occupying a shared first position 44', 44" relatively about and near the first end wall 24', 24" followed by a primary recess 46', 46" occupying a shared second position 50', 50" and continuing in this alternating manner such that another primary recess occupies a shared last position 52', 52" relatively about and near the second end wall 26', 26", whereas the longitudinal inward portion 38', 38" is shown with a secondary recess 54', 54" occupying the shared first position 44', 44" relatively near the first end wall followed by secondary projection 58', 58" occupying the shared second position and continuing in this alternating manner such that another secondary projection occupies the shared last position 52', 52" relatively near the second end wall.

Comparatively, interlocking means 34', 34" along the bottom leading edge 22', 22" of each side panel 16', 16", as shown in FIG. 1, comprises a reversed lineal arrangement of alternating projections and recesses from that of the opposing top leading edge 20', 20" such that the longitudinal outward portion 36', 36" thereof comprises a primary recess 48', 48" occupying the shared first position 44', 44" relatively about the first end wall 24', 24" followed by a primary projection 42', 42" occupying the shared second position 50', 50" and continuing in this alternating manner such that another primary projection occupies the shared last position 52', 52" relatively about and near the second end wall 26', 26", whereas the longitudinal inward portion 38', 38" is shown with a secondary projection 60', 60" occupying the shared first position relatively near the first end wall followed by a secondary recess 56', 56" occupying the shared second position and continuing in this alternating manner such that another secondary recess occupies the shared last position 52', 52" relatively near the second end wall.

In further observation of interlocking means as generally associated with each side panel in FIG. 3, the primary and secondary projections and recesses are of equal width such that each primary projection 40', 40", 42', 42" traversely positioned from the secondary recess 54', 54", 56', 56" along the same leading edge share an equal width, while each primary recess 46', 46", 48', 48" traversely positioned from the secondary projection 58', 58", 60', 60" along the same leading edge share an equal width. Base surfaces 62', 62", 64', 64" respectively associated with the primary and second recesses coexist on the same plane, as generally depicted in FIG. 6. Since there are no obstructions between the primary recess and exterior face 30', 30" as well as between the secondary recess and interior face 28', 28" of the side panel 16', 16", particularly as such to form primary and secondary drainage outlets 66', 66", 68', 68" thereabout, there exists opportune moments for sufficient drainage of accumulated moisture from the arrangement of interlocking means that may otherwise inhibit full engagement of the projections and recesses of one particular block assembly 12*a*, 12*b* with the projections and recesses of a neighboring block assembly. Although interlocking means 32', 32", 34', 34" primarily serves to reinforcingly secure and lock together adjoining seams of block assemblies stacked atop of one another to generally satisfy the height requirement of the wall structure, the relative configuration of each of the primary and secondary projections may equally serve in the direct capacity to properly align and guide interlocking means before establishing full connective engagement thereof, particularly offering to mitigate occurrences of inflicting damage thereto during field assembly of the ICF system 10. Accordingly, in this regard, it is preferred that a first embodied form of interlocking means fulfill use of primary projections each comprising a height comparatively higher than that of the secondary projection, preferably by one-third to one-half in additional height, while the longitudinal outward portion 36', 36" comprises a structural depth, taken along an axis normal to the exterior and interior faces, being approximately two-thirds greater than that of the longitudinal inward portion 38', 38". However, in some applications, it may be desirable that a second embodied form of interlocking means fulfills use of primary and secondary projections having equal heights and structural depths for increased structural rigidity along adjoining seams as a compromise of mitigating occurrences of inflicting damage thereto during field assembly.

Figure 4:
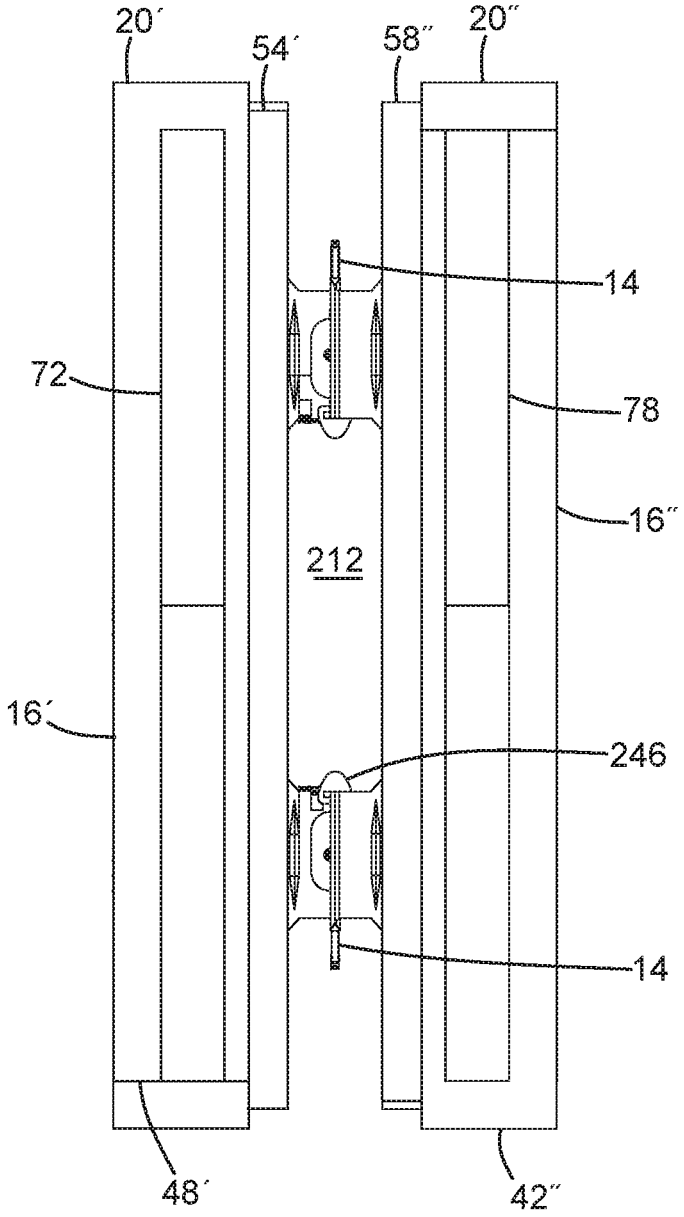
FIG. 4 is an end view of the preferred embodiment of the present invention illustrating first and second side panels held together in a foldable position by a plurality of panel spacing ties.
Figure 5:
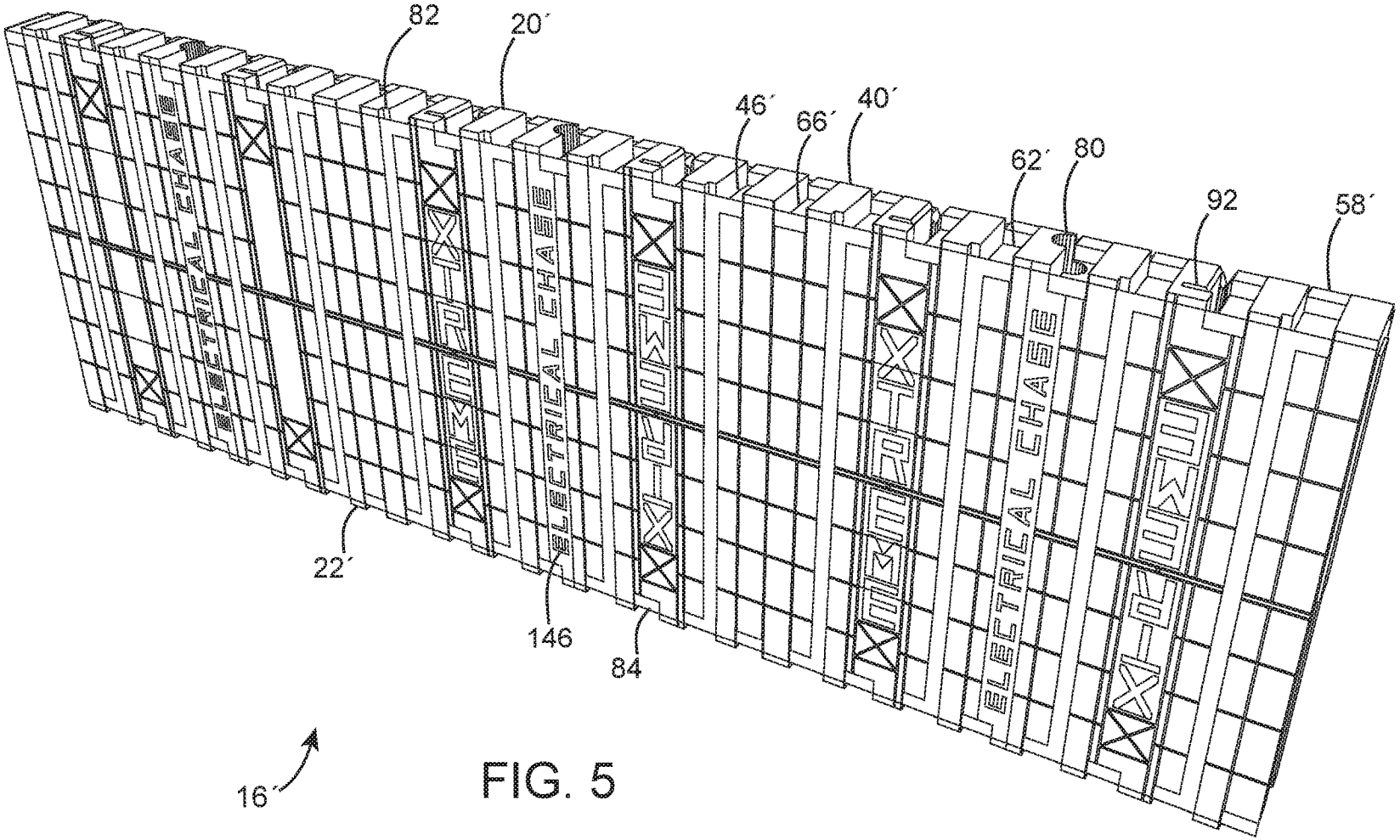
FIG. 5 is a side perspective view of the preferred embodiment of the present invention illustrating a first side panel having a top leading edge with longitudinal inward and outward portions configured with an alternating arrangement of primary projections and recesses.

As further evident in FIGS. 4 and 7, each of the first and second end walls 24', 24" 26", 26" of the first and second side panels 16', 16" of the longitudinal block assembly 10 is shown therein to respectively comprise a tongue and groove configuration 72, 74, 76, 78 to facilitate an interlocking relationship with an equally configured block assembly placed alongside thereof. In particular, the first end wall 24', 24" of the first and second side panels is shown to comprise a tongue 72*a*, 76*a* extending outwardly therefrom a predetermined distance and being situated above a groove 72*b*, 76*b* in an end-to-end relationship, where the groove is dimensional equivalent to the tongue to satisfy placement with another tongue associated with a neighboring side panel. Both the tongue and groove in this exemplary instance reside on the first end wall to lineally correspond to the longitudinal outward portion 36', 36" and comprises a shape substantially resembling a rectangle, where the longitudinal axis of the tongue and groove configuration 72, 76 generally extends parallel to an axis extending normal to the first and bottom leading edges. Comparatively, the second end walls 26', 26" of the first and second side panels 16', 16" equally comprises a tongue and groove configuration 74, 78 but in a reverse orientation, where the groove 74*b*, 78*b* resides above the tongue 74*a*, 78*a* in end-to-end relationship such to accept and mate with an equally but oppositely orientated tongue and groove configuration 72, 76 associated with the first end wall of the first and second side panels of a neighboring longitudinal or corner block assembly.

In further observation of the longitudinal and corner block assemblies 12*a*, 12*b* shown in FIGS. 1 and 54, the complementary second side panel 16" is shown in a rotated position such that the first end wall of the first side panel corresponds or aligns with the second end wall of the second side panel. Consequently, the primary projections 40' integral to the longitudinal outward portion 36' of the top leading edge of the first side panel traverse and correspond on the same plane to the primary recesses 48" integral to the longitudinal outward portion 36" of the top leading edge of the second side panel 16". Likewise, the secondary recesses integral to the longitudinal inward portion 54' of the top leading edge of the first side panel 16' traverse and correspond on the same plane to the secondary projections integral to the longitudinal inward portion 38" of the top leading edge 22" of the second side panel 16". By means of this configuration, the block assemblies 12*a*, 12*b* can be manipulated in a reversed or flipped orientation that allows the projections and recesses of the longitudinal outward and inward portions constituting interlocking means and the tongue and groove configurations of the first and second end walls to engagingly correspond with those of adjoining block assemblies to fulfill a tight seal and strengthened connection along their respective perimeters without having to resort to usage of supplemental or external supports and ties of the type typically offered in the art to secure like adjoining seams.

Referring now to FIGS. 5, 15, 17, and 54, the longitudinal and corner block assemblies 12*a*, 12*b* constituting the ICF system 10 are shown to comprise a plurality of vertical passageways 80 integrated within the structure of the side panel 16', 16" that serve to accept and pass therethrough a variety of plumbing lines, pipes, electrical wires, communication lines, etc. that effect further completion of a finished wall structure, whether it occurs pre- or post-fabrication of the concrete wall structure using the ICF system 10. In the instance of their application and use, the vertical passageways 80 are identified and located with markings as placed upon the exterior faces 30', 30" of the first and second side panels and are generally spaced apart at intervals of 8, 16, 24, or 48 inches on center along the top and bottom leading edges 20', 20", 22', 22", preferably residing within the confines of the longitudinal outward portion 36', 36", to generally correspond with the spacing requirements set forth in local, state and federal building codes for like features and extend vertically to the first and bottom leading edges of the side panel 16', 16" in such manner to allow vertical alignment with those present in neighboring block assemblies and maintain vertical continuity of the passageways for undisrupted accommodation of plumbing lines, for example, through the concrete wall structure constituting in part the building structure.

Figure 12:
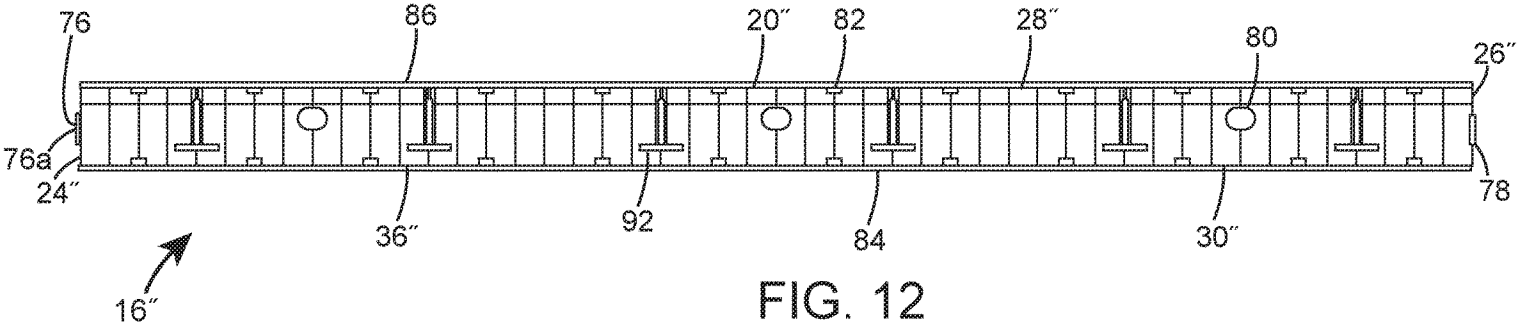
FIG. 12 is a top plan view of the preferred embodiment of the present invention illustrating a second side panel having interior and exterior faces laminated with a film and configured with a plurality of channels and a plurality of vertical passageways.
Figure 15:
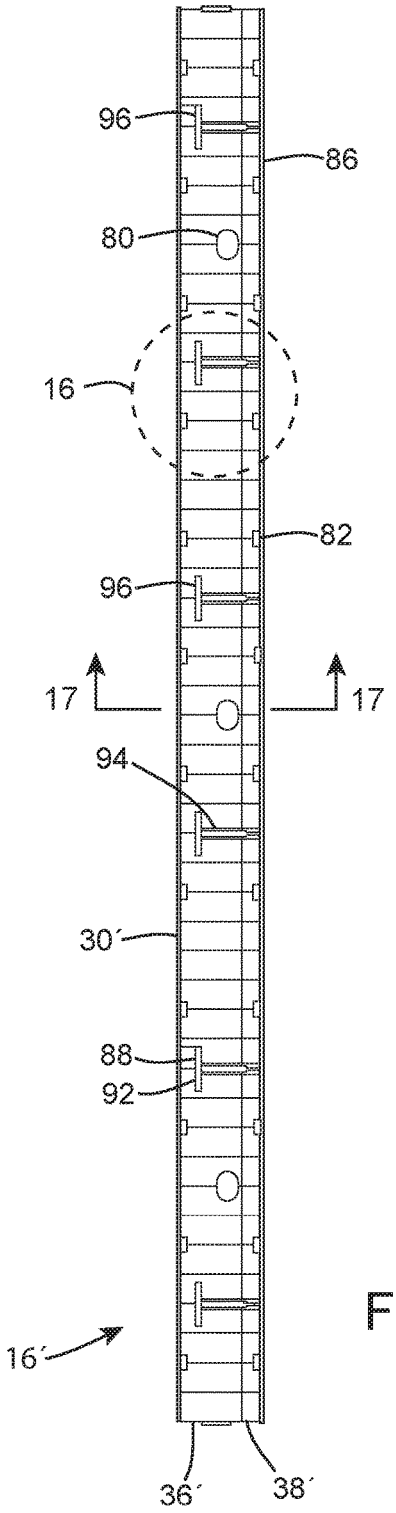
FIG. 15 is a top plan view of the preferred embodiment of the present invention illustrating a first side panel having longitudinal inward and outward portions and an exterior face with a plurality of channels and laminated with a film.

Supplementing the vertical passageways, FIGS. 11, 12 and 15 depicts placement of a plurality of channels 82 integrally within the structure of the opposing first and second side panels 16', 16" to effect efficient removal of accumulated moisture and like matter interiorly and/or exteriorly from the concrete wall structure upon completion thereof as well as serving to reduce sound transmittance through the finished concrete wall structure. The channels in particular reside generally on the interior face 28', 28" and/or exterior face 30', 30" of the side panel and extend inwardly into the side panel a predetermined distance to the extent of accommodating adequate drainage flow and vertically between the first and bottom leading edges, similarly to that of the vertical passageways described above, to allow for drainage continuity along upwardly- and downwardly-placed block assemblies. The number of channels and the dimensions thereof configured for the interior and/or exterior face of the side panel will depend on the design requirements set forth for the wall structure, with particular consideration of the moisture content in contact with the finished wall structure and abundance of sound waves necessitating abatement to achieve adequate acoustic levels. However, channels spaced apart at 4-inch intervals along the exterior and/or interior face of the side panel generally serve to meet most applications in this regard.

Since the channels 82 may reside on the interior and/or exterior face of the side panel to fulfill the desired object of drainage and abating sound transmittance, there is an undesirable opportunity for the channels to collect and hold an appreciable amount of foreign matter therewithin that may otherwise deleteriously impact the channels' ability to function most effectively. Accordingly, the interior and/or exterior face of the side panels 16', 16" may comprise a membrane or film 84 externally applied thereto that has the desired effect of covering and protecting the channels to inhibit entry of debris or other substances therewithin so as to maintain continued functionality thereof. Preferably, the membrane is fabricated from synthetic material, polypropylene or an equivalent type of material that resists premature deterioration caused by persistent contact with moisture and exposure to sunlight and is thermally applied or laminated to the exterior face during the manufacturing phase to gain ultimate adhesion. Although the primary functionality of the applied membrane is to protect the channels from debris or concrete intrusion, the membrane supplementally serves to add strength and rigidity to the side panels, since the presence of vertical passageways 80 and channels 82 embedded interiorly within the side panel can unduly compromise the structural integrity thereof due to the volumetric removal of support material to accommodate such features. Furthermore, the membrane offers the ability to be printed thereupon before application to the side panel to designate internally placed design features such as the location of passageways and panel spacing ties 14 as well as offering instructional information and data relating to the manufacture and assembly of the ICF system 12 and so forth. As a supplemental design aspect of concrete wall fabrication, the membrane may further comprise compositional and physical characteristics that is most suited and appropriate for certain applications on a per need basis, such as enhancements relating to energy conservation, for example. In this instance, side panels 16', 16" exteriorly laminated with a high tensile strength, silver metallic reflective film may desirably contribute to an energy-performing block assembly and ultimately an energy-efficient concrete wall structure. In yet other aspects of concrete wall design, the interior face 28', 28" of the side panel may equally be laminated with a membrane or film 86 to complement the applied laminate to the exterior face to offer supplemental strength and overall rigidity to the longitudinal block assembly 10 as well as facilitating removal of the side panel for particular applications desiring exposed concrete wall surfaces, for example. In this instance, the interior face of the side panel may receive a membrane fabricated from polypropylene or an equivalent type of material that generally possesses high tensile strength yet resists adhesion to the concrete substrate for ease of removal after curing of the concrete.

Figure 16:
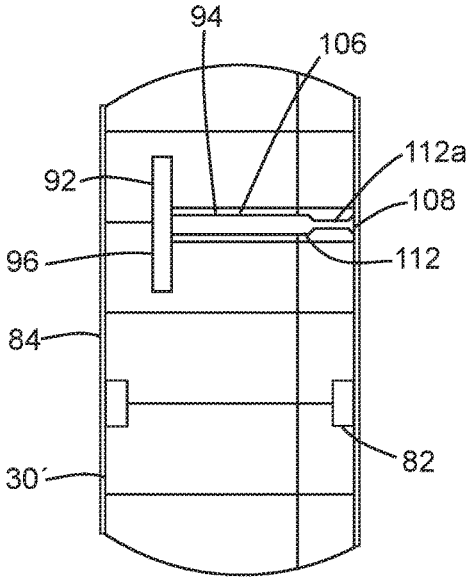
FIG. 16 is an exploded top plan view of the preferred embodiment of the present invention illustrating a spatially open T-slot having a first slot perpendicularly orientated to and spatially communicating with a second slot.
Figure 17:
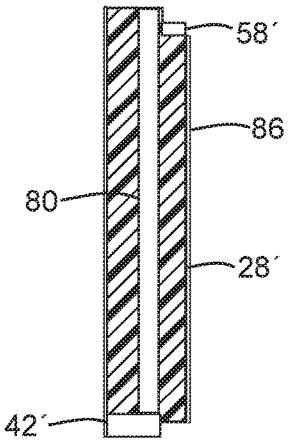
FIG. 17 is a cross sectional view of the preferred embodiment of the present invention taken along line 17-17 in FIG. 15 illustrating a first side panel having a vertical passageway and an exterior face laminated with a film.
Figure 29:
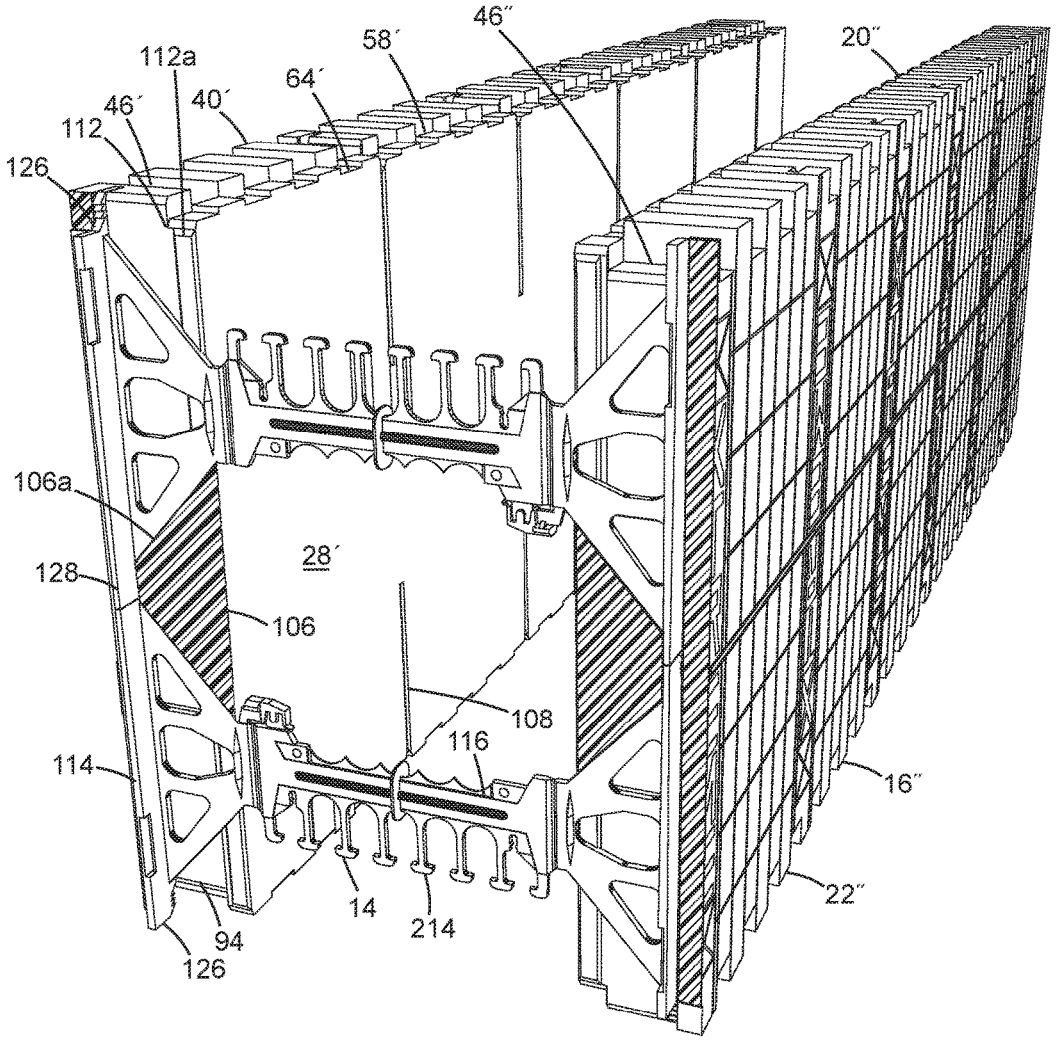
FIG. 29 is a cross sectional view of the preferred embodiment of the present invention taken along line 29-29 in FIG. 3 illustrating a pair of panel spacing ties vertically aligned and connected to one another by locking means and each having a pair of end sections slidably engaged within an opposing arrangement of tie receivers.
Figure 40:
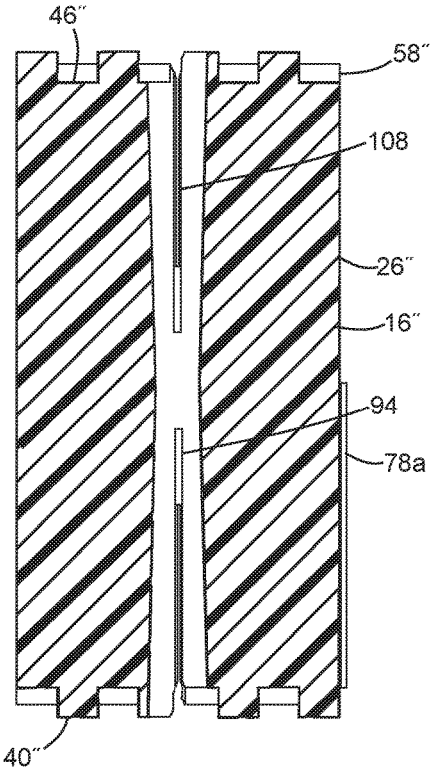
FIG. 40 is a cross sectional view of the preferred embodiment of the present invention taken along line 40-40 in FIG. 42 illustrating a shorten section of a second side panel comprising a tie receiver having a second slot in spatial communication with a first slot and a pair of aligned access slots.
Figure 44:
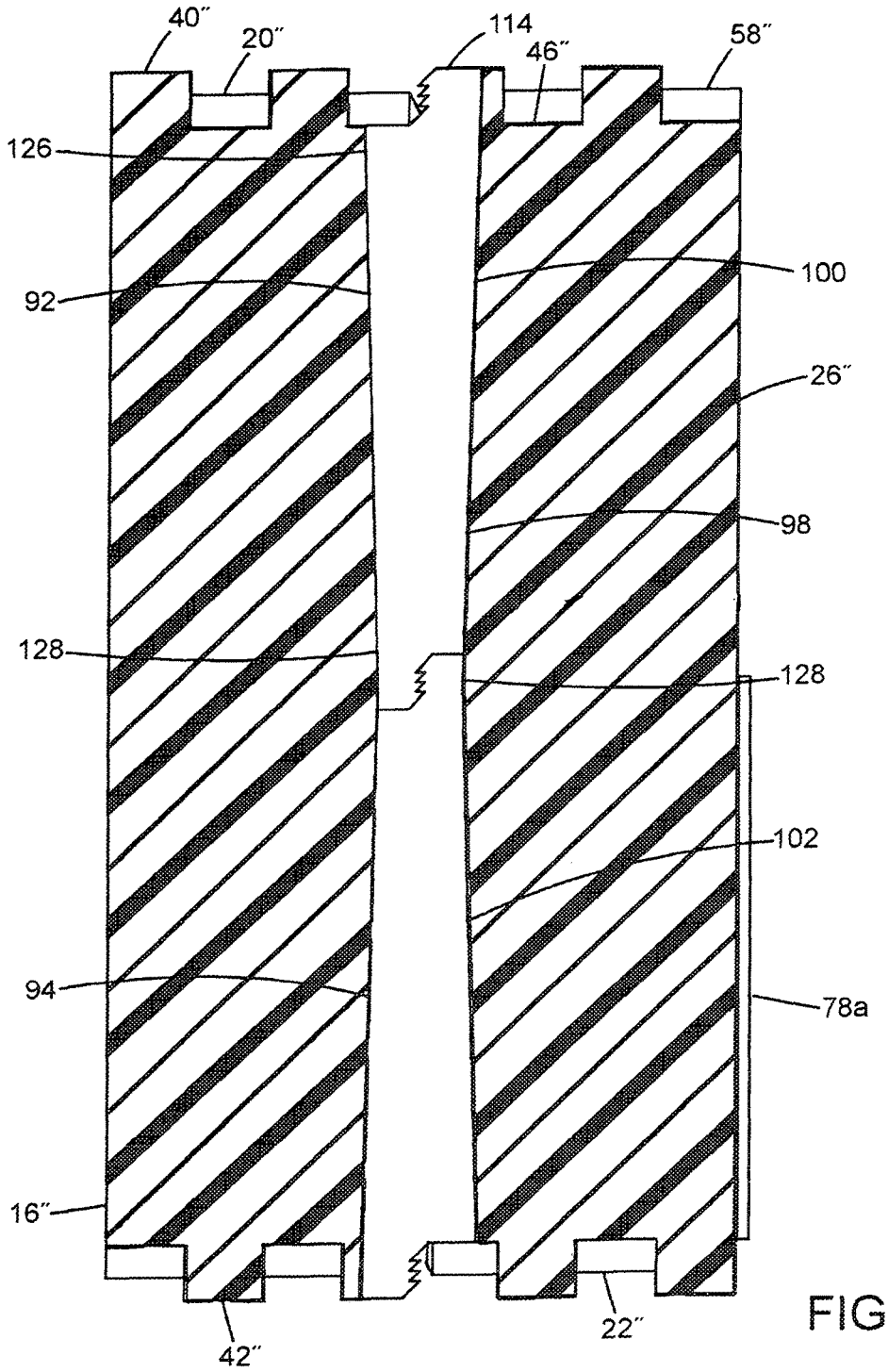
FIG. 44 is a cross sectional view of the preferred embodiment of the present invention illustrating a shorten section of a second side panel having a pair of opposing spatial wedges accommodating a pair of connected flange members associated with a pair of panel spacing ties vertically orientated to one another.

Now in reference to FIGS. 1 and 29, each side panel 16', 16" associated with the block assemblies 12*a*, 12*b* is supplemented with a plurality of tie receivers 88 each being selectively configured to accommodate and engagingly receive end sections 90 of the panel spacing ties 14 and corner panel spacing ties 17. Each tie receiver comprises first and second slots 92, 94 openly communicating with one another in part along their lengths to form a T-shaped slot 96 observably present about each of the first and bottom leading edges of the side panel, as generally represented in FIG. 16. The first slot 92, unlike the second slot 94, openly extends lengthwise between the top and bottom leading edges 20', 20", 22', 22" and comprises a pair of nonlinear sidewalls 98 each having first and second elements 100, 102 angularly pitched inward a predetermined amount respectively from the first and bottom leading edges toward a midsection of the first slot to form a pair of opposing spatial wedges openly communicating with one another to the likes of the overall configuration depicted in FIGS. 40 and 44. Comparatively, the second slot 94 is shown in FIG. 29 as being broken into two separable units by a triangular stop 106 situated near the midsection of the first slot, where sides 106*a* of the triangular stop serve to abut against and engage a select portion of the end sections 90 associated with a vertically stacked, connected pair of panel or corner panel spacing ties 14, 17 insofar to offer stability and hold thereof while situated within the confines of the tie receiver 88.

Figure 41:
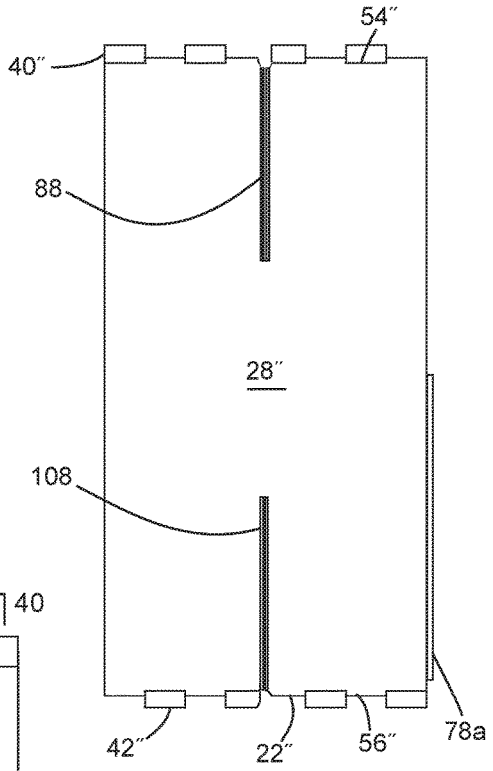
FIG. 41 is a back elevational view of the preferred embodiment of the present invention illustrating a shorten section of a second side panel having a pair of aligned access slots.
Figure 42:
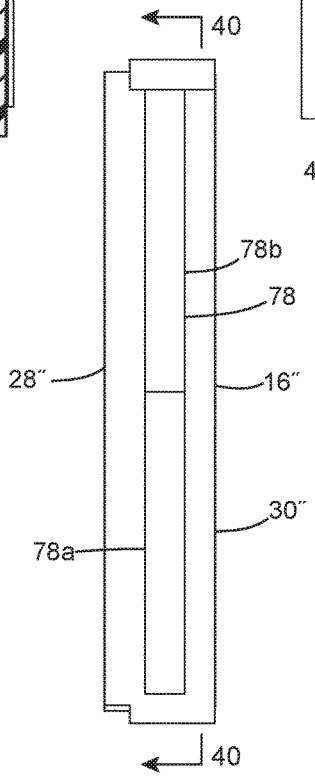
FIG. 42 is a left elevational view of the preferred embodiment of the present invention illustrating a shorten section of a second side panel having a second end wall with a tongue and groove configuration.
Figure 43:
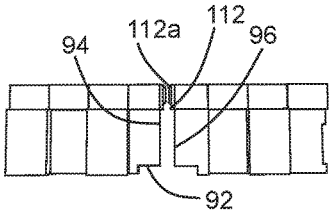
FIG. 43 is a top plan view of the preferred embodiment of the present invention illustrating a shorten section of a second side panel having a tie receiver with a T-shaped slot.

Supplementing the configuration of the T-shaped slot 96 is a pair of aligned access slots 108 that spatially communicate with the second slot 102 insofar to accommodate therewithin truss supports 110 of the type generally associated with the end sections 90 of the panel or corner panel spacing ties 14, 17. Each aligned access slot, as shown in FIGS. 41 and 43, comprises a pair of inward sidewalls 112 having a width generally extending from the interior face 28', 28" of the side panel and terminating at or near the transition between the longitudinal outward and inward portions in reach of the second slot to openly communicate therewith and an effective length defined as extending respectively from the top and bottom leading edges of the side panel and terminating a predetermined distance therefrom insofar to allow the end sections 90 of the panel or corner spacing ties 14, 17 to engagingly lock with one another by locking means while vertically positioned and partially housed within the tie receiver 88.

In further a tight and snug fit of the truss support 110 within the aligned access slots 108 that effects minimal lateral play for predictable parallel positioning of the side panels 16', 16" relative to one another, each of the inward walls 112 comprises an elongate nub 112*a* extending inwardly within and along the length of the aligned access slot, as generally shown in FIG. 29. Accordingly, as the truss support is slidably placed within the confines of the aligned access slot, a relative degree of material compression will occur along the elongate nut since the effective thickness of the truss support will slightly exceed the spacing held in between the inwardly opposing elongate nubs but generally correspond to the effective width or exposed opening of the aligned access slot.

Figure 18:
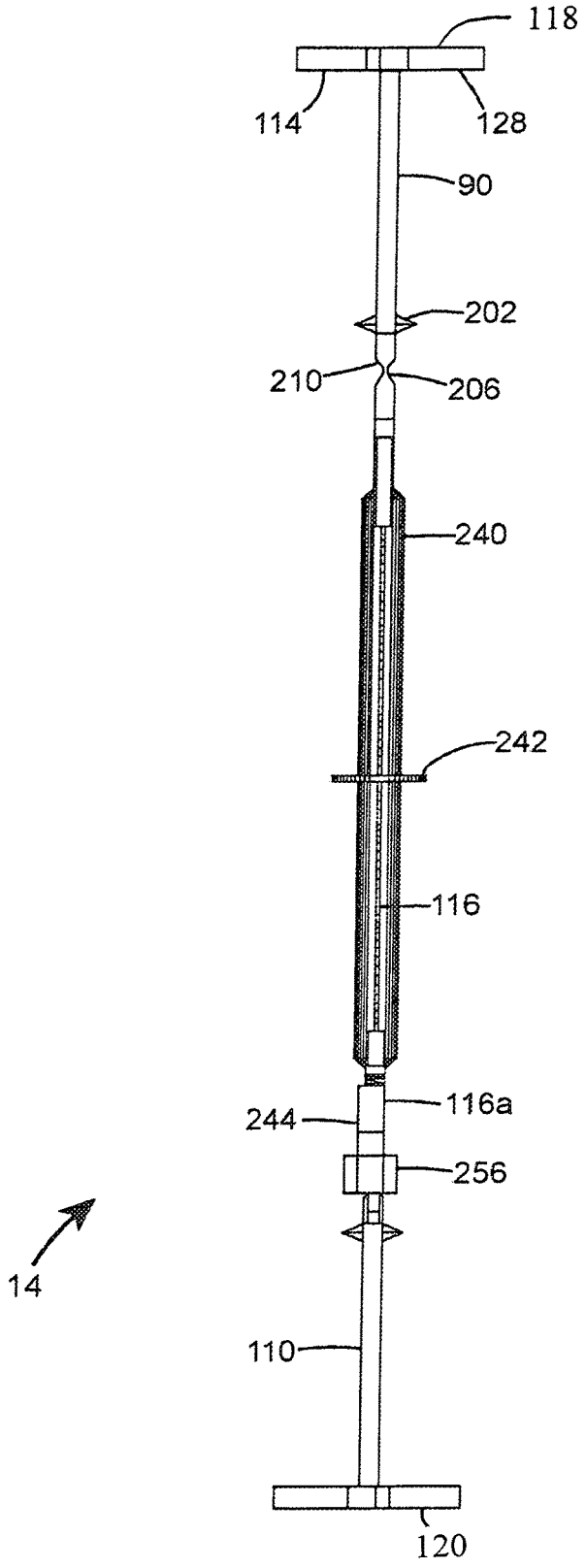
FIG. 18 is a bottom plan view of the preferred embodiment of the present invention illustrating a panel spacing tie comprising a mid-support section situated in between and connected to a pair of end sections each having a flange member perpendicularly attached thereto.
Figure 19:
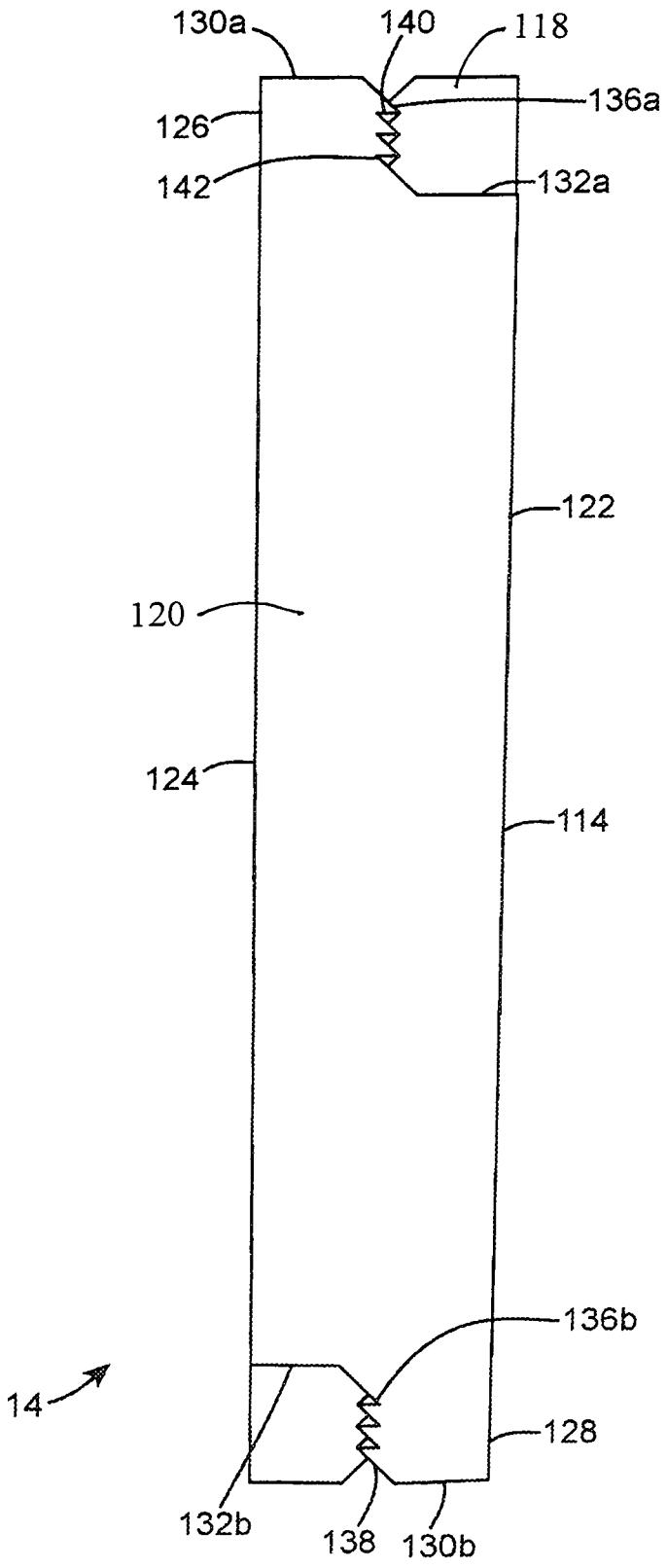
FIG. 19 is a left side elevational view of the preferred embodiment of the present invention illustrating a panel spacing tie comprising a pair of flange member each having first and second opposing ends configured with a set of teeth.

Referring now to FIGS. 18 and 19, each end section 90 of the panel and corner spacing ties is generally shown therein as comprising a flange member 114 having first and second planar surfaces 118, 120 bounded by first and second sideward members 122, 124 angularly extending between and connecting to first and second opposing ends 126, 128. The sideward members are generally shown in FIG. 19 as being angularly orientated a predetermined amount to form the overall appearance of the flange member 114 to the extent of geometrically corresponding to and spatially fitting within one of the opposing spatial wedges 104 of the first slot 92, where a width associated with the second opposing end 128 is less than a width of the first opposing end 126 by approximately 0.25-20%.

Figure 20:
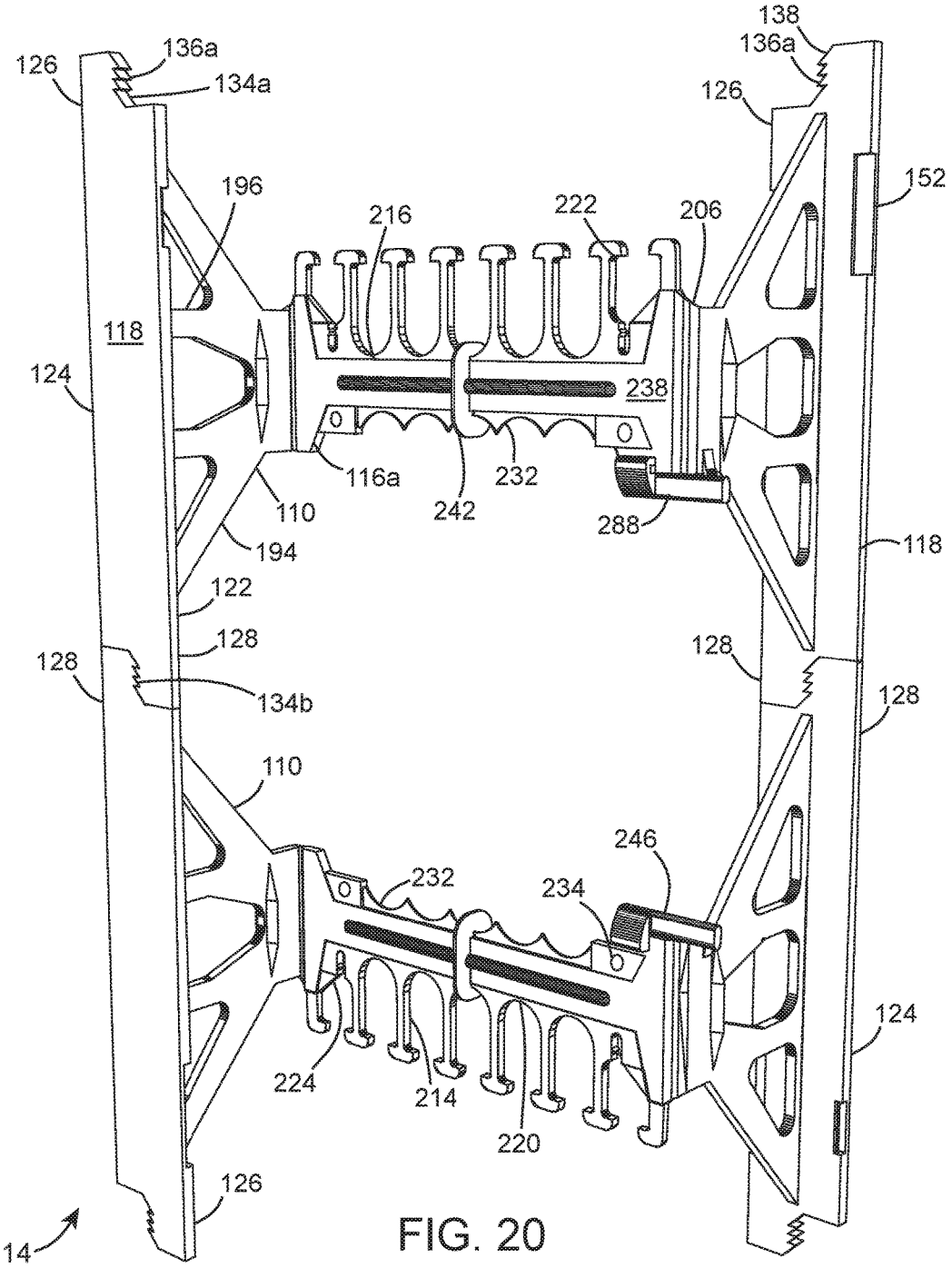
FIG. 20 is a front perspective view of the preferred embodiment of the present invention illustrating a pair of panel spacing ties vertically aligned and connected to one another along second opposing ends by locking means.
Figure 21:
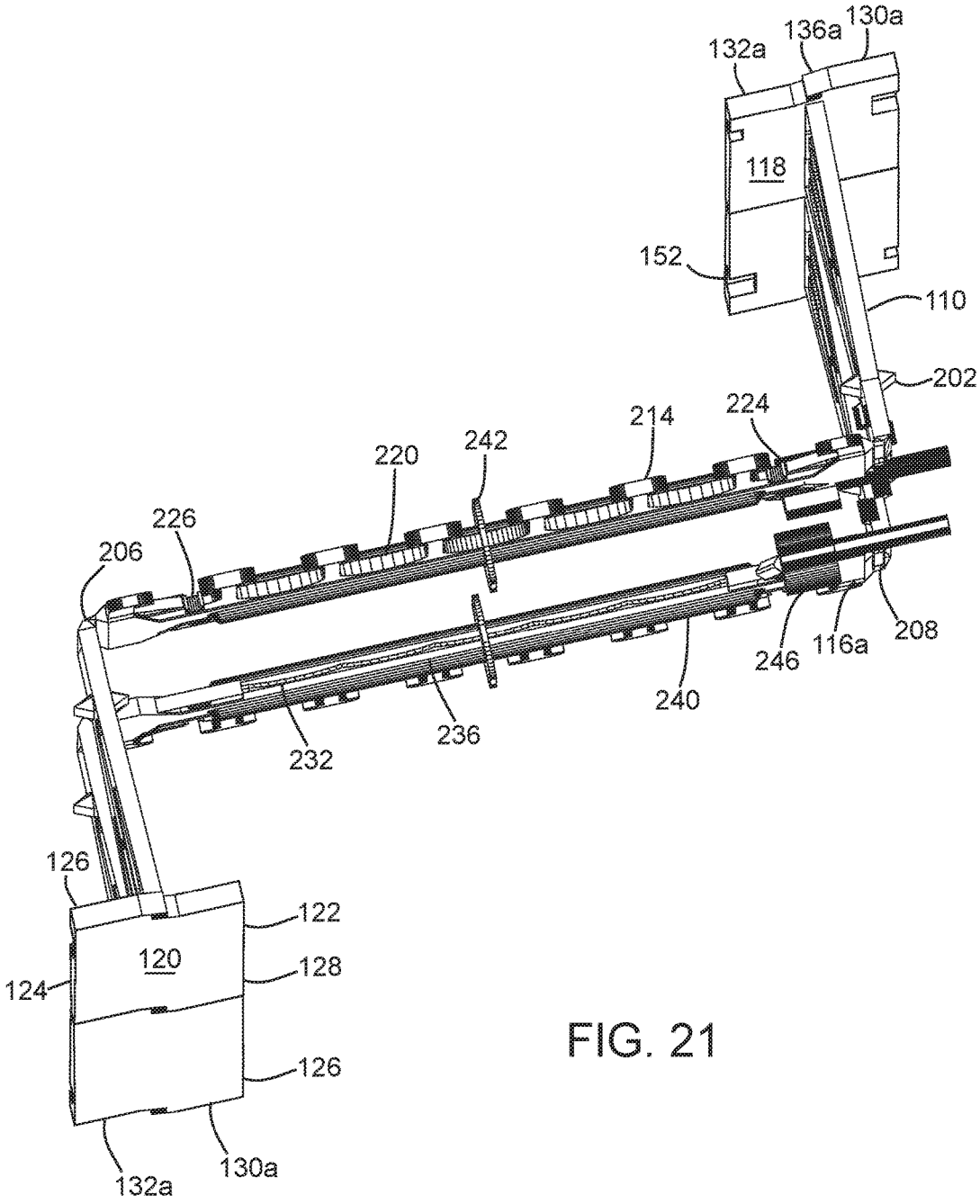
FIG. 21 is a top perspective view of the preferred embodiment of the present invention illustrating a pair of panel spacing ties vertically aligned and connected to one another along second opposing ends by locking means and having end sections connected to and angularly orientated to mid-support sections.
Figure 25:
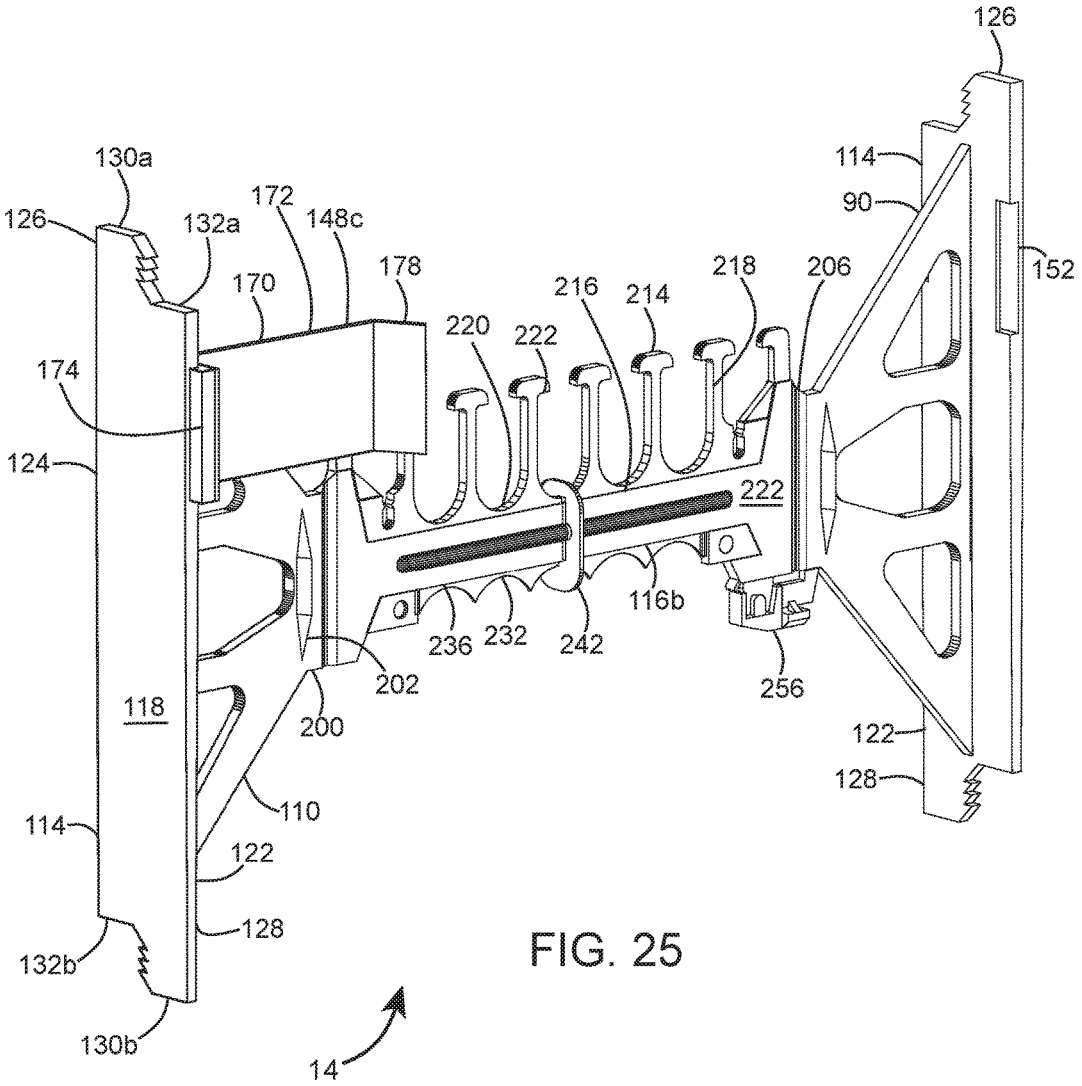
FIG. 25 is a front perspective view of the preferred embodiment of the present invention illustrating a panel spacing tie comprising a mid-support section situated in between and connected to a pair of end sections each having a flange member perpendicularly connected to a truss support, wherein one the flange members comprises a third metallic component attached thereto in the form an angular-shaped metallic plate.

In other aspects of the panel and corner panel spacing ties 14, 17 as represented in FIGS. 20 and 21, each of the first and second opposing ends 126, 128 is further associated with locking means, which is preferably shown therein to comprise upper and lower ridges 130*a*, 130*b*, 132*a*, 132*b* separated apart in terms of a predetermined vertical distance by a vertical riser 134*a*, 134*b* having a set of teeth 136*a*, 136*b* integrated within its structure. The vertical riser 134*a* of the first opposing end 126 as shown in FIG. 25 is generally associated with a set of teeth 136*a* that directionally face toward the first sideward member 122, while in contrast the vertical riser 134*b* of the second opposing end comprises a set of teeth 136*b* that directionally face in an opposite manner toward the second sideward member 124. Each tooth as associated with the set of teeth constituting in part locking means comprising a downwardly angular component 138 and a horizontal component 140 that generally contribute to forming the triangular appearance of the tooth.

Interposed in between each tooth is a triangular-shaped receptacle 142 suited to correspondingly receive and engage with the triangular tooth configuration of a neighboring flange member 114, as generally depicted in FIGS. 20 and 21. By means of the downwardly angular component 138 of each tooth, the set of teeth 136*a*, 136*b* are allowed to slidably pass or travel relatively downward without undue resistance upon an applied pressure force until the upper ridge 130*a*, 130*b* of one flange member meets and engages the lower ridge 132*a*, 132*b* of the proposed connected flange member and the teeth become situated within their respective complementary receptacles 142 of the adjoining flange member. Consequently, the mating relationship of the teeth within corresponding receptacles and the adjoined arrangement of the upper and lower ridges of neighboring flange members desirably contribute to inhibit the connected flange members from pulling apart under the influence of an applied tensional force or moving longitudinally inward toward one another that may otherwise compromise the structural continuity and rigidity of the flange members placed and housed interiorly within the first and second side panels 16', 16". Although locking means sufficiently serves to lock together adjoining flange members in this regard, it is the resultant geometric configuration of the flange members 114 slidably placed within the opposing spatial wedges 104 of the first slot 92 that fulfills to directionally align and guide the flange members and facilitate efficient operation of locking means for a tight hold on the panel or corner panel spacing tie 14, 17 relative to the side panel without undue lateral play that could otherwise compromise the accurate dimensioning of the block assembly, as typically illustrated in FIG. 29.

In recognition of the longitudinal block assembly 12*a* having the capacity to be orientated in a reversible manner that allows for connection with neighboring block assemblies by interlocking means, the two end sections 90 of each panel spacing tie 14 in particular are configured with flange members 114 that reversibly reflect with one another to further this aspect of functionality. For instance, the first planar surface 118 of the flange member associated with one end section is generally shown in FIGS. 18 and 19 as directionally facing outward from the perpendicular connection of the flange member to the truss support, whereas the first planar surface of the flange member associated with the complementary or second end section 90 of the panel spacing tie directionally faces inward toward the perpendicular connection of the flange member to the truss support 110. Accordingly, the set of teeth 136*a* associated with each of the first opposing ends 126 of the two connected flange members will be orientated in an opposite manner as well as the set of teeth 136*b* associated with each of the second opposing ends 128.

Figure 13:
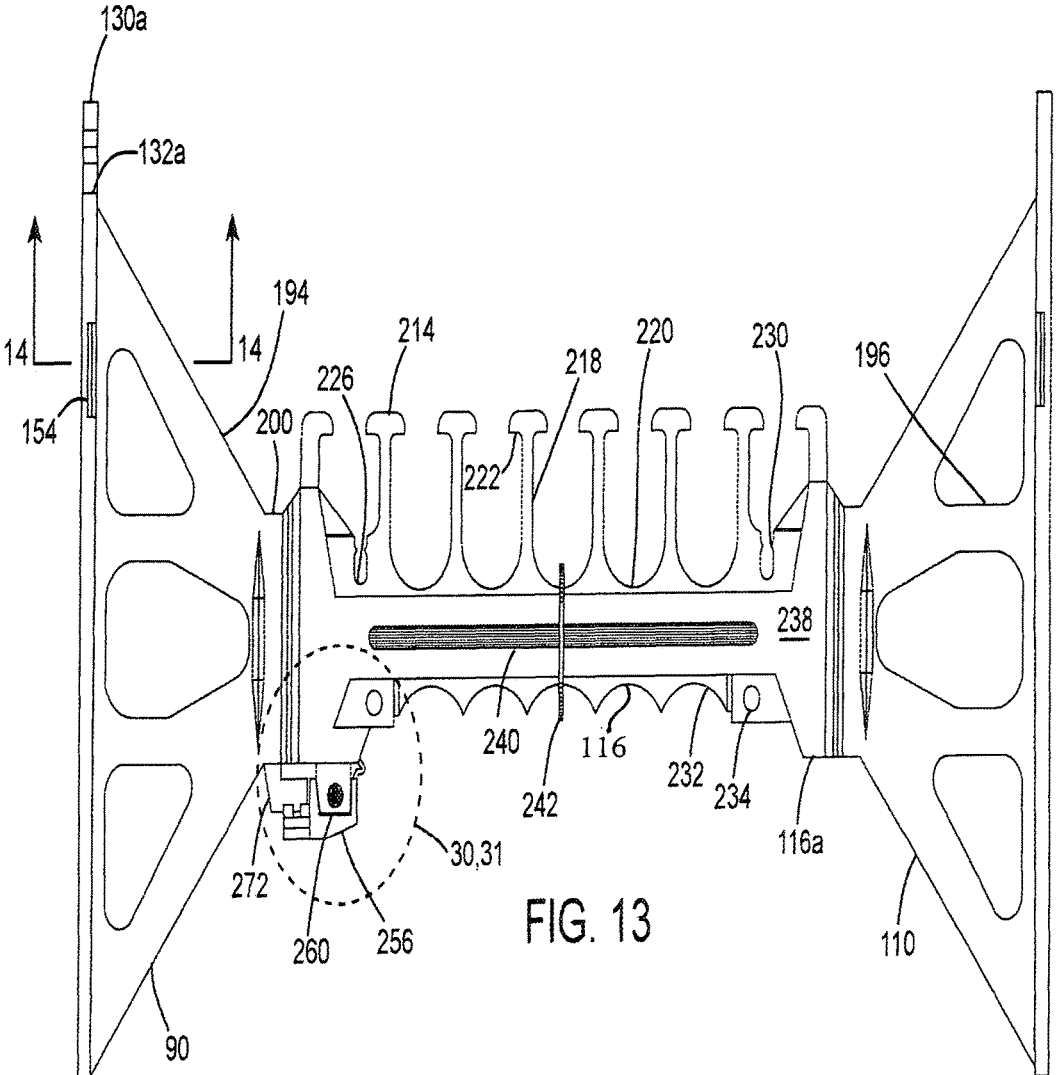
FIG. 13 is a front elevational view of the preferred embodiment of the present invention illustrating a panel spacing tie having a mid-support section interposed in between and connected to ends sections.
Figure 14:
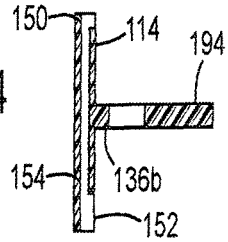
FIG. 14 is a cross sectional view of the preferred embodiment of the present invention taken along line 14-14 in FIG. 13 illustrating a truss support connected perpendicularly to a flange member having an accessible recessed portion with an internal sleeve.
Figure 23:
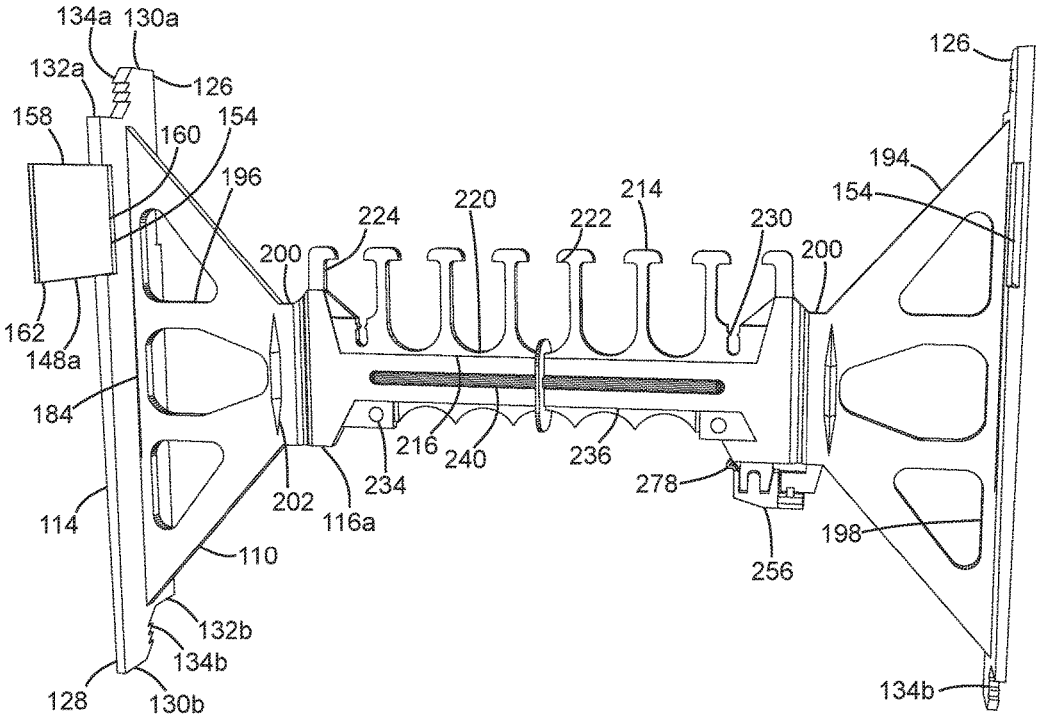
FIG. 23 is a front perspective view of the preferred embodiment of the present invention illustrating a panel spacing tie comprising a mid-support section situated in between and connected to a pair of end sections each having a flange member perpendicularly connected to a truss support, wherein one the flange members comprises a first metallic component attached thereto in the form of a metallic plate.
Figure 24:
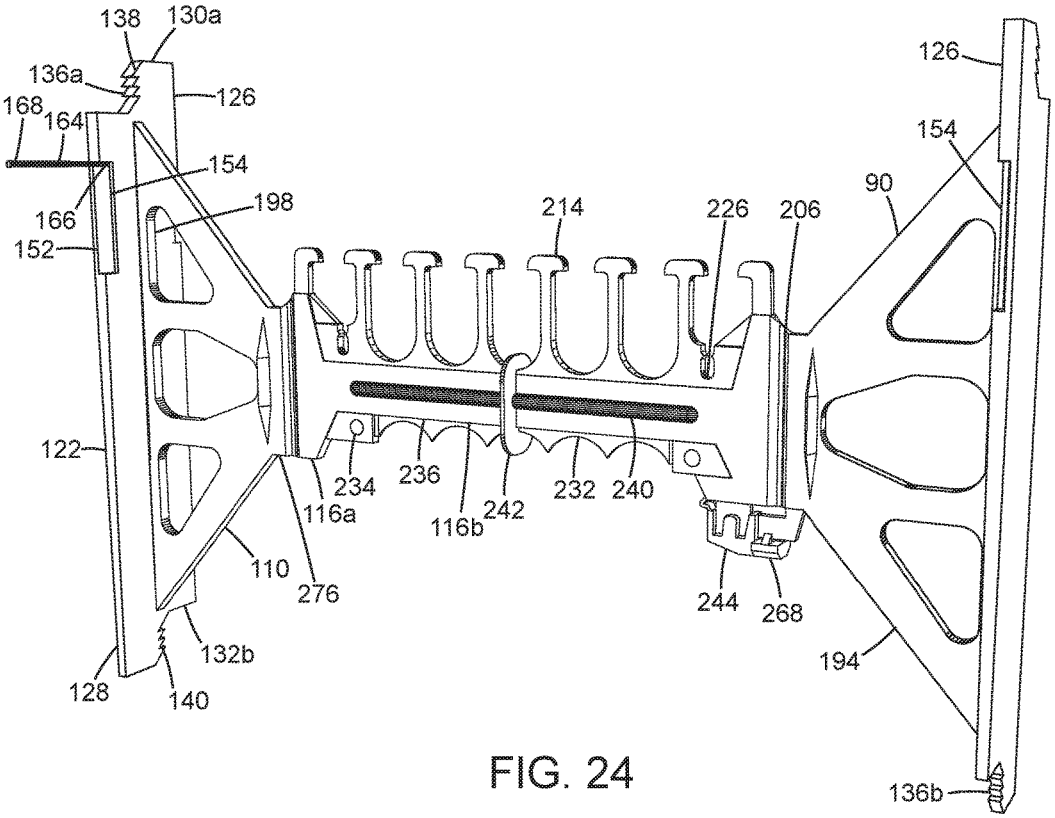
FIG. 24 is a front perspective view of the preferred embodiment of the present invention illustrating a panel spacing tie comprising a mid-support section situated in between and connected to a pair of end sections each having a flange member perpendicularly connected to a truss support, wherein one the flange members comprises a second metallic component attached thereto in the form of a metallic rod.
Figure 26:
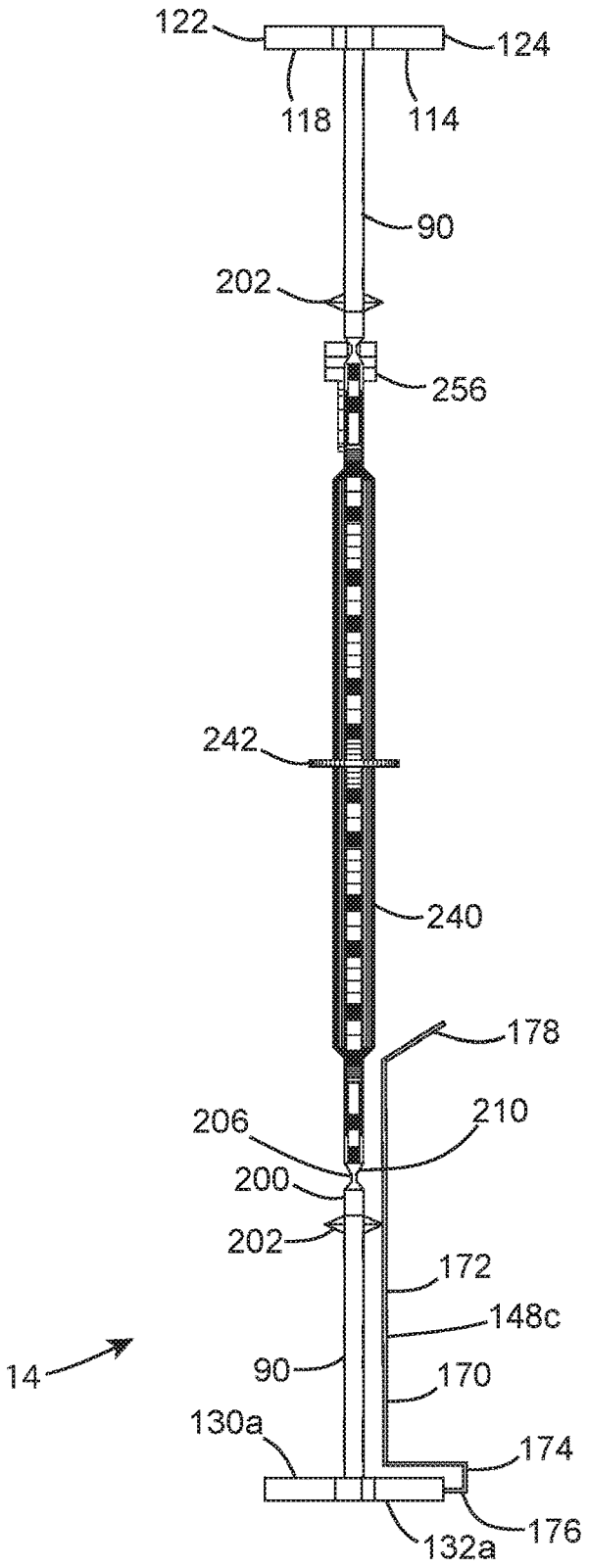
FIG. 26 is a top plan view of the preferred embodiment of the present invention illustrating a panel spacing tie comprising a mid-support section situated in between and connected to a pair of end sections each having a flange member perpendicularly connected to a truss support, wherein one the flange members comprises a third metallic component attached thereto in the form an angular-shaped metallic plate.
Figure 27:
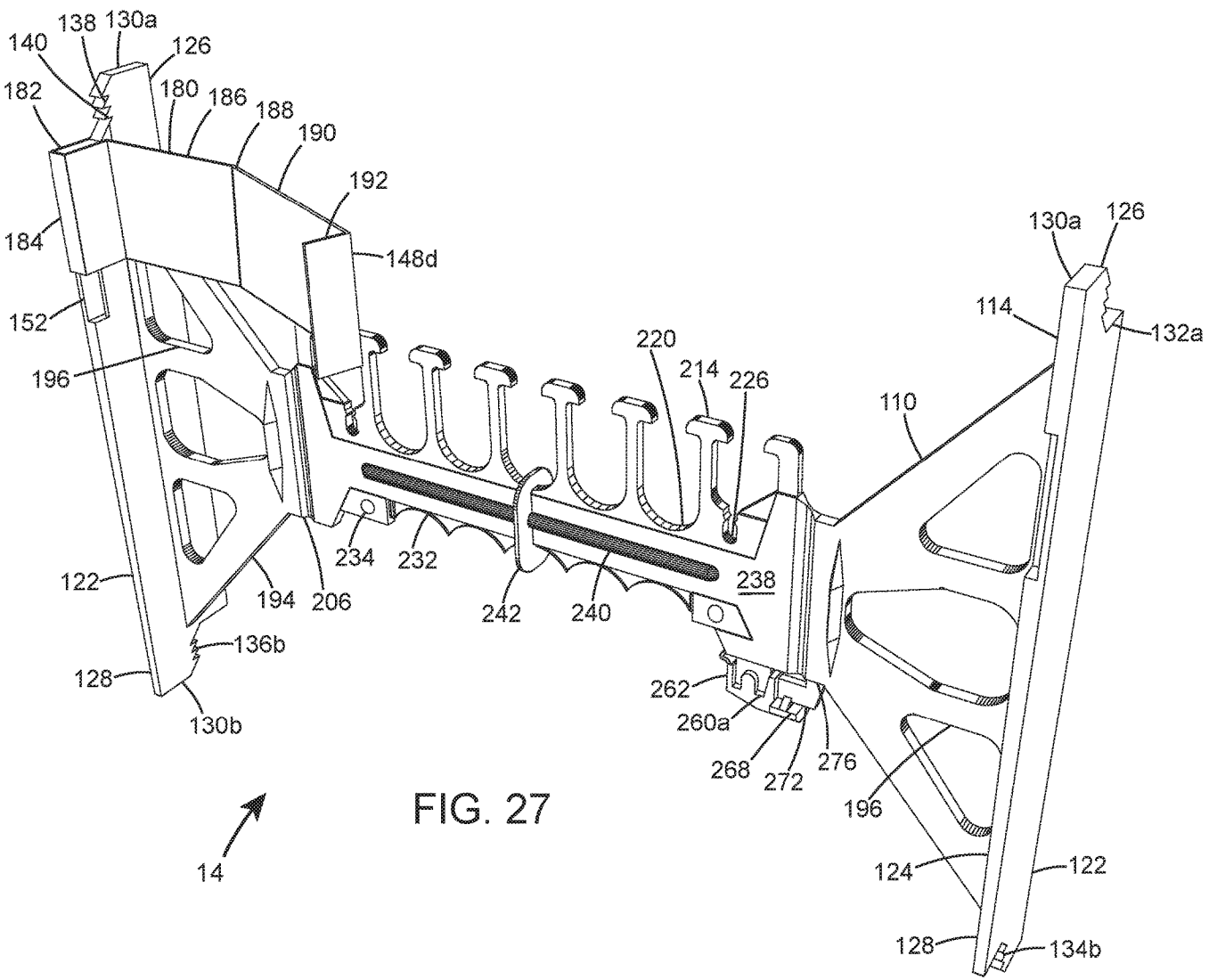
FIG. 27 is a front perspective view of the preferred embodiment of the present invention illustrating a panel spacing tie comprising a mid-support section situated in between and connected to a pair of end sections each having a flange member perpendicularly connected to a truss support, wherein one the flange members comprises a fourth metallic component attached thereto in the form of a sliding bendable plate.

To assist in locating embedded, hidden flange members vertically aligned and housed within the confines of the side panel after assembly of the ICF system 10, generally for purposes of mounting ancillary structures, each block assembly 12*a*, 12*b* is further associated with locating means. In its simpliest form, locating means generally comprises embedded markings 146 formed into and placed relatively about the exterior face 30', 30" of the first and second side panels and in alignment with the known placement or position of the first slot designated for receiving and housing therewithin the vertically aligned, connected flange members. Although the simplest form of locating means may be appropriate in most applications, it may become entirely inappropriate in instances where the embedded markings are covered by finishing materials momentarily after construction of the poured concrete wall structure using the ICF system 10. In this regard, locating means may alternatively comprise metallic components 148*a*, 148*b*, 148*c*, 148*d* mounted to the flange member to assist in its location using magnetic-based stud finders, for example. As generally depicted in FIGS. 13 and 14, a sideward slot 150 is integrally provided in the flange member 114 with an accessible recessed portion 152 directionally open toward and facing the mid-support section 116. An internal sleeve 154 integrally open to the accessible recessed portion and extending to the sideward member is selectively configured to accept and house therewithin an inward portion 156 of the metallic component for its retention and connection of the flange member. In a first alternative form of locating means, the first metallic component 148*a* is shown in FIG. 23 as comprising a metallic plate 158 having a first end 160 slidably positioned within the spatial confines of the internal sleeve 154 and a second exposed end 162 extending outwardly beyond the first or second sideward member 122, 124 of the flange member. In a second alternative form of locating means, the second metallic component 148*b* is shown in FIG. 24 as comprising a metallic rod 164 having a first end 166 placed within the internal sleeve 154 and a second end 168 extending outwardly beyond the first or second sideward member of the flange member 114 to the likes proffered for the first alternative form of locating means. In a third alternative form of locating means, the third metallic component 148*c* is shown in FIGS. 25 and 26 as comprising an angularly shaped plate 170 having a planar mid-section 172 interposed in between and connected to an end section 174 formed into a rectangular configuration with a free outward end 176 that slidably engages the accessible recessed portion 152 to reside within the internal sleeve 154 and an opposing angular end 178 that is generally configured to extend beyond the interior face 28', 28" of the first and second side panels insofar to reach within the communicating receptacle 18 of the ICF system 10 for encasement within the concrete's matrix. In a final and fourth form of locating means, as shown in FIGS. 1 and 27, the fourth metallic component 148*d* operates apart from the accessible recessed portion and is connectively configured with the flange member after it has been placed within the confines of the T-shaped slot 96 to join internally with another vertically placed panel spacing tie, where in particular one end of the flange member generally extends in part formation with interlocking means for locking engagement with a similarly configured flange member of an adjoining longitudinal or corner block assembly. Accordingly, in line with this configuration, the fourth metallic component is shown in FIG. 27 as comprising a sliding bendable plate 180 having an end 182 configured as a u-shaped sleeve 184 to slidably fit externally over the first opposing end 126 of the flange member 114 comprising in part locking means. An inwardly extending member 186 is further shown as being integrally connected and extending perpendicularly outward from the u-shaped sleeve and is configured to reside internally within the aligned access slot alongside the truss support 110 and near interlocking means. Further attached to an opposing end 188 of the inwardly extending member is an outward bent member 190 configured with a v-shaped end 192 that generally extends outwardly from the truss support of the panel or corner panel spacing tie 14, 17, as typically shown in FIG. 27. The outward bent member with its v-shaped end is configured to form within the concrete mix for a firm and tight hold of the fourth metallic component 148*d* relatively to the side panel.

Although locating means primarily serves to locate hidden flange members for subsequent mounting of finishing materials and the like to the flange members after construction of the concrete wall structure, the first, third and fourth alternative forms of locating means may supplementally serve in the capacity to reinforce mounting of finishing materials that may otherwise exceed the holding and supportive capacity of the flange members 114. In some applications, however, variation in the thickness of the metallic component may be appropriate or desirable to adequately support the weight of select finishing materials.

In further reference to FIG. 13, the truss support 110 as associated with each end section 90 of either the panel or corner panel spacing tie 14, 17 is generally shown therein as comprising a pair of outer angular supports 194 operating in conjunction with a pair of internal supports 196 extending in between and connecting to first and second vertical members 198, 200, where the first vertical member comprises a length that generally approximates the distance in between the lower ridges 132*a*, 132*b* of the first and second opposing ends 126, 128 and connects to and extends outwardly from the flange member 114. Comparatively, the second vertical member 200 of the panel or corner panel spacing tie 14, 17 is respectively shown in FIGS. 23 and 47 as comprising a pair of integral stops 202 that extend outwardly from each side thereof a predetermined distance or a vertical sleeve 204, whereby the stops or the vertical sleeve generally engages a portion of the interior face 28', 28" of the side panel as the end section 90 of the panel or corner panel spacing tie is slidably positioned and housed in part within the confines of the tie receiver 88. The functionality of the integral stops as well as the vertical sleeve in some respects respectively serve to add rigidty to the panel and corner spacing ties and consequently limit racking of the block assemblies for more accurate dimensional spacing in between opposing side panels.

Figure 22:
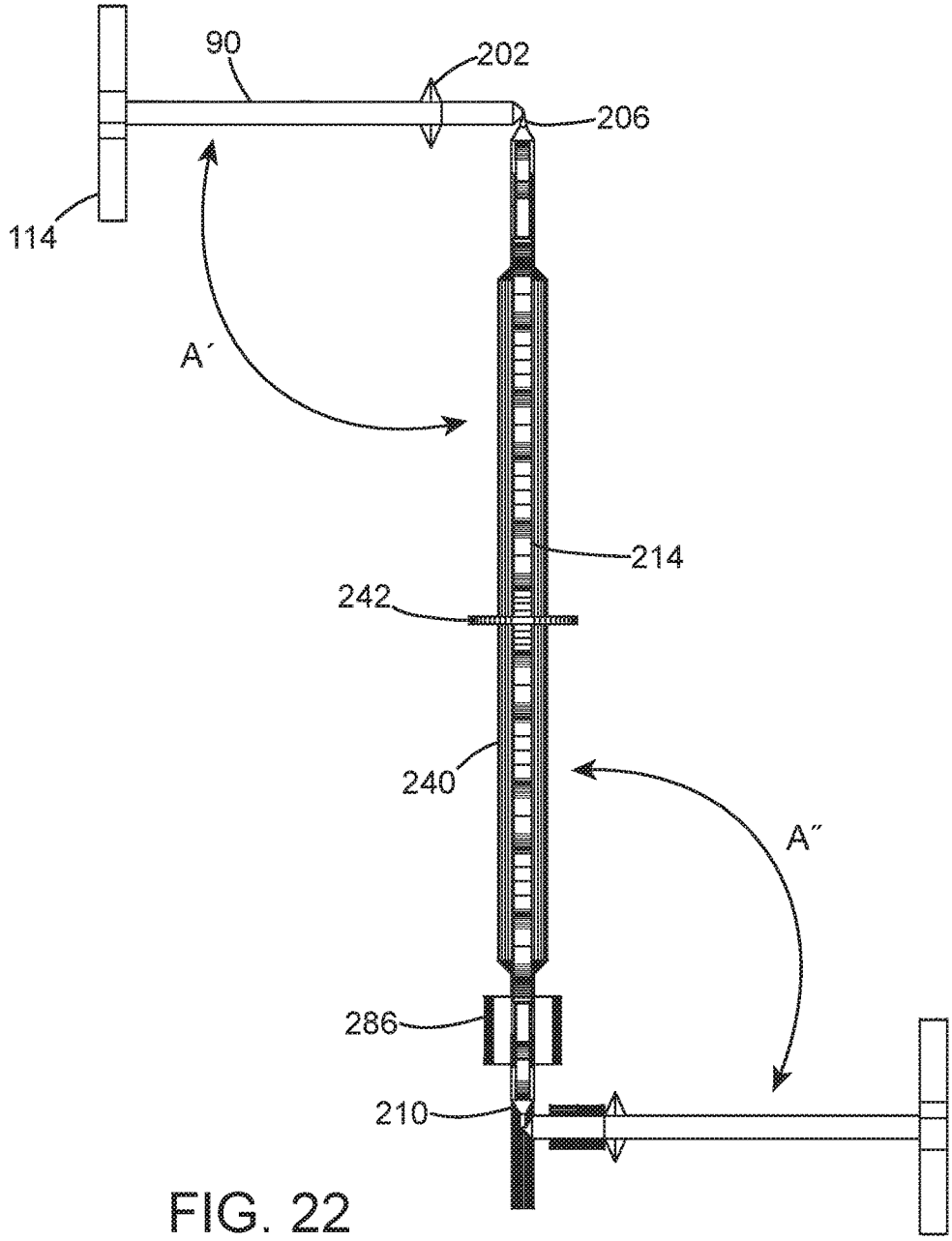
FIG. 22 is a top plan view of the preferred embodiment of the present invention illustrating a pair of panel spacing ties each having a pair of end sections connected to and angularly orientated to a mid-support section.
Figure 39:
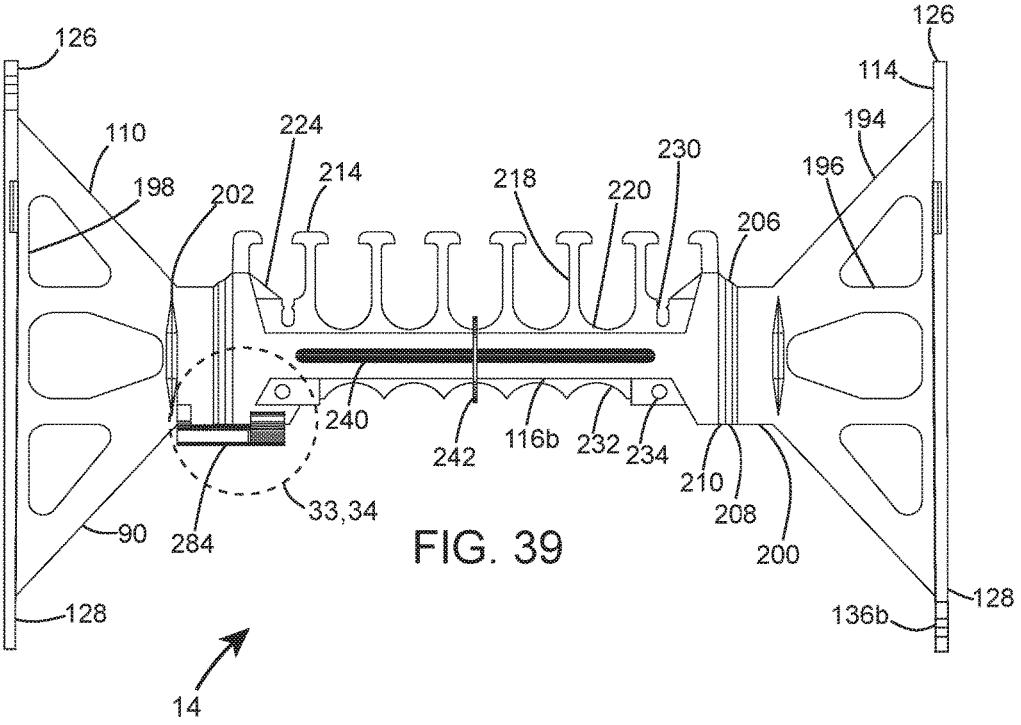
FIG. 39 is a front elevational view of the preferred embodiment of the present invention illustrating a panel spacing tie having a mid-support section situated in between and connected to a pair of end sections by a living hinge and locked in an aligned orientation by a second embodied form of a locking mechanism.

Now in specific reference to FIGS. 18 and 39, a living hinge 206 is further associated with each end section 90 of the panel spacing tie 14, where it is shown therein as being interposed in between and connectively joining together the second vertical member and and an end 116*a* of a mid-support section 116. The living hinge is generally characterized as comprising an elongate flexible member 208 integrally connecting to inwardly tapered elements 210 associated with the second vertical member and the end of the mid-support section such to fulfill angular movement of each end section 90 relatively from the mid-support section 116 of the panel spacing tie. FIG. 22 generally depicts a degree of angular movement of each end section relatively about each side of the mid-support section, wherein the end section can move angularly leftward A' or rightward A" approximately 100° from a static position of the mid-support section. Accordingly, the operative capacity of the pair of living hinges as associated with each panel spacing tie 14 is particularly advantageous in attaining the state of compactness of the longitudinal block assembly 12*a* for shipping and transport purposes, where the opposing side panels 16', 16" are generally observed in FIGS. 4, 6, 8, and 9 as being placed in side-by-side, racked positioned and the mid-support section of each panel spacing tie resides relatively lengthwise within a compacted space 212. The compacted space, as maintained in between the interior faces of the opposing side panels in a collapsible state, is generally limited by the extent the elongate flexible member 208 of the living hinge 206 distantly extends outward from the interior face of one side panel and engages the interior face 28', 28" of the opposing side panel, typically in the manner depicted in FIG. 9.

As generally exemplified in FIG. 13, the mid-support section 116 further comprises a plurality of T-stems 214 extending upwardly from a top edge 216 thereof to form in between adjacent T-stems an innermost open receptacle 218 for receiving and holding therewithin ancillary reinforcement supports in the form of rebar and the like that commonly accompany the fabrication of concrete wall structures for supplementing strength thereto. Each innermost open receptacle is generally configured with a concave bottom 220 where an underside portion 222 of each T-stem inhibits supplemental fasteners and ties used in securing the reinforcement support to the panel spacing tie from sliding upward and apart from the open receptacle.

A pair of outermost open receptacles 224 each positioned near the ends of the mid-support section and in alignment with the innermost open receptacles, as generally represented in FIG. 13, comprises a concave slot 226 that serve to receive and hold therewithin a pre-select portion of a lateral support member 228 that supplements the hold of adjacent panel spacing ties 14 for increased rigidity of the block assembly 12*a*, 12*b* as well as serving to supplement the tongue and groove configuration for increased hold of block assemblies placed in a side-by-side relationship. In another instance of its use, the lateral support member may serve to extendingly bridge to the concave slots 226 associated with panel spacing ties 14 of side-by-side longitudinal or corner block assemblies such to tightly hold together and secure their position relative to one another where the tongue and groove configuration has been removed, for example, by the act of vertically cutting one or more block assemblies to accommodate the lineal dimension of the concrete wall structure. As further evident in FIGS. 13 and 23, the concave slot is shown therein as comprising a pair of opposing nubs 230 at its entrance that supplementally serves to lock in place and prevent the lateral support member from being inadvertently removed from its position while functioning to connect and secure adjoining panel spacing ties.

Figure 28:
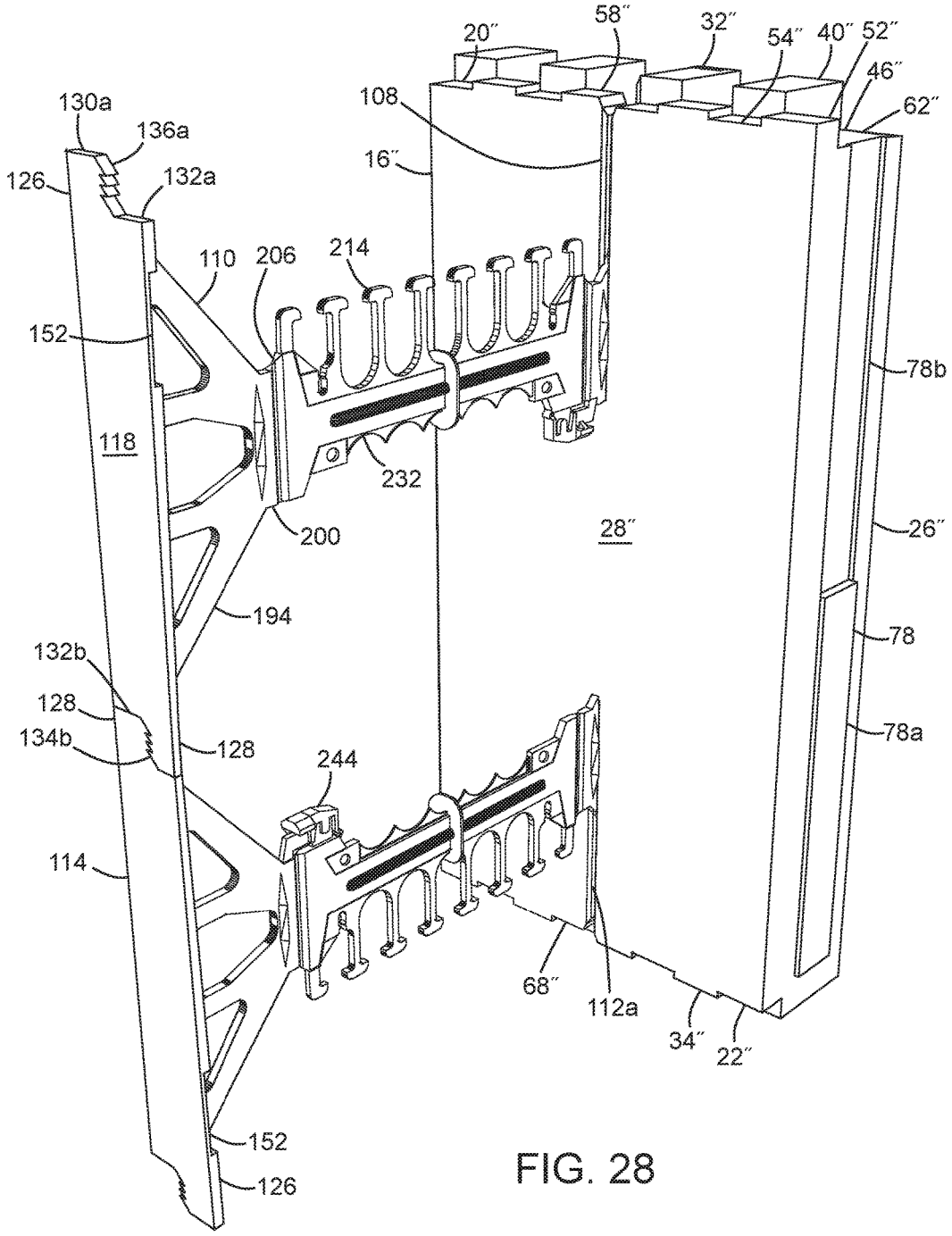
FIG. 28 is a front perspective view of the preferred embodiment of the present invention illustrating a pair of panel spacing ties vertically aligned and connected to one another by locking means and configured for fitment within a pair of aligned access slots.

The mid-support section 116, as generally depicted in FIGS. 24 and 28, is supplemented with a plurality of concave depressions 232 positioned along its bottom edge 116*b* that serve to receive and hold therewithin ancillary reinforcement supports of the type generally suited for the innermost open receptacles. Supplemental fasteners and ties may equally be used to secure the position of the ancillary reinforcement supports relatively within the concave depressions. Generally located below the concave slots of the outermost open receptacles 224 and in alignment with the concave depressions 232 is a pair of apertures 234 extending through a lower portion 236 of the mid-support section 116 that serve to receive and pass therethrough sections of wire and the like that supplement the operability of the lateral support member 228 in laterally securing together nearby panel spacing ties. Attached in an opposing manner to outward faces 238 of the mid-support section in between the bottom and top edges 116*b*, 216 thereof, as generally represented in FIG. 27, is a pair of longitudinal stiffeners 240 that primarily operates to add rigidity to the overall structure of the panel spacing tie 14 insofar to inhibit racking of the block assembly as well as ensuring an equidistant relationship in between the opposing side panels 16', 16". As generally illustrated in FIGS. 22 and 24, the mid-support section is further shown as comprising a mid-stop 242 perpendicularly oriented to and mounted to outward faces of the mid-support section such to traverse the longitudinal stiffeners and intercept in part one of the innermost open receptacles 218 relatively situated above a nearby concave depression 232. The mid-stop in this regard generally serves to limit the extent of movement of one or more inner fitted panels longitudinally inward along the mid-support section where such inner fitted panels have been added interiorly within the receptacle portion and attached to the panel spacing tie to offer supplemental rigidity thereto.

Now referring to FIGS. 30-37, the panel spacing tie 14 is further supplemented with either first or second embodied forms of a locking mechanism 244, 246 that prevents angular movement of the end section 90 relatively to the mid-support section 116 of the panel spacing tie by means of the living hinge. Although the locking mechanism, as generally represented in FIGS. 24 and 27, is shown to exist at one end of the panel spacing tie, it is understood within the context of this disclosure that the first or second embodied forms of the locking mechanism may unequivocally exist about both ends of the panel spacing tie 14 to supplement its rigidity in appropriate applications, for example.

Figure 30:
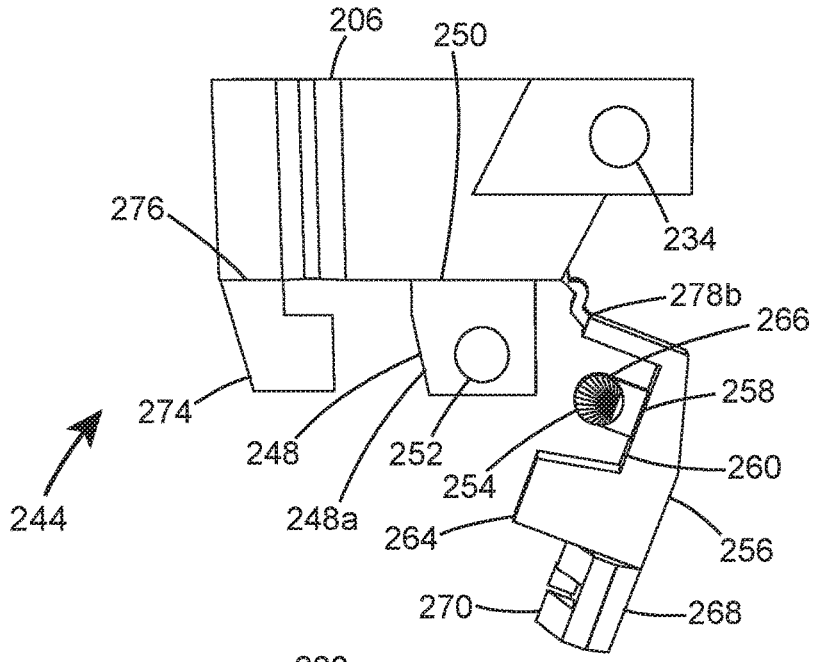
FIG. 30 is an exploded front elevational view of the preferred embodiment of the present invention illustrating a first embodied form of a locking mechanism having a swinging latch in an open position.
Figure 31:
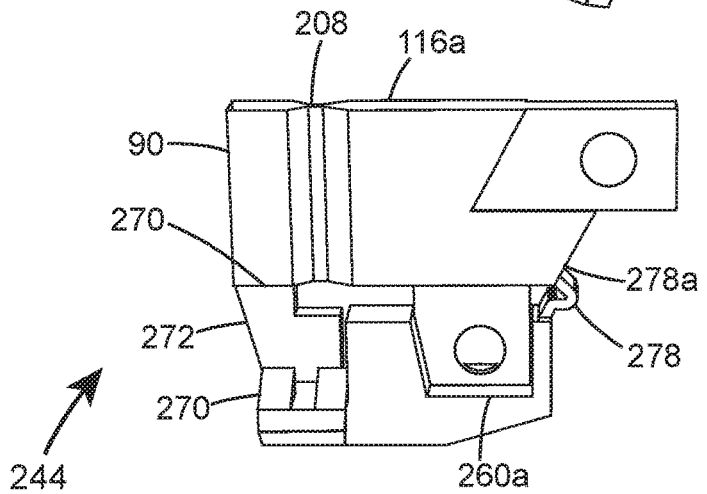
FIG. 31 is an exploded front elevational view of the preferred embodiment of the present invention illustrating a first embodied form of a locking mechanism having a swinging latch in a closed, locked position.
Figure 32:
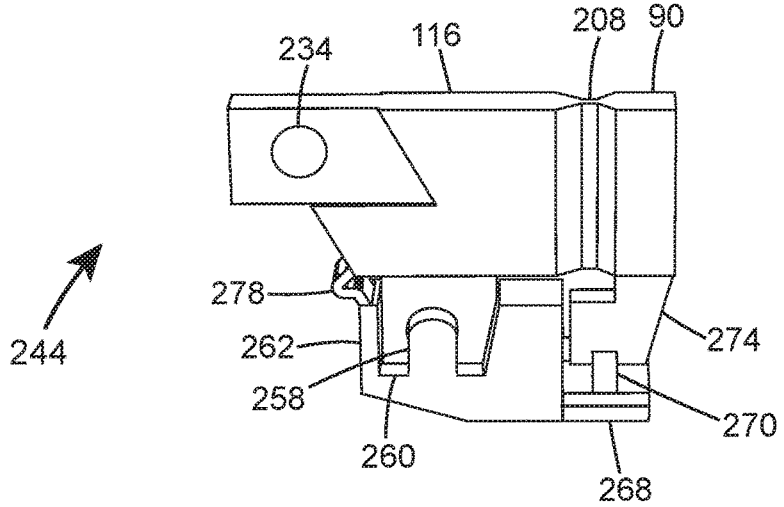
FIG. 32 is an exploded back elevational view of the preferred embodiment of the present invention illustrating a first embodied form of a locking mechanism having a swinging latch in a closed, locked position.
Figure 33:
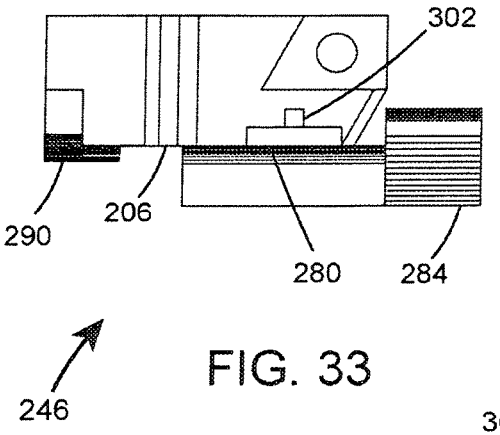
FIG. 33 is an exploded front elevational view of the preferred embodiment of the present invention illustrating a second embodied form of a locking mechanism having a sliding latch in a retracted, open position.
Figure 34:
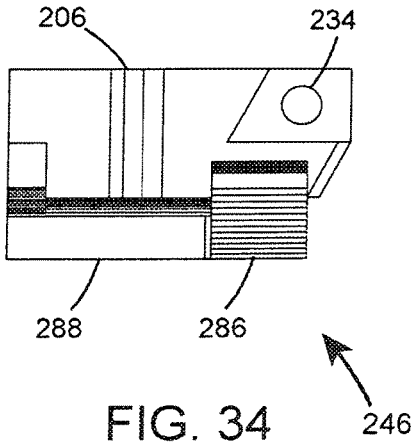
FIG. 34 is an exploded front elevational view of the preferred embodiment of the present invention illustrating a second embodied form of a locking mechanism having a sliding latch in a closed, locked position.
Figure 35:
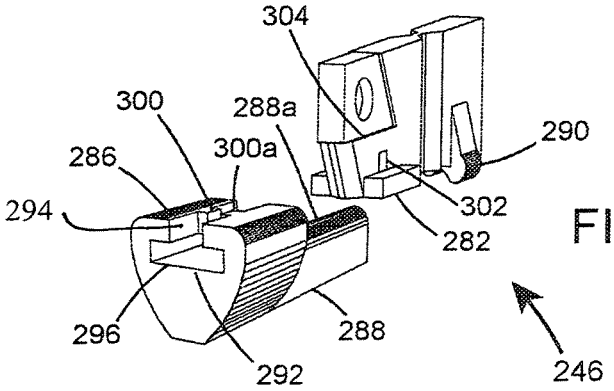
FIG. 35 is an exploded left perspective view of the preferred embodiment of the present invention illustrating a second embodied form of a locking mechanism having a sliding latch separably apart from a horizontal plate.
Figure 36:
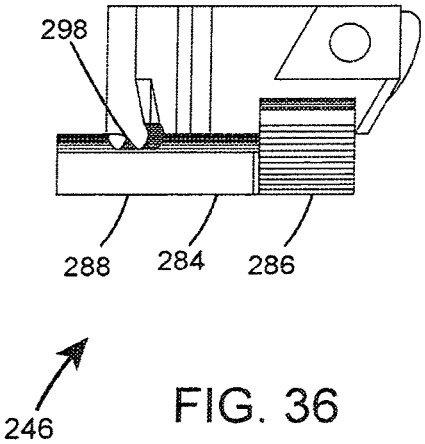
FIG. 36 is an exploded front elevational view of the preferred embodiment of the present invention illustrating a second embodied form of a locking mechanism having a sliding latch in a closed, disengaged position relatively to an end section.
Figure 37:
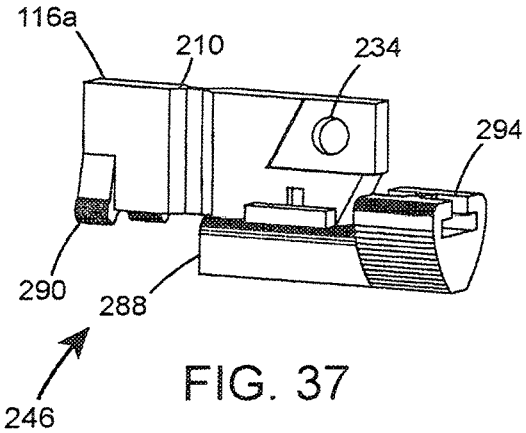
FIG. 37 is an exploded back perspective view of the preferred embodiment of the present invention illustrating a second embodied form of a locking mechanism comprising a sliding latch having an elongate arm retracted from a pair of offsetting lobes.
Figure 38:
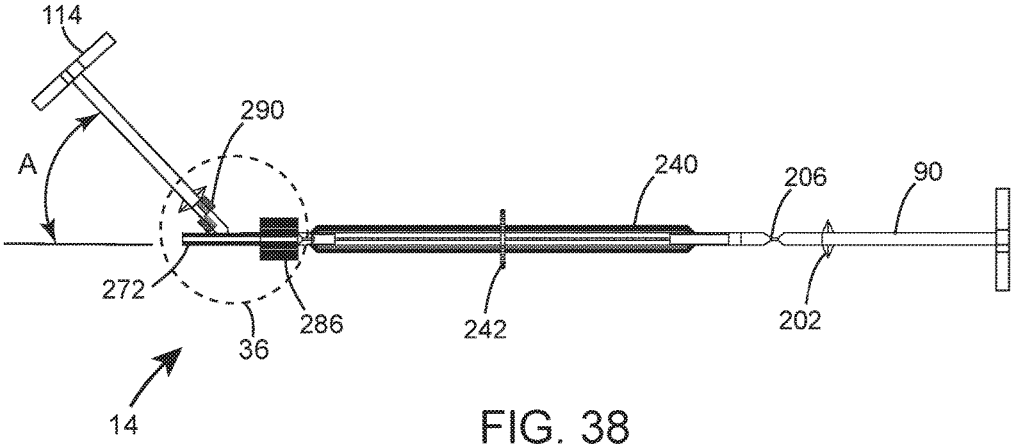
FIG. 38 is a top plan view of the preferred embodiment of the present invention illustrating a panel spacing tie having an end section connected to and angularly orientated from a mid-support section.

As generally associated with the first embodied form of the locking mechanism 244, a planar extension 248 is shown in FIGS. 25 and 30-32 as extending outwardly from a distal edge 250 of the mid-support section's end and comprises an aperture 252 extending therethrough for receiving therein a cylindrical sideward member 254 associated with a swinging latch 256. The cylindrical sideward member is shown in FIGS. 30 and 32 as extending perpendicularly outward from an upward support 258 integrally connecting to and upwardly extending from one side of a base portion 260*a* of a receiver 260 formed by a hinge wall 262 and an intermediate partition 264 integral to the swinging latch. The receiver is preferably shown in FIG. 30 as comprising a geometric configuration substantially corresponding to that of the planar extension 248 to allow the planar extension to frictionally engage and fit within the geometric confines of the receiver. Since the upward support is generally shown in FIG. 32 as being placed in an offsetting manner along one side of the base portion 260*a* such that the cylindrical sideward member 254 may collide otherwise with the structure of the planar extension during movement thereof, it is the inherent resilient properties of the upward support to undergo a modest amount of outward deflection insofar to permit the cylindrical sideward member to slidably move about an outer surface 248*a* of the planar extension and enable its reach to engagingly fit within the aperture 236 associated with the planar extension. A tapered end 266 integral to the cylindrical sideward member is further provided to allow initial tracking upwardly upon and over the outer surface of the planar extension to fulfill movement thereabout as described herein.

In further association with the first embodied form of the locking mechanism 244, as depicted in FIGS. 30 and 31, the swinging latch 256 is provided with a platform 268 extending from the intermediate partition 264 and having a pair of offsetting protuberances 270 extending upwardly therefrom to frictionally mate with an extendable portion 272 of an L-shaped member 274 as connected to the end section 90. FIG. 30 generally represents connection of one end of the L-shaped member to an end 276 of the second vertical member where the extendable portion is shown therein to span unconnected or bridge over the living hinge 206 in order to maintain its continued functionality apart from the locking mechanism. Dimensional spacing in between the offsetting protuberances may be slightly less than the thickness of the extendable portion to adequately accommodate a tight frictional fit that eliminates lateral play between the mid-support section 116 and end section 90 of the panel spacing tie as well as maintaining a degree of linearity thereof. As further evident in FIG. 31, a strap 278 having an end 278*a* connected to the distal edge of the mid-support section and an another end 278*b* connected to the hinge wall 262 serves as attachment means for attaching the swinging latch to the panel spacing tie and making it readily available for fulfilling its functionality in the manner disclosed herein.

As generally associated with the second embodied form of the locking mechanism 246, a horizontal plate 280 is depicted in FIGS. 33-37 as being connected to and perpendicularly orientated to the distal edge of the mid-support section's end 116*a* to form the general geometric shape of a T-mount 282 for operably interacting with a sliding latch 284. The sliding latch is further shown in FIG. 35 as comprising a gripable head 286 integrally connected to an elongate arm 288 having a semi-cylindrical configuration 288*a* along one side thereof for sliding engagement with a pair of offsetting lobes 290 integrally connecting to and extending angularly outward from the end of the second vertical member. Comparatively, the gripable head 286 comprises an internal rectangular recess 292 substantially corresponding to the geometric configuration of the horizontal plate and an internal vertical recess 294 perpendicularly orientated to and in spatial communication with the internal rectangular recess to generally form a T-shaped recess 296 to accommodate receipt and sliding passage of the T-mount. As further evident in FIG. 37, each lobe 290 is shown therein as comprising an inward side 298 with a concave surface substantially conforming in part to the exterior curvature associated with the semi-cylindrical configuration of the elongate arm 288 where the opposing configuration of the lobes sufficiently guides the sliding latch 284 to prevent lateral movement thereabout while furthering to restrict angular movement of the mid-support section 116 relatively to the end section 90 of the panel spacing tie 14 as the elongate arm largely spans unconnected or bridges over the living hinge 206. In fulfilling to restrict linear movement of the elongate arm apart from the lobes while in an engaging position, the internal vertical recess 294 is further associated with a pair of opposing tips 300 that extend inwardly therein to engage and mate with equally configured depressions 302 generally present about an exterior surface 304 of the distal end, below the horizontal plate as substantially illustrated in FIGS. 33 and 35. Accordingly, the elongate arm of the sliding latch will move towards and slidably engage the opposing configuration of the lobes 290 to the extent that the opposing tips 300 engage and snap fit within the confines of the equally configured depressions. Since the tips generally extend inwardly within the spatial confines defining the internal vertical recess 294 that may otherwise inhibit the free sliding movement of the T-mount 282 internally within the T-shaped recess 296, each tip may comprise a relative amount of beveling 300*a* to facilitate transitional placement thereabout that in turn effects a degree of deflection of the surrounding structure of the T-shaped recess to accommodate operability of the opposing tips 300 in the manner disclosed herein.

Figure 52:
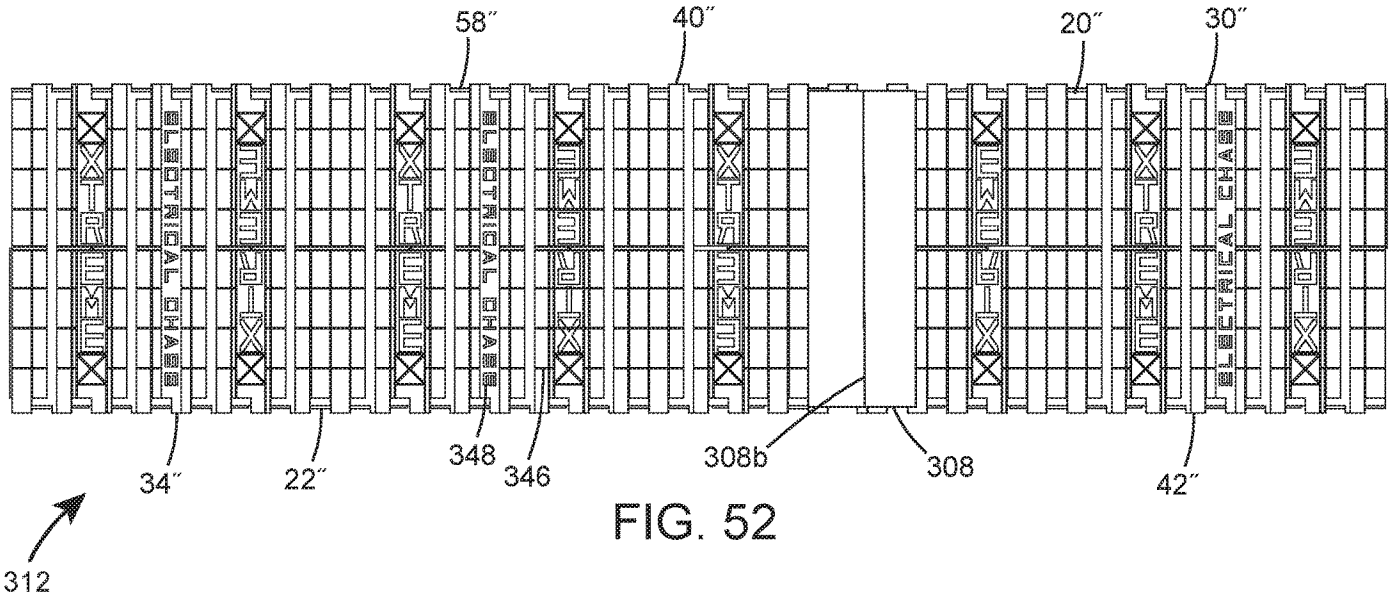
FIG. 52 is a front elevational view of the preferred embodiment of the present invention illustrating an inner corner side panel having a v-shaped cutout and visual markings.
Figure 53:
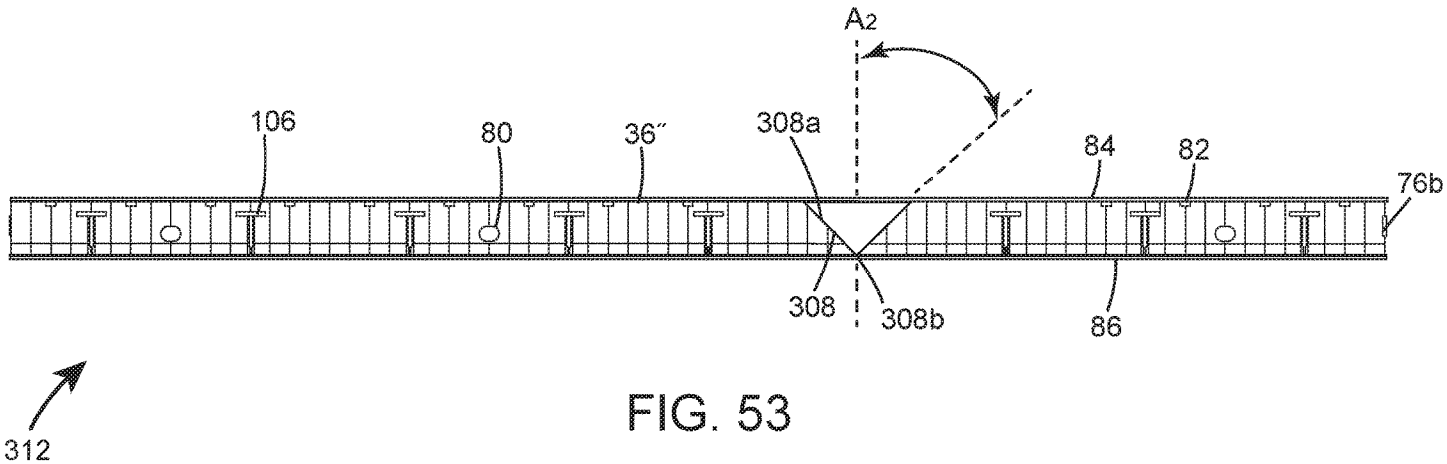
FIG. 53 is a bottom plan view of the preferred embodiment of the present invention illustrating an inner corner side panel comprising a v-shaped cutout, a plurality of vertical passageways and interior and exterior faces laminated with film.

Referring now to FIGS. 50-53, the first and second side panels 16', 16" as generally associated with the corner block assembly 12*b* are further modified in form from those associated with the longitudinal block assembly 12*a* to accommodate fabrication of a concrete corner wall structure having a 90° angular relationship. Accordingly, the first and second side panels each comprises a v-shaped cutout 306, 308 extending longitudinally in between the first and bottom leading edges thereof and parallel to the first and second end walls, where the v-shaped cutout comprises a pair of angular sides 306*a*, 308*a* each being orientated approximately 45° from axis $A_1$, $A_2$ extending normal to the exterior and interior faces of the side panel through vertex 306*b*, 306*b*. In the instance of the first side panel 16', which generally represents an outer corner side panel 310 of the corner block assembly 12*b* in FIGS. 50 and 51, the v-shaped cutout 306 is observably present about the interior face 28' to disrupt its surface continuity, whereas the second side panel 16", which generally represents an inner corner side panel 312 in FIGS. 52 and 53, shows the v-shaped cutout 308 being observably present about the exterior face 30". Under circumstances of fabricating the outer and inner corner side panels, the membranes generally covering the exterior and interior faces for purposes described herein are largely left intact to add supportive rigidity to the side panels while in a flattened state insofar to attain a degree of compactness for economical shipping thereof, for example. Contrariwise, where the outer and inner corner side panels 310, 312 are configured for assembly, the membrane 84, 86 covering the v-shaped cutout is openly sliced or folded to accommodate corner folding of the side panel relatively about and along a vertex 306*b*, 308*b* of the v-shaped cutout such to allow the angular sides 306*a*, 308*a* to engage one another, whereas the membrane on the opposing side is largely left intact to serve as a hinging mechanism while also adding supportive rigidity to the corner block assembly 12*b* particularly as such to mitigate occurrences of hydrostatic blowout upon receiving pourable concrete within the communicating receptacle 18, for example.

Figure 47:
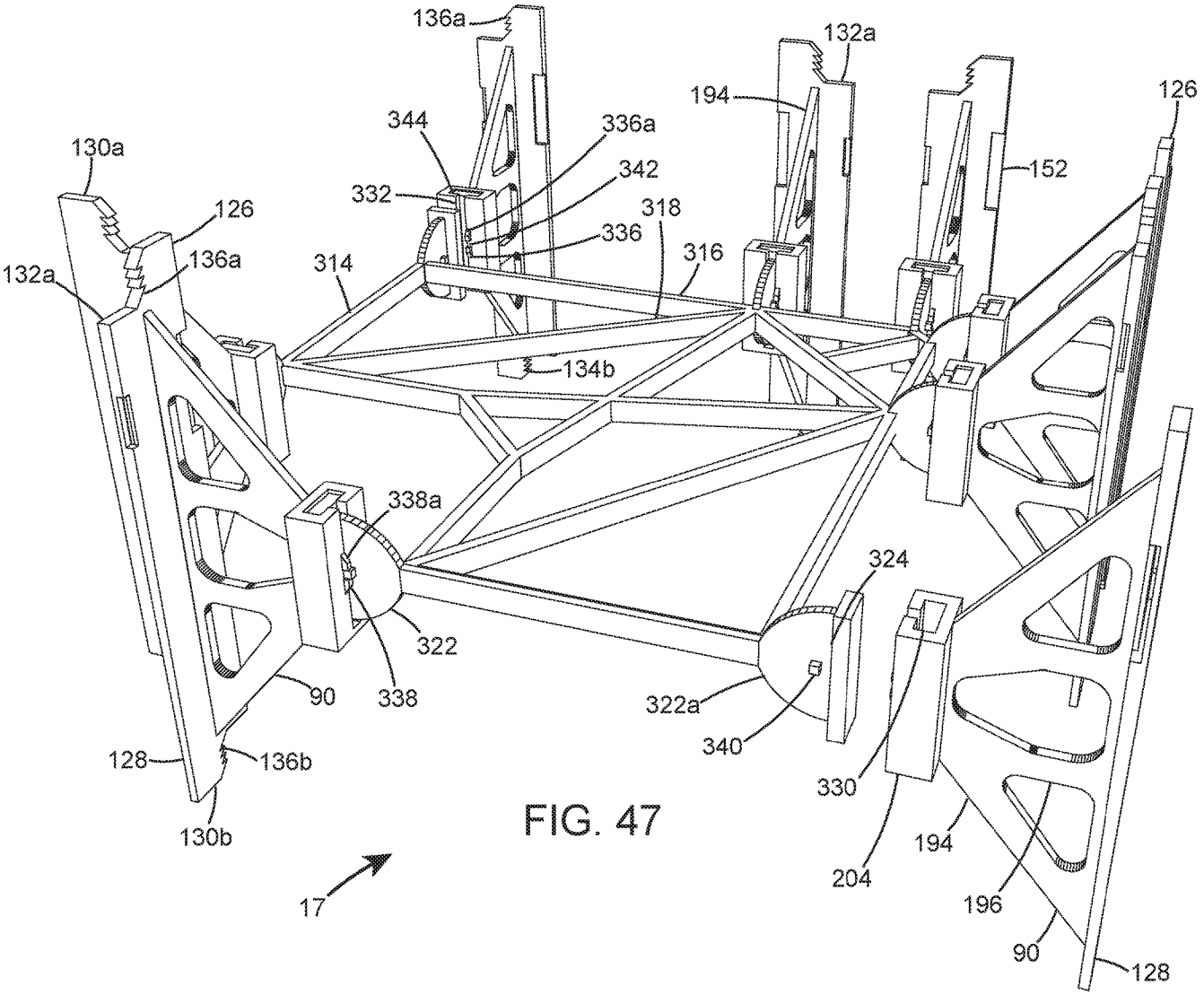
FIG. 47 is a front perspective view of the preferred embodiment of the present invention illustrating a corner panel spacing tie comprising end section connected to a unified corner frame having an interior sub-frame assembly.
Figure 48:
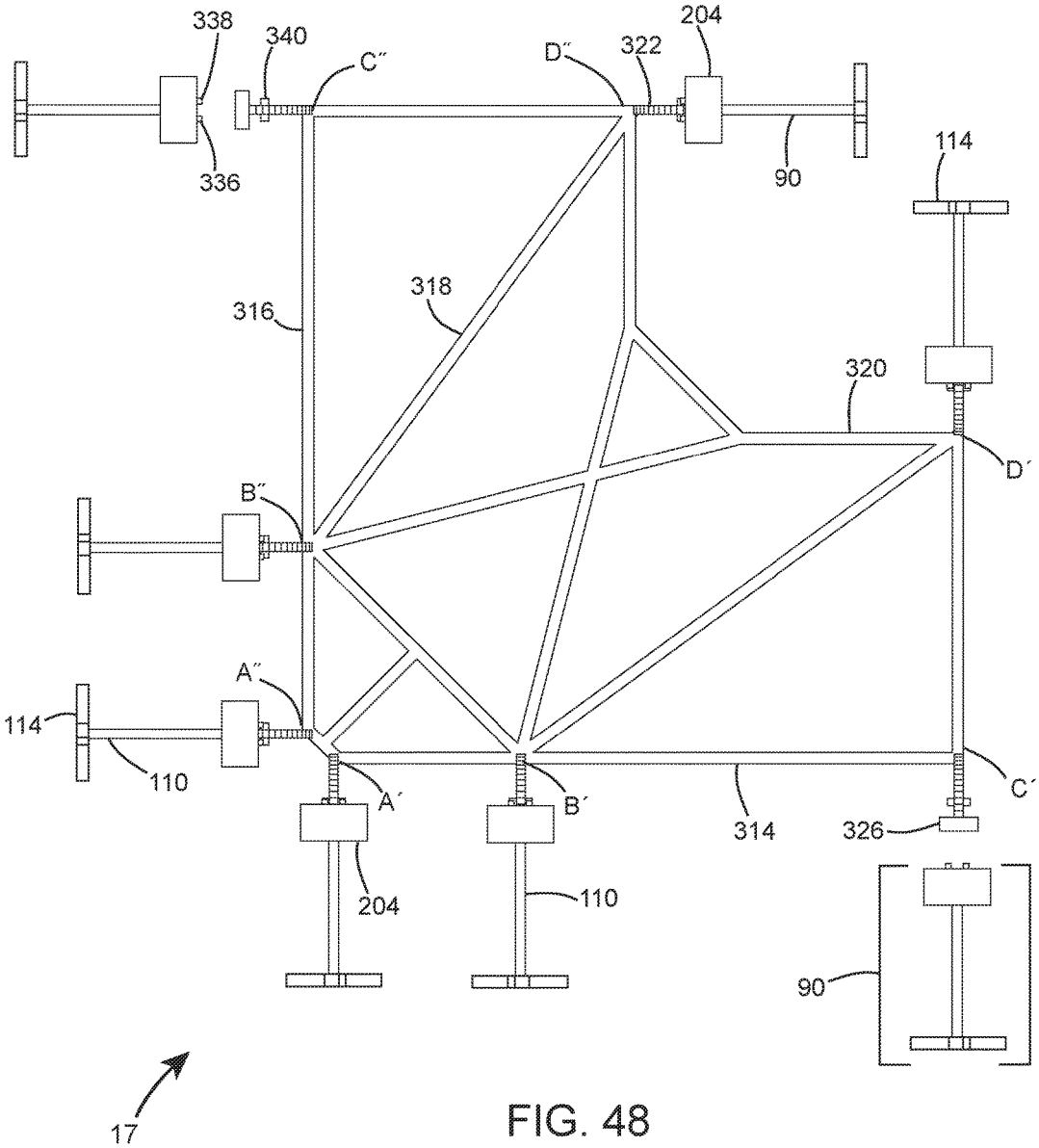
FIG. 48 is a bottom plan view of the preferred embodiment of the present invention illustrating a corner panel spacing tie comprising a unified corner frame having connective nodes for fixedly attaching end sections thereto.

In supplementing the overall structure of the corner block assembly 12*b*, end sections 90 of the corner panel spacing tie 17 are configured for connection to a unified corner frame 314 near connective nodes A', A", B', B", C', C", D', D" generally associated with an exterior frame 316, as seen in FIG. 48. The unified corner frame is particularly shown in FIGS. 47 and 48 as comprising an interior sub-frame assembly 318 having cross braces 320 angularly extending to a pre-select number of the connective nodes that serve to reinforce mounting of the sleeve associated with each end section as well as equally distributing linear forces along the overall structure of the unified corner frame. Generally extending outwardly from and connecting to each connective node is a semi-circular disk 322 that is vertically orientated relative to the exterior frame 316 and comprises a lengthened side 324 for engaging and attaching thereto a vertical flange 326 to substantially form a T-shaped mount 328 of the type illustrated in FIG. 48. The T-shaped mount in this regard is geometrically configured to correspond with that of a T-shaped receptacle 330 extending lenghthwise partway through the vertical sleeve 204 where a linear opening 332 associated with the T-shaped receptacle accommodates passage of a portion of the semi-circular disc 322. Locking of the T-shaped mount 328 relatively within the confines of the T-shaped receptacle occurs by the presence of a sub-locking assembly 334, where it is shown in FIG. 47 as comprising a pair of upper and lower protuberances 336, 338 each being present relatively about each side of the linear opening to operably interact with a pair of posts 340 extending outwardly and connecting to sideward faces 322*a* of the semi-circular disk 322. A slot 342 formed in between the upper and lower protuberances is configured to accept therewithin each post 340 to prevent linear movement of the T-shaped mount 328 upwardly through the T-shaped receptacle 330 and apart from a T-shaped opening 344. To ease the transitional placement of the post relatively within each slot, the upper and lower protuberances are shown in FIG. 47 as comprising outward ramped portions 336*a*, 338*a*.

Figure 49:
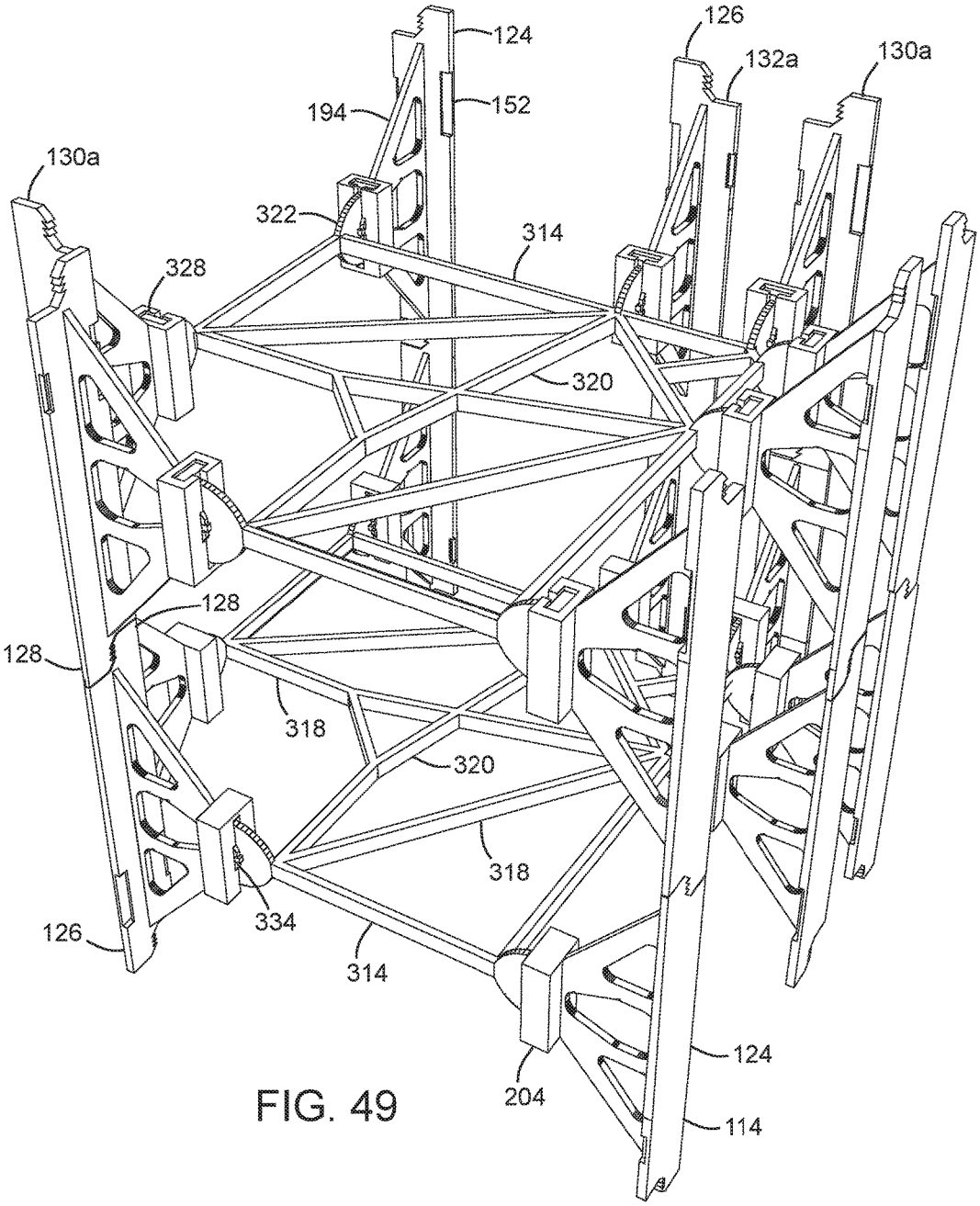
FIG. 49 is a front perspective view of the preferred embodiment of the present invention illustrating a pair of corner panel spacing tie vertically stacked upon and connected to one another by locking means.
Figure 50:
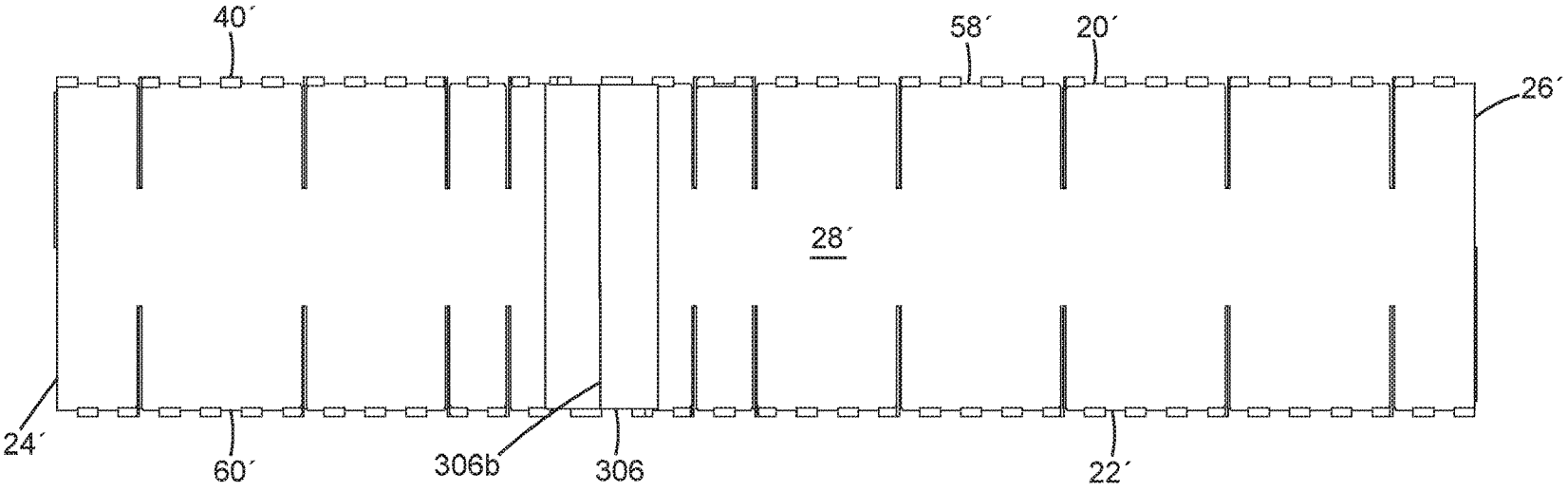
FIG. 50 is a back elevational view of the preferred embodiment of the present invention illustrating an outer corner side panel having a v-shaped cutout and a plurality of tie receivers.
Figure 51:
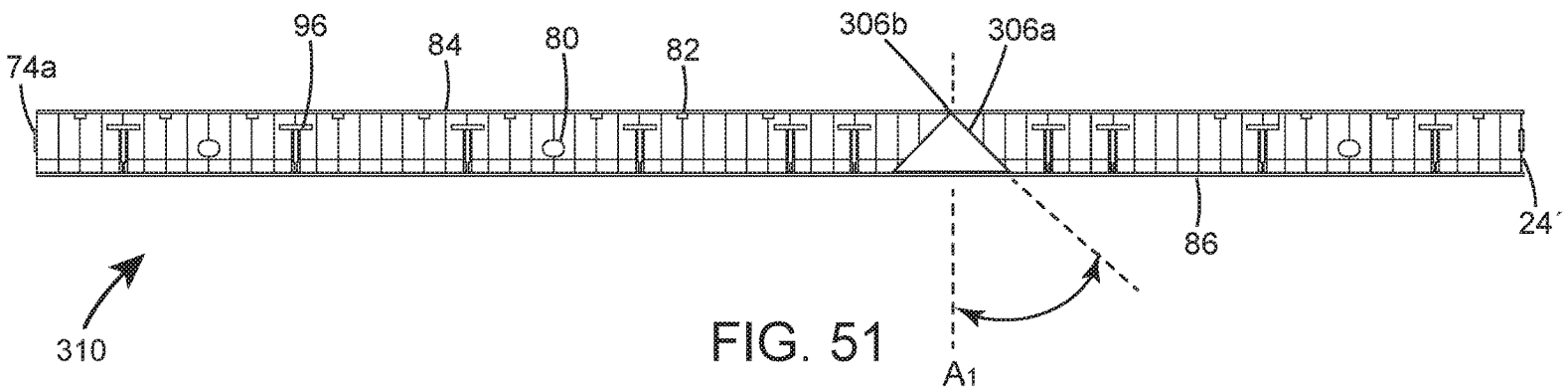
FIG. 51 is a bottom plan view of the preferred embodiment of the present invention illustrating an outer corner side panel comprising a v-shaped cutout, a plurality of tie receivers and an interior face laminated with a membrane or film.

In fulfilling reversibility of the corner block assembly 12*b* to the likes of the longitudinal block assembly 12*a*, each end section 90 of the corner panel spacing tie 17 as affiliated with each connective node is configured with a properly orientated flange member that accommodates connection of a stack arrangement of corner block assemblies 12*b* by locking means regardless of orientation, particularly as such to provide a continuous internal support of the flange members relatively at and near the corner wall structure for supplemental rigidity thereabout. Accordingly, the first opposing ends 126 as well as the second opposing ends 128 associated with a complementary pair of flange members at connective nodes A'-A", B'-B", C'-C", D'-D" are shown in FIGS. 47 and 49 as having oppositely orientated set of teeth that fulfill operation of locking means where the first opposing ends 126 are available for connection with upwardly or downwardly stacked flange members 114 of neighboring corner block assemblies by locking means, primarily in vicinity of interlocking means, while the second opposing ends 128 are available for connection with one another internally within the tie receiver 88 of the outer and inner corner side panels 310, 312 by locking means. As a further example of this arrangement, the first opposing ends of the flange members associated with a first, non-inverted corner block assembly 12*b* at connective nodes A'-A" will inversely and respectively correspond for connection with the first opposing ends of the flange members associated with a second, inverted corner block assembly at connective node A"-A' and so forth with respect to the remaining connective nodes B'-B", C'-C", D'-D". Furthermore, the flange members 114 associated with the panel spacing ties of the first, non-inverted corner block assembly will correspond for connection with those associated with the inverted corner block assembly, whereas the remaining unconnected flange members of panel spacing ties 14 not used in this manner of configuration will be available for connection with those associated with the longitudinal block assembly 12*a* such to provide an offsetting or staggered arrangement of vertical seams among adjoining block assemblies. In this regard, the corner panel spacing ties operating in conjunction with the reversible configuration proffered by the panel spacing ties 17 allows for inverted and non-inverted placement of multiple, stacked corner block assemblies 12*b* to attain flexibility in constructing the concrete wall structure with supplemental support to withstand increased amounts of hydrostatic pressures generally associated with poured concrete.

Now by way of briefly describing the assembly of the longitudinal and corner block assemblies 12*a*, 12*b* in the context of preparing for fabrication of a concrete wall structure one will appreciably gain further insight into understanding the utilitarian benefits of the ICF system 10.

In typical applications involving the ICF system 10, each of the longitudinal block assemblies 12*a* is preferably preconfigured at the factory where the first and second side panels 16', 16" are appropriately orientated relative to one another to allow for inverted or reversed orientation of the longitudinal block assembly that further effects connectivity to adjacent, vertically placed block assemblies by interlocking means. Each longitudinal block assembly is shown in FIGS. 1 and 3 to comprise opposing sets of tie receivers 88 integrated within the structure of the side panels thereof with each tie receiver having upwardly- and downwardly-aligned access slots 108 designated for receiving therein end sections 90 of a pair of panel spacing ties 14 vertically positioned atop of one another. By means of this configuration, the flange members 114 associated with the end sections are allowed to mate and lock with one another while being contained within the opposing spatial wedges 104 by locking means such to form a continuous lineal structure interiorly within the side panel, whereas unconnected first opposing ends 126 of the flange members generally coincide with interlocking means to make available their connective relation with neighboring block assemblies of like configuration by locking means.

Since the panel spacing ties 14 are initially maintained without engagement of the locking mechanism 244, 246 in association therewith, the first and second side panels are permitted to collapse inwardly toward one another in rather a rackable manner as generally depicted in FIGS. 4, 6 and 9 where the mid-support section 116 of each connected panel spacing tie resides relatively lengthwise within the compacted space 212, particularly being advantageous in attaining compactness for economical shipping to a job site, for example.

Contrariwise, each corner block assembly 12*b* may or may not be pre-configured to the likes of the longitudinal block assembly 12*a*, particularly being dependent on the need to attain compactness for economical shipping and/or the time constraints imposed upon personnel during field assembly of the ICF system. However, in instances of fabrication, the corner block assembly is configured with first and second side panels that have been modified with v-shaped cutouts 306, 308 to allow folding of the side panel relatively thereabout insofar to achieve the requisite 90° angular relationship of the side panels for formation of the concrete corner wall structure. In further aspects of assembly, a pair of corner panel spacing ties 17 is appropriately placed and anchored within designated tie receivers 88 located most near the v-shaped cutout to offer increased structural strength and rigidity thereabout and safeguard against inadvertent occurrences of hydrostatic blowout that is commonly observed in the art with other known prior art assemblies and techniques, whereas the remaining sets of opposing tie receivers accept end sections 90 of the panel spacing ties 14 to the likes of the longitudinal block assembly 12*a*. Like the longitudinal block assembly, the panel and corner panel spacing ties 14, 17 operably associated with the corner block assembly 12*b* shown in FIG. 54 provide a continuous lineal flange structure embedded interiorly within the side panel for increased structural rigidity to withstand transport and assembly of the ICF system 10 and pouring of concrete as well as supportive mounting of finishing materials and the like after concrete wall formation.

The design aspects of the concrete wall structure, notably in terms of lineal and height dimensions, will generally dictate the size and number of longitudinal and corner block assemblies required to complete the wall structure. Concrete wall formation using the ICF system 10 is similar in part to traditional methods in that an aboveground or a belowground footing is utilized to support the load of the finished concrete wall structure.

In an exemplary application directed to forming a concrete wall structure having a square-shaped perimeter without openings, four pre-assembled corner block assemblies 12*b* would be appropriately placed onto the footing to establish the overall dimensions of the wall structure. Longitudinal block assemblies 12*a*, each being configured with panel spacing ties 14 orientated in an aligned, locked state by means of the locking mechanism 244, 246, would be adjacently placed and connected to the corner block assemblies by means of appropriately aligning and engaging the tongue and groove configurations generally present about the first and second ends of the side panels associated with the block assemblies.

Figure 45:
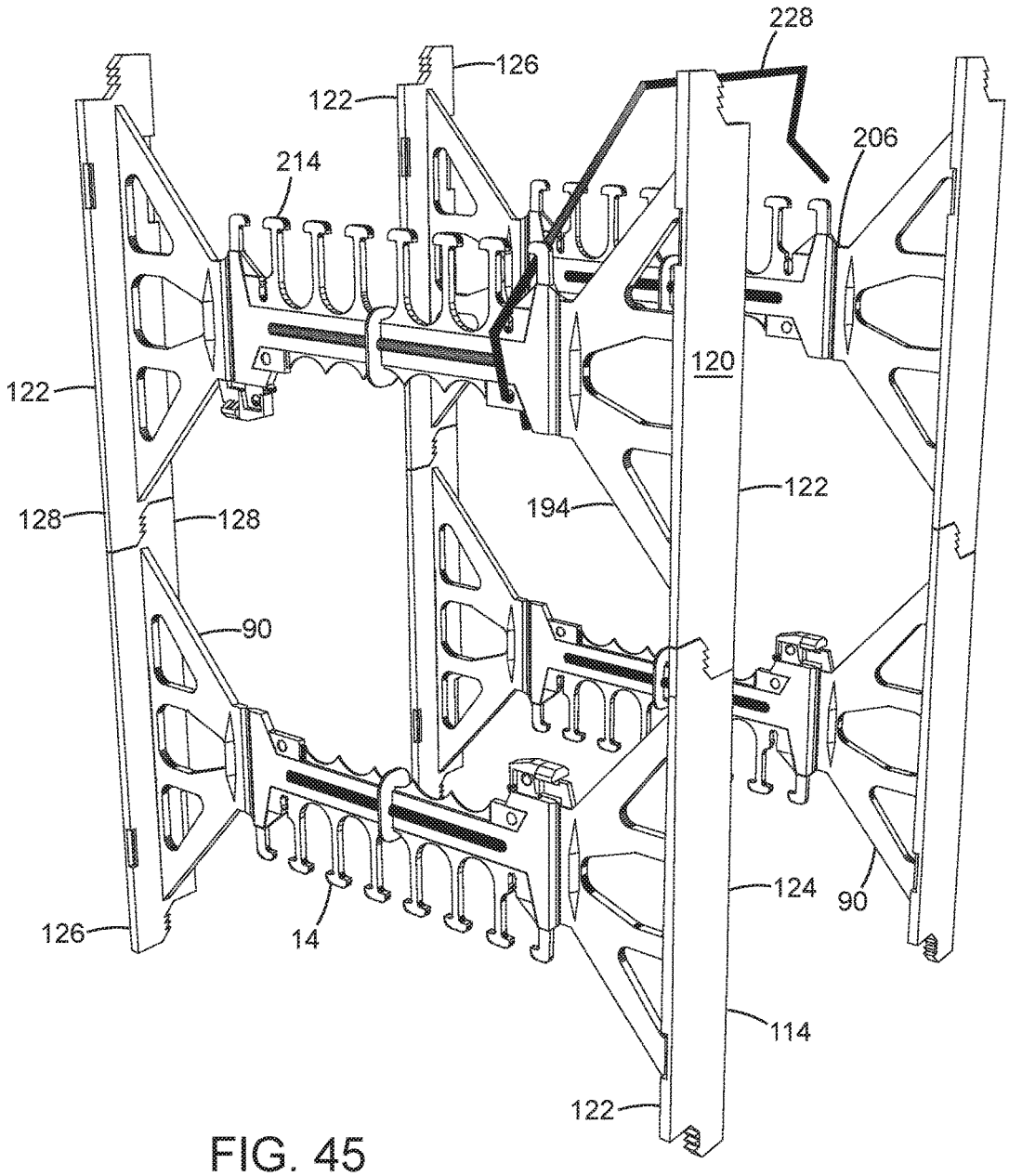
FIG. 45 is a front perspective view of the preferred embodiment of the present invention illustrating a side-by-side pair of panel spacing ties proposed for lateral supportive connection by a section of wire.
Figure 46:
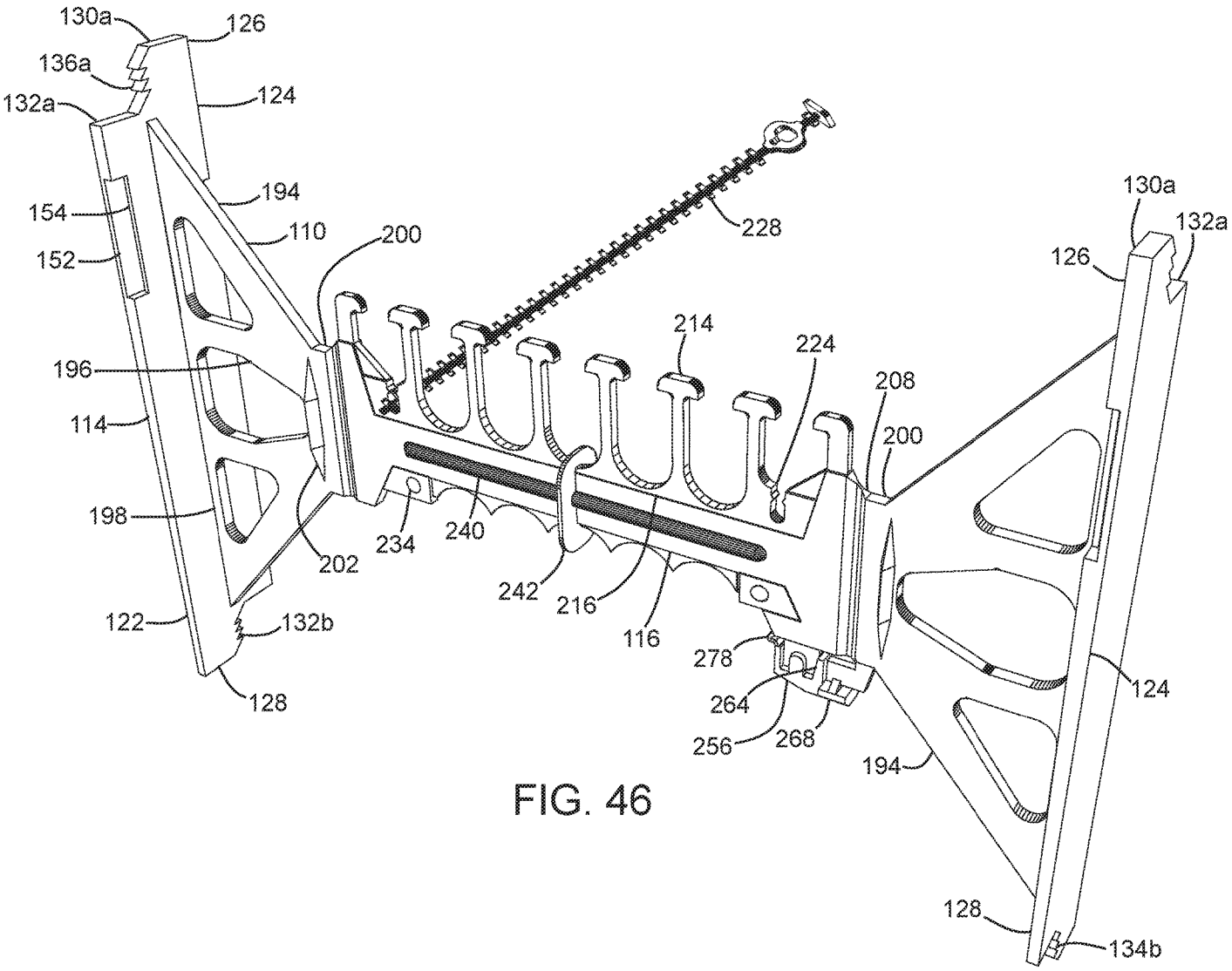
FIG. 46 is a front perspective view of the preferred embodiment of the present invention illustrating a panel spacing tie proposed for lateral supportive connection by a lateral support member.

Since the lineal dimensions of the concrete wall structure may differ from the aggregate lineal dimension of adjacently placed block assemblies as dimensionally manufactured on an individual basis, it is permissible to vertically cut the opposing side panels along integral scribe markings 346 present on the exterior face 30', 30" of the side panel. Consequently, this may result in the loss of the tongue and groove configuration associated with ends of the side panels. Accordingly, in this instance, one or more lateral support members 228 or wires extending in between and connecting neighboring panel spacing ties 14 may be appropriately utilized to retain a relative amount of structural strength along an otherwise weakened pair of vertical seams, typically in the manner illustrated in FIG. 45.

In furthering completion of the concrete wall structure in this exemplary instance, supplemental corner block assemblies are systematically stacked atop of the initially placed corner block assemblies where the side panels 16', 16" in association therewith are vertically cut along integral scribe markings 346 to fulfill an offsetting relation of supplemental, adjacently placed longitudinal block assemblies suited for connection with one another. In situations where the concrete wall structure desirably requires accommodation of electrical and plumbing lines as well as means for channeling moisture from the exterior side of the finished wall structure, attention is given to vertically align the vertical passageways 80 and channels 82 inherently associated with the side panels constituting in part the longitudinal and corner block assemblies. Further provisions in the nature of an applied membrane or film 84, 86 to the interior or exterior face of one or more side panels or combination thereof offers to mitigate occurrences of intrusion of debris and other foreign substances such as concrete into the channels, supplements the structural strength of the block assemblies and increases the energy efficiency or rating of the finished concrete wall structure.

As it can be seen from the foregoing there is provided in accordance with this invention a simple and easily assembled system that is particularly suited to economically develop and fabricate finished concrete wall structures through the applied use of panel spacing ties 14 operably interacting with side panels 16', 16" to form longitudinal and corner block assemblies 12*a*, 12*b* possessing the capacity to offer compactness for economical shipping and transport, efficient assembly by field personnel, accommodations for plumbing lines, electrical wire, etc., and an appreciably increase in the structural strength and rigidity thereof to mitigate occurrences of hydrostatic blowout that may otherwise unreasonably delay and increase the overall cost of concrete wall formation.

It is obvious that the components comprising the ICF system 10 may be fabricated from a variety of materials, providing such selection or use of materials possess the capacity to withstand tensional and compressive forces acting thereon throughout its duration of use in fabricating and erecting concrete wall structures. Accordingly, it is most desirable, and therefore preferred, to fabricate the side panels 16', 16" from expanded polystyrene (EPS) or equivalent type of materials that offers to fulfill energy efficiencies mandated by applicable building codes and capable of being thermally-shaped molded in terms of attaining the overall shape with variations in dimensional thickness and length thereof and offering characteristics directed to integral scribe markings 346 representing horizontal and vertical cut lines at predetermined invervals, provisions for drainage channels 82, and visual markings 348 embossed, raised or depressed into the exterior face of the side panel for identifying vertical passageways, flange members and the like features, as seen in FIGS. 1 and 6, notwithstanding the presence of film 84 applied thereover and onto the exterior face 30', 30". In the other respects, the panel and corner spacing ties 14, 17 are preferably fabricated from thermoplastic polymers such as nylon, polyethylene, polystyrene, ABS, or polycarbonate and formed using plastic injection molding techniques or equivalent.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. An insulating concrete form system, comprising, in combination:

first and second side panels each having interior and exterior faces, first and second end walls, and top and bottom leading edges;

a plurality of tie receivers embedded interiorly within each of said first and second side panels, said tie receivers of the first side panel being configured to align with and oppose said tie receivers of the second side panel to form complementary pairs of tie receivers, each of said tie receivers having a first slot perpendicularly orientating to and openly communicating with a second slot to form a T-shaped slot, said first slot having a pair of nonlinear sidewalls defining a pair of opposing spatial wedges openly communicating with one another, each of said tie receivers having a pair of aligned access slots openly communicating with said second slot and intercepting said interior face of each of the first and second side panels; and a plurality of panel spacing ties configured to hold said first and second side panels apart from one another in an opposing manner, each of said panel spacing ties having a mid-support section interposing in between and connecting to a pair of end sections, each of said end sections having a truss support connecting to and supporting a flange member geometrically corresponding to one of said opposing spatial wedges for containment therewithin, said flange member having first and second opposing ends each being configured with locking means for connecting and holding together a vertically stacked arrangement of panel spacing ties while said end sections pass through said aligned access slots for containment within said tie receivers.

2. The insulating concrete form system as set forth in claim 1, wherein said top and bottom leading edges of the first and second side panels each comprise a longitudinal outward portion having an alternating arrangement of primary projections and primary recesses and a longitudinal inward portion having an alternating arrangement of secondary projections and secondary recesses.

3. The insulating concrete form system as set forth in claim 2, wherein said top and bottom leading edges of each of the first and second side panels comprise a shared first position relatively near said first end wall and a shared last position relatively near said second end wall, said shared first position of the top and bottom leading edges respectively accommodating said primary projection and said primary recess present about said longitudinal outward portion and said secondary recess and said secondary projection present about said longitudinal inward portion, said shared last position of the top and bottom leading edges respectively accommodating said primary recess and said primary projection present about said longitudinal outward portion and said secondary projection and said secondary recess present about said longitudinal inward portion.

4. The insulating concrete form system as set forth in claim 3, wherein said first end wall of the first side panel is orientated to align with and correspond to said second end wall of the second side panel while said interior faces of the first and second side panels substantially oppose one another, whereby said primary projections and said primary recesses of the longitudinal outward portions of the first side panel respectively traverse and align with said primary recesses and said primary projections of the longitudinal outward portions of the second side panel and said secondary projections and said secondary recesses of the longitudinal inward portions of the first side panel respectively traverse and align with said secondary recesses and said secondary projections of the longitudinal inward portions of the second side panel.

5. The insulating concrete form system as set forth in claim 2, wherein said primary projections of the longitudinal outward portions of the first and second side panels each comprises a height comparatively greater than a height associated with said secondary projections of the longitudinal inward portions of the first and second side panels.

6. The insulating concrete form system as set forth in claim 1, wherein said first and second end walls of the first and second side panels each comprise a tongue and groove configuration for adjoining and connecting together one or more complementary sets of first and second side panels placed in a side-by-side manner.

7. The insulating concrete form system as set forth in claim 1, wherein said aligned access slot comprises a pair of inward walls each being configured with an elongate nub extending inwardly into said aligned access slot to supplementally hold said truss support.

8. The insulating concrete form system as set forth in claim 1, wherein said first and second side panels each comprise a plurality of vertical passageways each being spaced apart from one another a predetermined distance, said exterior faces of the first and second side panels having embedded markings for identifying and locating said vertical passageways embedded interiorly within each of said first and second side panels.

9. The insulating concrete form system as set forth in claim 1, wherein said locking means comprises a vertical riser having a set of teeth and being situated in between an upper ridge and a lower ridge.

10. The insulating concrete form system as set forth in claim 9, wherein said set of teeth associated with the first opposing end of the flange member extend directionally opposite of said set of teeth associated with the second opposing end.

11. The insulating concrete form system as set forth in claim 1, wherein each of said end sections connects to said mid-support section by a living hinge to further a degree of angular movement relatively to one another.

12. The insulating concrete form system as set forth in claim 11, wherein said living hinge comprises an elongate flexible member capable of allowing each of said end sections of the panel spacing tie to move angularly leftward or rightward approximately 100° from a static position of the mid-support section.

13. The insulating concrete form system as set forth in claim 12, wherein said panel spacing tie comprises a locking mechanism spanning across said living hinge to substantially limit angular movement of said end section relatively to said mid-support section of the panel spacing tie.

14. The insulating concrete form system as set forth in claim 13, wherein said locking mechanism comprises an L-shaped member extending downwardly from one of said end sections of the panel spacing tie and spanning across said living hinge, a planar extension extending downwardly from said mid-support section, and a swinging latch having a receiver adaptable for receiving said planar extension, said receiver having an upward support configured with a cylindrical sideward member to engagingly fit within an aperture extending through said planar extension, said swinging latch having a platform configured with a pair of offsetting protuberances extending upwardly therefrom to frictionally mate with an extendable portion of the L-shaped member.

15. The insulating concrete form system as set forth in claim 13, wherein said locking mechanism comprises a horizontal plate connecting to and extending perpendicular to said mid-support section to form a T-mount and a sliding latch having a gripable head integrally connecting to an elongate arm configured with a semi-cylindrical configuration, said gripable head having an internal rectangular recess geometrically corresponding to said horizontal plate and an internal vertical recess perpendicularly orientated to and in spatial communication with said internal rectangular recess to generally form a T-shaped recess to spatially accommodate said T-mount, said end section of the panel spacing tie having a pair of offsetting lobes integrally connecting to and extending angularly outward therefrom to slidably receive and frictionally engage said elongate arm while spanning across said living hinge.

16. The insulating concrete form system as set forth in claim 1, wherein said mid-support section comprises a top edge configured with a plurality of T-stems extending upwardly therefrom.

17. The insulating concrete form system as set forth in claim 1, wherein each of said complementary pairs of tie receivers of the first and second side panels accommodate placement of a pair of panel spacing ties vertically arranged with one another to allow said second opposing ends of the flange members to connect together by locking means while confined within said pair of opposing spatial wedges and said first opposing ends of the flange members to extend into said primary projections of the longitudinal outward portions of the first and second side panels.

18. The insulating concrete form system as set forth in claim 1, wherein said second opposing end of the flange member comprises a width less than a width of the first opposing end by approximately 0.25-20%.

19. The insulating concrete form system as set forth in claim 1, wherein said interior face of the first side panel comprises a v-shaped cutout having a pair of angular sides and a vertex, whereby folding said first side panel relatively about said vertex to the extent said angular sides of the v-shaped cutout of the first side panel engage with one another forms an outer corner side panel, said exterior face of the second side panel comprises a v-shaped cutout having a pair of angular sides and a vertex, whereby folding said second side panel relatively about said vertex to the extent said angular sides of the v-shaped cutout of the second side panel engage with one another forms an inner corner side panel.

20. The insulating concrete form system as set forth in claim 19, further comprising a pair of corner spacing ties each having a unified corner frame configured with connective nodes for connecting thereto an equal number of end sections, each of said end sections of the corner spacing tie being configured with said flange member capable of fitting within one of said opposing spatial wedges and having a vertical sleeve configured with a T-shaped receptacle, each of said connective nodes having a semi-circular disk and a vertical flange attached thereto to form a T-shaped mount for placement within said T-shaped receptacle.

21. The insulating concrete form system as set forth in claim 20, wherein said corner spacing ties are placed in vicinity of said v-shaped cutouts of the first and second side panels respectively forming said outer corner and inner corner side panels and vertically stacked and orientated thereabout to enable said second opposing ends of the flange members to connect with one another by locking means while contained within said tie receiver.

22. The insulating concrete form system as set forth in claim 1, wherein said second slot comprises a triangular stop situated midway thereof and having sides abutting against and engaging an outer angular support of the truss support.

23. The insulating concrete form system as set forth in claim 1, wherein said exterior faces of the first and second side panels each comprises a plurality of channels each being spaced apart from one another a predetermined distance and a membrane exteriorly applied over said exterior faces to encapsulate said channels.

24. The insulating concrete form system as set forth in claim 1, further comprising locating means for locating said flange members embedded interiorly within each of said first and second side panels, said flange member having a sideward slot configured with an accessible recessed portion and an internal sleeve integrally open to said accessible recessed portion.

25. The insulating concrete form system as set forth in claim 24, wherein said locating means comprises embedded markings present about said exteriors faces of the first and second side panel adaptively designating each of said tie receivers.

26. The insulating concrete form system as set forth in claim 24, wherein said locating means comprises a metallic plate having a first end slidably positioned within said internal sleeve and a second exposed end extending outwardly beyond a first or second sideward member of the flange member.

27. The insulating concrete form system as set forth in claim 24, wherein said locating means comprises a metallic rod having a first end placed within said internal sleeve and a second end extending outwardly beyond a first or second sideward member of the flange member.

28. The insulating concrete form system as set forth in claim 24, wherein said locating means comprises a metallic, angularly shaped plate having a planar mid-section interposing in between and connecting to an end section formed into a rectangular configuration with a free outward end slidably engaging said accessible recessed portion to reside within said internal sleeve and an opposing angular end configured to extend beyond said interior face of each of the first and second side panels.

29. The insulating concrete form system as set forth in claim 24, wherein said locating means comprises a sliding bendable plate having an end configured as u-shaped sleeve to slidably fit externally over said first opposing end of the flange member and an inwardly extending member integrally connecting to said u-shaped sleeve, said inwardly extending member having an outward bent member configured with a v-shaped end.

30. The insulating concrete form system as set forth in claim 1, wherein said mid-support section comprises a pair of outermost open receptacles each being positioned near ends of the mid-support section, said outermost open receptacles each having a concave slot capable of holding therewithin a pre-select portion of a lateral support member to supplementally hold said panel spacing ties located adjacent to one another.

31. An insulating concrete form system, comprising, in combination:

first and second side panels each having interior and exterior faces, first and second end walls, and top and bottom leading edges, said interior face of the first side panel having a v-shaped cutout with a pair of angular sides and a vertex, whereby folding said first side panel relatively about said vertex to the extent said angular sides of the v-shaped cutout of the first side panel engage with one another forms an outer corner side panel, said exterior face of the second side panel having a v-shaped cutout having a pair of angular sides and a vertex, whereby folding said second side panel relatively about said vertex to the extent said angular sides of the v-shaped cutout of the second side panel engage with one another forms an inner corner side panel;

a plurality of tie receivers embedded interiorly within each of said outer and inner corner side panels, each of said tie receivers having a first slot perpendicularly orientating to and openly communicating with a second slot to form a T-shaped slot, said first slot having a pair of nonlinear sidewalls defining a pair of opposing spatial wedges openly communicating with one another, each of said tie receivers having a pair of aligned access slots openly communicating with said second slot and intercepting said interior face of each of said outer and inner corner side panels; and a plurality of panel spacing ties configured to hold said outer corner side panel apart from said inner corner side panel in an opposing manner, each of said panel spacing ties having a mid-support section interposing in between and connecting to a pair of end sections, each of said end sections having a truss support connecting to and supporting a flange member geometrically corresponding to one of said opposing spatial wedges for containment therewithin, said flange member having first and second opposing ends each being configured with locking means for connecting and holding together a vertically stacked arrangement of panel spacing ties while said end sections pass through said aligned access slots for containment within said tie receivers.

32. The insulating concrete form system as set forth in claim 31, wherein said top and bottom leading edges of the outer and inner corner side panels each comprise a longitudinal outward portion having an alternating arrangement of primary projections and primary recesses and a longitudinal inward portion having an alternating arrangement of secondary projections and secondary recesses.

33. The insulating concrete form system as set forth in claim 32, wherein said top and bottom leading edges of each of said outer and inner corner side panels comprise a shared first position relatively near said first end wall and a shared last position relatively near said second end wall, said shared first position of the top and bottom leading edges respectively accommodating said primary projection and said primary recess present about said longitudinal outward portion and said secondary recess and said secondary projection present about said longitudinal inward portion, said shared last position of the top and bottom leading edges respectively accommodating said primary recess and said primary projection present about said longitudinal outward portion and said secondary projection and said secondary recess present about said longitudinal inward portion.

34. The insulating concrete form system as set forth in claim 33, wherein said first end wall of the outer corner side panel is orientated to align with and correspond to said second end wall of the inner corner side panel while said interior faces of the outer and inner corner side panels substantially oppose one another.

35. The insulating concrete form system as set forth in claim 34, wherein said first and second end walls of the outer and inner corner side panels each comprise a tongue and groove configuration.

36. The insulating concrete form system as set forth in claim 31, further comprising a pair of corner spacing ties each having a unified corner frame configured with connective nodes for connecting thereto an equal number of end sections, each of said end sections of the corner spacing tie being configured with said flange member capable of fitting within one of said opposing spatial wedges and having a vertical sleeve configured with a T-shaped receptacle, each of said connective nodes having a semi-circular disk and a vertical flange attached thereto to form a T-shaped mount for placement within said T-shaped receptacle.

37. The insulating concrete form system as set forth in claim 36, wherein said corner spacing ties are vertically stacked to enable said second opposing ends of the flange members to connect with one another by locking means while being housed within said tie receiver.

38. The insulating concrete form system as set forth in claim 31, wherein said panel spacing tie comprises locating means for locating said flange members embedded interiorly within each of said outer and inner corner side panels.

39. The insulating concrete form system as set forth in claim 31, wherein each of said end sections connects to said mid-support section by a living hinge, said living hinge having an elongate flexible member capable of allowing each of said end sections of the panel spacing tie to move angularly leftward or rightward approximately 100° from a static position of the mid-support section.

40. The insulating concrete form system as set forth in claim 39, wherein said panel spacing tie comprises a locking mechanism spanning across said living hinge to substantially limit angular movement of said end section relatively to said mid-support section of the panel spacing tie.

41. The insulating concrete form system as set forth in claim 39, wherein said panel spacing tie comprises a locking mechanism having an L-shaped member extending downwardly from one of said end sections of the panel spacing tie and spanning across said living hinge, a planar extension extending downwardly from said mid-support section, and a swinging latch having a receiver adaptable for receiving said planar extension, said receiver having an upward support configured with a cylindrical sideward member to engagingly fit within an aperture extending through said planar extension, said swinging latch having a platform configured with a pair of offsetting protuberances extending upwardly therefrom to frictionally mate with an extendable portion of the L-shaped member.

42. The insulating concrete form system as set forth in claim 39, wherein said panel spacing tie comprises a locking mechanism having a horizontal plate connecting to and extending perpendicular to said mid-support section to form a T-mount and a sliding latch having a gripable head integrally connecting to an elongate arm configured with a semi-cylindrical configuration, said gripable head having an internal rectangular recess geometrically corresponding to said horizontal plate and an internal vertical recess perpendicularly orientated to and in spatial communication with said internal rectangular recess to generally form a T-shaped recess to spatially accommodate said T-mount, said end section of the panel spacing tie having a pair of offsetting lobes integrally connecting to and extending angularly outward therefrom to slidably receive and frictionally engage said elongate arm while spanning across said living hinge.

43. The insulating concrete form system as set forth in claim 31, wherein said locking means comprises a vertical riser having teeth and being situated in between an upper ridge and a lower ridge, said teeth of the first opposing end of the flange member extend directionally opposite of said teeth of the second opposing end of the flange member.

44. An insulating concrete form system, comprising, in combination:

first and second side panels each having interior and exterior faces, first and second end walls, and top and bottom leading edges;

outer and inner corner side panels each having interior and exterior faces, first and second end walls, and top and bottom leading edges;

a plurality of tie receivers embedded interiorly within each of said first and second side panels and said outer and inner corner side panels, each of said tie receivers having a first slot perpendicularly orientating to and openly communicating with a second slot to form a T-shaped slot, said first slot having a pair of nonlinear sidewalls defining a pair of opposing spatial wedges openly communicating with one another, each of said tie receivers having a pair of aligned access slots openly communicating with said second slot and intercepting said interior face of each of said outer and inner corner side panels; and a plurality of panel spacing ties configured to hold said first side panel apart from said second side panel as a complementary set of side panels and said outer corner side panel apart from said inner corner side panel as a complementary set of corner side panels, each of said panel spacing ties having a mid-support section interposing in between and connecting to a pair of end sections, each of said end sections having a truss support connecting to and supporting a flange member geometrically corresponding to one of said opposing spatial wedges for containment therewithin, said flange member having first and second opposing ends each being configured with locking means for connecting and holding together a vertically stacked arrangement of panel spacing ties while said end sections pass through said aligned access slots for containment within said tie receivers.

45. The insulating concrete form system as set forth in claim 44, wherein said top and bottom leading edges of the first and second side panels and said top and bottom leading edges of the outer and inner corner side panels each comprise a longitudinal outward portion having an alternating arrangement of primary projections and primary recesses and a longitudinal inward portion having an alternating arrangement of secondary projections and secondary recesses.

46. The insulating concrete form system as set forth in claim 44, wherein said first end wall of the outer corner side panel is orientated to align with and correspond to said second end wall of the inner corner side panel while said interior faces of the outer and inner corner side panels substantially oppose one another.

47. The insulating concrete form system as set forth in claim 45, wherein said first end wall of the first side panel is orientated to align with and correspond to said second end wall of the second side panel while said interior faces of the first and second side panels substantially oppose one another, whereby said primary projections and said primary recesses of the longitudinal outward portions of the first side panel respectively traverse and align with said primary recesses and said primary projections of the longitudinal outward portions of the second side panel and said secondary projections and said secondary recesses of the longitudinal inward portions of the first side panel respectively traverse and align with said secondary recesses and said secondary projections of the longitudinal inward portions of the second side panel.

48. The insulating concrete form system as set forth in claim 44, wherein said first and second end walls of the outer and inner corner side panels and said first and second end walls of the first and second side panels each respectively comprise a tongue and groove configuration for adjoining and connecting together in a side-by-side manner more than one complementary sets of side panels and more than one complementary sets of corner side panels.

49. The insulating concrete form system as set forth in claim 44, further comprising a pair of corner spacing ties each having a unified corner frame configured with connective nodes for connecting thereto an equal number of end sections, each of said end sections of the corner spacing tie being configured with said flange member capable of fitting within one of said opposing spatial wedges and having a vertical sleeve configured with a T-shaped receptacle, each of said connective nodes having a semi-circular disk and a vertical flange attached thereto to form a T-shaped mount for placement within said T-shaped receptacle.

50. The insulating concrete form system as set forth in claim 49, wherein said corner spacing ties are vertically stacked to enable said second opposing ends of the flange members to connect with one another by locking means while contained within said tie receiver.

51. The insulating concrete form system as set forth in claim 44, wherein said panel spacing tie and said corner spacing tie each comprises locating means for locating said flange members embedded interiorly within each of said first and second said panels and said outer and inner corner side panels.

52. The insulating concrete form system as set forth in claim 44, wherein each of said end sections connects to said mid-support section by a living hinge, said living hinge having an elongate flexible member capable of allowing each of said end sections of the panel spacing tie to move angularly leftward or rightward approximately 100° from a static position of the mid-support section.

53. The insulating concrete form system as set forth in claim 52, wherein said panel spacing tie comprises a locking mechanism having an L-shaped member extending downwardly from one of said end sections of the panel spacing tie and spanning across said living hinge, a planar extension extending downwardly from said mid-support section, and a swinging latch having a receiver adaptable for receiving said planar extension, said receiver having an upward support configured with a cylindrical sideward member to engagingly fit within an aperture extending through said planar extension, said swinging latch having a platform configured with a pair of offsetting protuberances extending upwardly therefrom to frictionally mate with an extendable portion of the L-shaped member.

54. The insulating concrete form system as set forth in claim 52, wherein said panel spacing tie comprises a locking mechanism having a horizontal plate connecting to and extending perpendicular to said mid-support section to form a T-mount and a sliding latch having a gripable head integrally connecting to an elongate arm configured with a semi-cylindrical configuration, said gripable head having an internal rectangular recess geometrically corresponding to said horizontal plate and an internal vertical recess perpendicularly orientated to and in spatial communication with said internal rectangular recess to generally form a T-shaped recess to spatially accommodate said T-mount, said end section of the panel spacing tie having a pair of offsetting lobes integrally connecting to and extending angularly outward therefrom to slidably receive and frictionally engage said elongate arm while spanning across said living hinge.

55. The insulating concrete form system as set forth in claim 44, wherein said locking means comprises a vertical riser having teeth and being situated in between an upper ridge and a lower ridge, said teeth of the first opposing end of the flange member extend directionally opposite of said teeth of the second opposing end of the flange member.

* * * * *